US012622509B2

(12) United States Patent
Flynn et al.

(10) Patent No.: US 12,622,509 B2
(45) **Date of Patent: *May 12, 2026**

(54) PRODUCT FOR HOLDING ITEMS AND METHOD FOR MAKING SAME

(71) Applicant: Nupur, LLC, Baltimore, MD (US)

(72) Inventors: Nupur Parekh Flynn, Baltimore, MD (US); Jennifer Ann Ewing, Easton, MD (US); Shannon Theresa Shingleton, Arnold, MD (US); Douglas Pemberton, Timonium, MD (US); Jeremy Asher Higgings, Kansas City, MO (US); Jordan Douglas Hayes, Baltimore, MD (US); Kevin Barnes, Baltimore, MD (US); Joshua Barnes, Kansas City, MO (US)

(73) Assignee: Nupur, LLC, Baltimore, MD (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/355,993

(22) Filed: Jun. 23, 2021

(65) Prior Publication Data

US 2022/0015535 A1 Jan. 20, 2022

Related U.S. Application Data

(63) Continuation-in-part of application No. 15/930,909, filed on May 13, 2020, now Pat. No. 11,058,215.

(60) Provisional application No. 63/131,629, filed on Dec. 29, 2020, provisional application No. 63/085,573, filed on Sep. 30, 2020, provisional application No. 63/069,443, filed on Aug. 24, 2020, provisional application No. 62/907,822, filed on Sep. 30, 2019.

(51) Int. Cl.

| | |
|---|---|
| ***A47B 3/083*** | (2006.01) |
| ***A47B 3/10*** | (2006.01) |
| *A45C 9/00* | (2006.01) |
| *A45C 13/00* | (2006.01) |

(52) U.S. Cl.

CPC ..... *A47B 3/083* (2013.01); *A47B 3/10* (2013.01); *A45C 9/00* (2013.01); *A45C 13/001* (2013.01)

(58) Field of Classification Search

CPC ..... A47B 3/10; A47B 3/083; F16M 11/38
USPC ..... 108/169, 35, 36, 24, 34, 14, 132, 131
See application file for complete search history.

(56) References Cited

U.S. PATENT DOCUMENTS 875,195 A 12/1907 Loftin
984,529 A 2/1911 Bereman
(Continued)

FOREIGN PATENT DOCUMENTS

AM 0494 U 9/2017
CN 2220774 Y 2/1996
(Continued)

OTHER PUBLICATIONS

Written Opinion cited in Application No. PCT/US2020/053494 dated Jan. 5, 2021.

(Continued)

*Primary Examiner* — Jose V Chen
(74) *Attorney, Agent, or Firm* — DLA Piper LLP (US)

(57) ABSTRACT

A product for holding an item. Enclosure shells can be connected together to form a v-shape surface to hold the item when opened. Legs can connect to the sides of the enclosure shells. The legs can be configured to hold up the v-shape surface platform when opened.

20 Claims, 110 Drawing Sheets

(56) References Cited

U.S. PATENT DOCUMENTS

| | | | | |
|---|---|---|---|---|
| 1,154,692 | A | 9/1915 | Dehullu | |
| 1,270,730 | A | 6/1918 | Haydon | |
| 1,445,566 | A | 2/1923 | Stoll | |
| 2,167,342 | A | 7/1939 | York | |
| 2,233,202 | A | 2/1941 | Finch | |
| 2,311,798 | A | 2/1943 | Weber | |
| 2,406,237 | A | 8/1946 | Milkoff | |
| 2,709,631 | A | 5/1955 | Covucci | |
| 2,762,554 | A | 9/1956 | Burman | |
| 2,817,567 | A | 12/1957 | Shepherdson | |
| 2,862,777 | A | 12/1958 | Paige | |
| 3,227,106 | A | 1/1966 | Waddell | |
| 3,368,504 | A * | 2/1968 | Cohen | A47B 3/087 108/131 |
| 3,476,456 | A | 11/1969 | Canavan | |
| 3,554,141 | A | 1/1971 | Burr | |
| D286,479 | S | 11/1986 | Marchesini | |
| 4,790,416 | A | 12/1988 | Baker | |
| D306,100 | S | 2/1990 | Wende | |
| 5,067,417 | A | 11/1991 | Marmentini et al. | |
| 6,148,895 | A | 11/2000 | Biggers | |
| 6,454,357 | B1 * | 9/2002 | Foulger | A47C 16/025 108/131 |
| 7,805,784 | B2 | 10/2010 | Lemire et al. | |
| 8,188,410 | B2 | 5/2012 | Dean et al. | |
| 8,490,551 | B1 | 7/2013 | Wagner et al. | |
| D743,491 | S | 11/2015 | Fissell et al. | |
| D797,479 | S | 9/2017 | Manea | |
| D809,070 | S | 1/2018 | Fissell et al. | |
| D844,353 | S | 4/2019 | Horowitz | |
| D909,786 | S | 2/2021 | Wavomba | |
| 11,058,215 | B2 | 7/2021 | Flynn et al. | |
| D936,997 | S | 11/2021 | Li | |
| D942,192 | S | 2/2022 | Lundin et al. | |
| D948,725 | S | 4/2022 | Yun et al. | |
| D970,939 | S | 11/2022 | Li | |
| 2005/0031148 | A1 | 2/2005 | McNary | |
| 2005/0235886 | A1 | 10/2005 | Koning et al. | |
| 2005/0247243 | A1 | 11/2005 | Laws et al. | |
| 2005/0263045 | A1 * | 12/2005 | Lietuvietis | A47B 3/0809 108/131 |
| 2007/0184769 | A1 | 8/2007 | Lin | |
| 2009/0277320 | A1 | 11/2009 | Wallis | |
| 2010/0089407 | A1 | 4/2010 | Gardner et al. | |
| 2011/0155021 | A1 * | 6/2011 | Geitner | A47B 3/08 108/65 |
| 2012/0042809 | A1 | 2/2012 | Emsley | |
| 2015/0083522 | A1 | 3/2015 | Chancier | |
| 2019/0166987 | A1 | 6/2019 | Diaz et al. | |
| 2020/0046115 | A1 | 2/2020 | Thorpe | |

FOREIGN PATENT DOCUMENTS

| | | | |
|---|---|---|---|
| CN | 201691470 | U | 1/2011 |
| CN | 204241428 | U | 4/2015 |
| CN | 104970566 | A | 10/2015 |
| CN | 208582368 | U | 3/2019 |
| DE | 2036021 | A1 | 1/1972 |
| DE | 3825304 | A1 | 3/1989 |
| EP | 1464252 | A2 | 10/2004 |
| RU | 147562 | U1 | 11/2014 |
| WO | 2021067409 | A1 | 4/2021 |

OTHER PUBLICATIONS

International Search Report cited in Application No. PCT/US2020/053494 dated Jan. 5, 2021.
Design U.S. Appl. No. 15/930,909, electronically captured.
Design U.S. Appl. No. 29/747,612, electronically captured.
Design U.S. Appl. No. 29/734,515, electronically captured.
International Preliminary Report on Patentability for International Application No. PCT/US2020/053494, dated Apr. 14, 2022, 09 Pages.
International Search Report and Written Opinion for International Application No. PCT/US2021/073134, dated Apr. 7, 2022, 06 Pages.
Office Action for Canadian Application No. 3,156,234, dated Jul. 20, 2022, 48 Pages.
Design U.S. Appl. No. 29/776,462 electronically captured.
U.S. Appl. No. 17/355,993, Electronically captured from Apr. 10, 2023 to May 5, 2023, 162 pages.
U.S. Appl. No. 29/734,515, Electronically captured from Apr. 12, 2023 to May 5, 2023, 32 pages.
U.S. Appl. No. 29/747,612, Electronically captured from Apr. 12, 2023 to May 5, 2023, 33 pages.
Office Action for Chinese Patent Application No. 202080069068.9, mailed May 11, 2023, 8 Pages.
Office Action for Mexican Patent Application No. MX/a/2022/003580, dated Sep. 7, 2023, 3 pages.
U.S. Appl. No. 29/734,515, Electronically captured from on Oct. 30, 2023.
U.S. Appl. No. 29/747,612, Electronically captured from on Oct. 30, 2023.
U.S. Appl. No. 29/734,515 Electronically Capture from Dec. 21, 2023 to Feb. 6, 2024, 15 pages.
U.S. Appl. No. 29/747,612 Electronically Capture from Dec. 7, 2023 to Feb. 6, 2024, 18 pages.
Office Action for Chinese Patent Application No. 202080069068.9, mailed Jan. 18, 2024, 6 Pages.
Partial Translation for Office Action for Chinese Patent Application No. 202080069068.9, mailed Jan. 18, 2024, 6 Pages.
Extended European Search Report for Application No. 20872211.6, dated Nov. 7, 2023, 11 Pages.
Office Action for Chinese Patent Application No. 202130654926.3, mailed Apr. 9, 2024, 4 pages.
Office Action for European Patent Application No. 20872211.6, mailed Sep. 11, 2024, 6 pages.
Office Action for U.S. Appl. No. 18/883,775, mailed Mar. 17, 2026, 8 pages.

* cited by examiner

Components

- 2X Enclosure Shells (105)
- 4X Clips (110)
- 2X Legs (115)
- 2X Clasps (120)
- 4X Magnets (125)
- 2X Feet (not pictured) (130)
- 4X Springs (not pictured) (135)
- 4X Screws (not pictured) (140)

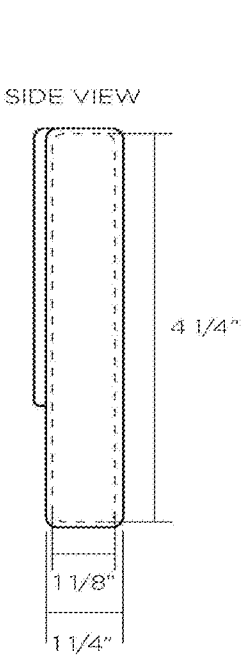
BAGCEIT PACKAGING
PART NUMBER: 272-001-0020
FIG. 3A
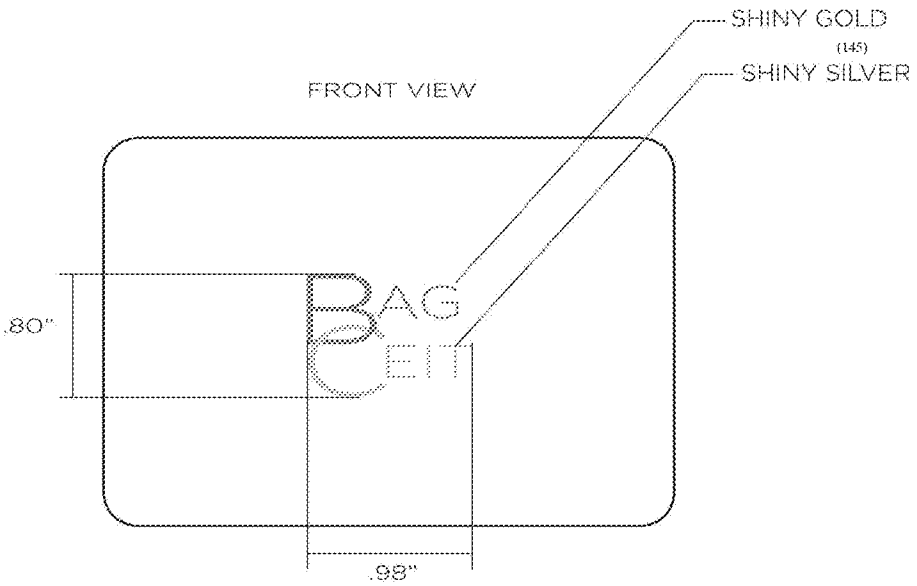
*ALL TEXT IS SHINY LIKE FOIL

FIG. 10A

Work Instructions

BAGCEIT

272-001-0001

1.0 Purpose

1.1 This work instruction addresses the required tasks for the assembly of the BAGCEIT for Nupur (272-001)

2.0 Scope

2.1 This work instruction applies to the BAGCEIT assembly (272-001)

3.0 Records

3.1 n/a

4.0 Associated Documents

4.1 213-001-9000 – Document List

5.0 Definitions

5.1 WIP: Work in Progress 5.2 QTY: Quantity

6.0 Responsibility

6.1 Production: Responsible for execution of tasks herein and reporting.

6.2 Quality: Responsible for inspection checks and trending of data to inform production

7.0 Tools, Fixtures, Gauges

7.1 Wire cutters 7.2 Phillips head screwdriver 7.3 Super Glue 7.4 Metal File 7.5 Mallet / Hammer 7.6 Tape Measure

8.0 Safety Requirements

8.1 Protective eye wear

FIG. 10B 8.2 Gloves

9.0 Instructions – General assembly

9.1 Retrieve all necessary materials and prepare for assembly. Refer to figure 1 for all materials.

*Figure 1: BAGCEIT BOM*

| REF # | QTY | PART NUMBER | DESCRIPTION | MATERIAL |
|---|---|---|---|---|
| 1-1 | 1 | 272-001-0002 | ENCLOSURE SHELL 1 | ABS |
| 1-2 | 1 | 272-001-0009 | ENCLOSURE SHELL 2 | ABS |
| 1-3 | 2 | 272-001-0003 | LEG | ALUMINIUM |
| 1-4 | 1 | 272-001-00011 | PIN, LONG | SST |
| 1-5 | 4 | 272-001-0012 | HINGE CLIP | ABS |
| 1-6 | 2 | 272-001-0013 | BUMPER | RUBBER |
| 1-7 | 4 | 272-001-0014 | PIN, SHORT | SST |
| 1-8 | 2 | 272-001-0018 | CLASP | SST |
| 1-9 | 4 | 91772A503 | PAN HEAD SCREW, 2-56 X .06 LG | SST |
| 1-10 | 4 | 9271K13 | SPRING, TORSION, LH. 16OD | MUSIC-WIRE STEEL |
| 1-11 | 4 | DH18 | MAGNET | SST |
| 1-12 | 4 | 272-001-0031 | SUPER GLUE | GLUE |

9.2 Cut (1) long pin (1-4) to 4.75" cut (4) short pins (1-7) to 1.125" using wire cutters. Remove all burrs and sharp edges with a metal file. File down the pin so that both ends have flat faces.

FIG. 10C 9.3 Line up the long hinge of Enclosure shell 1 (1-1) and Enclosure shell 2 (1-2) and secure together by inserting (1) long pin (1-4) with a hammer or mallet. NOTE: Before inserting the pin, test fit the pin in the hinge to ensure that it will be flush with the out ends of the hinge. No part of the pin should be sticking out. If required, file down the pin until it is the correct size.

9.4 Add 1 small drop of super glue into each designated magnet holes (2) in enclosure shell 1 (1-1). Before the glue dries, insert (2) magnets (1-11) into the magnet holes. Use a hammer or mallet and gently tap down until they are fully seated inside the holes.

FIG. 10D 9.5 each of the installed magnets (4), orient and test with another magnet to find which end will *ATTRACT* to the already installed magnet. This test magnet should now be installed directly across into enclosure shell 2 (1-2) with the same procedure as step 9.4, ensuring that the side that attracted is facing up out of the hole.

9.6 Install (1) clasp (1-8) onto the side of enclosure shell 1 (1-1) using (2) pan head screws (1-9). Repeat for enclosure shell 2 (1-2)

9.7 Insert (1) Bumper (1-6) into holes at bottom of (1) leg (1-3). Repeat this process to create (2) legs with bumpers.

FIG. 10E 9.8 Place (1) Leg (1-3) flat side down onto a table. Install (2) Hinge clips (1-5) with the flat side facing up using (1) short pin (1-7) per hinge. With the pin partly installed, slide a torsion spring in the middle of the hinge clip so that the pin secures it in place. Ensure that the torsion spring is installed with one end facing down and flush with the side of the leg. Trim the torsion spring with wire cutters so that the top end is flush with the hinge clip and the bottom end doesn't extend beyond the flat face of the leg (1-3). Repeat to create (2) leg assemblies

FIG. 10F 9.9 Take the leg and clip assembly and insert the hinge clips (1-5) into slots in enclosure shell 1 (1-1) and enclosure shell 2 (1-2) so that the flat face of the leg is facing towards the center of the assembly.

10.0 Inspection

10.1 All parts to be visually inspected for correct part assembly and visual defects.

11.0 Revisions

0.01 Initial Release

STEP 1301 - Molds close – cycle begins
STEP 1302 - Heated plastic is injected into the mold
STEP 1303 - Part is given cooling time
STEP 1304 - Screw retracts while drawing in new plastic for the next part
STEP 1305 - Molds opens, and ejector pins push part out of mold – cycle ends

STEP 1401 Dies closed – cycle begins
STEP 1402 Heated metal is injected into the mold
STEP 1403 Part is given cooling time
STEP 1404 Piston retracts
STEP 1405 Molds opens, and ejector pins push part out of mold, flash is removed – cycle ends

FIG. 16B

Example Dimensions

2

Example dimensions are:

- 3.5 inches tall x 5 inches wide x 8 inches long when the product is fully open.
  - Small, low-rise seat comprised of a durable fabric (e.g., canvas), supported by lightweight, collapsible metal legs.
  - When the seat is open, a bag can be placed upon it. The seat can slide under a chair, can sit next to a chair, or in front of your feet. The product can fit in tight spaces in some embodiments.
- When the product is folded closed, it can be smaller (e.g., half the size) and thus portable.
  - It can fit under multiple types of chairs
  - It can come with a small carrying case and/or a strap (e.g., wrist strap)
  - It can accommodate multiple types and sizes of bags

Product Features

Can be lightweight, compact, portable, easy to use

Example Features:

- Can keeps bag from touching floor
- Can be small (e.g., approx. 3.5 in x 5in x 8in when fully open)
  - Can be half the size when folded
- Can fit under all types of chairs
- Can be small carrying case with wrist strap
- Can be cleaned
- Can be stable on all types of floor surfaces
- Can have unique aesthetic
- Can accommodate different size bags

FIG. 16E

FIG. 18A

Work Instructions

BAGCEIT

1.0 Purpose

1.1 This work instruction addresses the required tasks for the assembly of the BAGCEIT for Nupur (272-001)

2.0 Scope

2.1 This work instruction applies to the BAGCEIT assembly (272-001)

3.0 Records

3.1 n/a

4.0 Associated Documents

4.1 213-001-9000 – Document List

5.0 Definitions

5.1 WIP: Work in Progress 5.2 QTY: Quantity

6.0 Responsibility

6.1 Production: Responsible for execution of tasks herein and reporting.

6.2 Quality: Responsible for inspection checks and trending of data to inform production

7.0 Tools, Fixtures, Gauges

7.1 Wire cutters 7.2 Phillips head screwdriver 7.3 Super Glue 7.4 Metal File 7.5 Mallet / Hammer 7.6 Tape Measure

8.0 Safety Requirements

8.1 Protective eye wear 8.2 Gloves

FIG. 18B

9.0 Instructions – General assembly

9.1 Retrieve all necessary materials and prepare for assembly. Refer to figure 1 for all materials.

*Figure 1: BAGCEIT BOM*

| REF # | QTY | PART NUMBER | DESCRIPTION | MATERIAL |
|---|---|---|---|---|
| 1-1 | 1 | 272-001-0002 | ENCLOSURE SHELL 1 | ABS |
| 1-2 | 1 | 272-001-0009 | ENCLOSURE SHELL 2 | ABS |
| 1-3 | 2 | 272-001-0003 | LEG | ALUMINIUM |
| 1-4 | 1 | 272-001-00011 | PIN, LONG | SST |
| 1-5 | 4 | 272-001-0012 | HINGE CLIP | ABS |
| 1-6 | 2 | 272-001-0013 | BUMPER | RUBBER |
| 1-7 | 4 | 272-001-0014 | PIN, SHORT | SST |
| 1-8 | 2 | 272-001-0018 | CLASP | SST |
| 1-9 | 4 | 91772A503 | PAN HEAD SCREW, 2-56 X .06 LG | SST |
| 1-10 | 4 | 9271K13 | SPRING, TORSION, LH. 16OD | MUSIC-WIRE STEEL |
| 1-11 | 4 | DH18 | MAGNET | SST |
| 1-12 | 4 | 272-001-0031 | SUPER GLUE | GLUE |
| 1-13 | 2 | 272-001-0034 | LOCK | ABS |

9.2 Cut (1) long pin (1-4) to 4.75" cut (4) short pins (1-7) to 1.125" using wire cutters. Remove all burrs and sharp edges with a metal file. File down the pin so that both ends have flat faces.

FIG. 18C 9.3 Line up the long hinge of Enclosure shell 1 (1-1) and Enclosure shell 2 (1-2) and secure together by inserting (1) long pin (1-4) with a hammer or mallet. NOTE: Before inserting the pin, test fit the pin in the hinge to ensure that it will be flush with the out ends of the hinge. No part of the pin should be sticking out. If required, file down the pin until it is the correct size.

9.4 Add 1 small drop of super glue into each designated magnet holes (2) in enclosure shell 1 (1-1). Before the glue dries, insert (2) magnets (1-11) into the magnet holes. Use a hammer or mallet and gently tap down until they are fully seated inside the holes.

FIG. 18D 9.5 For each of the installed magnets (4), orient and test with another magnet to find which end will *ATTRACT* to the already installed magnet. This test magnet should now be installed directly across into enclosure shell 2 (1-2) with the same procedure as step 9.4, ensuring that the side that attracted is facing up out of the hole.

9.6 Install (1) clasp (1-8) onto the side of enclosure shell 1 (1-1) using (2) pan head screws (1-9). Repeat for enclosure shell 2 (1-2)

9.7 Insert (1) spring (1-10) into (1) lock (1-13) and place lock on enclosure shell 1 (1-1). Install (1) pan head screw (1-9). Repeat this process to other enclosure shell 2 (1-2)

FIG. 18E 9.8 Insert (1) Bumper (1-6) into holes at bottom of (1) leg (1-3). Repeat this process to create (2) legs with bumpers.

9.9 Place (1) Leg (1-3) flat side down onto a table. Install (2) Hinge clips (1-5) with the flat side facing up using (1) short pin (1-7) per hinge. With the pin partly installed, slide a torsion spring in the middle of the hinge clip so that the pin secures it in place. Ensure that the torsion spring is installed with one end facing down and flush with the side of the leg. Trim the torsion spring with wire cutters so that the top end is flush with the hinge clip and the bottom end doesn't extend beyond the flat face of the leg (1-3). Repeat to create (2) leg assemblies

FIG. 18F 9.10 Take the leg and clip assembly and insert the hinge clips (1-5) into slots in enclosure shell 1 (1-1) and enclosure shell 2 (1-2) so that the flat face of the leg is facing towards the center of the assembly.

10.0 Inspection 10.1 All parts to be visually inspected for correct part assembly and visual defects.

11.0 Revisions 0.01 Initial Release 0.02 Product updated

FIG. 21A

BAGCEIT (pronounced "bag-seat") can be for everyone, because everyone cares about hygiene. BAGCEIT can be an individual-sized, lightweight, small, affordable, portable seat with retractable legs for purses, briefcases, and bags of all types. It can also work for keys, cellphones, laptops and other personal items.

A purpose of BAGCEIT can be to keep your bag and personal items from touching the floor – period – whether you are in a board meeting or a PTA meeting, the gym, an airplane, at a gala, eating with friends at a restaurant, waiting at the doctor's office - anywhere - indoors or outdoors. Space and hygiene are at a premium these days, but that doesn't mean you and your personal items have to suffer. Open the pocket-size BAGCEIT anywhere - at anytime - and you may not have to worry about putting your bag and personal items on a dirty floor again - no more taking up space on a cramped table, putting a bag on your lap, or trying to hang it on the back of your chair.

FIG. 21D

[redacted] Microban + Materials

Microban additive can hinder the growth of bacteria by up to 99.99%

Plastic Application
Additives can be mixed in with polymers, and then the part can be manufactured

Metal Applications
Additives can be mixed into an epoxy which can be applied after parts have been manufactured

Example microban applications on BAGCEIT

Plastic
Enclosures – ABS
Clips – ABS
Feet – Rubber

Metal
Clasps – 304 Stainless Steel
Legs – Aluminum

FIG. 22A

Example Instructions

BAGCEIT

1.0 Purpose 1.1 This work instruction can set forth tasks for the assembly of an embodiment of the BAGCEIT

2.0 Scope 2.1 This work instruction can apply apply to the BAGCEIT assembly

3.0 Records 3.1 n/a

4.0 Associated Documents 4.1 213-001-9000 – Document List

5.0 Definitions 5.1 WIP: Work in Progress 5.2 QTY: Quantity

6.0 Example Responsibility 6.1 Production: Responsible for execution of tasks herein and reporting.

7.0 Example Tools, Fixtures, Gauges 7.1 Wire cutters 7.2 Phillips head screwdriver 7.3 Super Glue 7.4 Metal File 7.5 Mallet / Hammer 7.6 Tape Measure

8.0 Example Safety Requirements 8.1 Protective eye wear 8.2 Gloves

9.0 Example Instructions – General assembly 9.1 Retrieve all necessary materials and prepare for assembly. Refer to figure 1 for all materials.

FIG. 22B

*Figure 1: BAGCEIT BOM*

| REF # | QTY | PART NUMBER | DESCRIPTION | MATERIAL |
|---|---|---|---|---|
| 1-1 | 1 | 272-001-0002 | ENCLOSURE SHELL 1 | ABS |
| 1-2 | 1 | 272-001-0009 | ENCLOSURE SHELL 2 | ABS |
| 1-3 | 1 | 272-001-0011 | PIN, LONG | SST |
| 1-4 | 2 | 272-001-0013 | BUMPER, RUBBER | RUBBER |
| 1-5 | 2 | 272-001-0018 | CLASP, GENERIC | 304 SST |
| 1-6 | 1 | 272-001-0021 | LEG, 1A | AL |
| 1-7 | 1 | 272-001-0022 | LEG, 1B | AL |
| 1-8 | 2 | 272-001-0023 | LEG 2 | AL |
| 1-8 | 4 | 91772A503 | PAN HEAD SCREW, 2-56 X .06 LG | SST |
| 1-9 | 4 | 272-001-0028 | MODIFIED 9271K94 TORSION SPRING | MUSIC-WIRE PER ASTM A228 |
| 1-10 | 4 | DH18 | MAGNET | SST |
| 1-11 | 4 | 272-001-0024 | SLOTTED RAIL | POLYPROPYLENE |
| 1-12 | 4 | 272-001-0025 | SLIDER PIN | AL |
| 1-13 | 4 | 272-001-0026 | LOW FRICTION SLEEVE | PTFE |
| 1-14 | 2 | 272-001-0027 | LEG HINGE PIN | AL |

9.2 Can cut (1) long pin (1-3) to 4.75", cut (4) slider pins (1-12) to 1.15", cut (2) leg hinge pins (1-14) using wire cutters. Remove all burrs and sharp edges with a metal file. File down the pin so that both ends have flat faces.

9.3 Can gather enclosure shell 1 (1-1), enclosure shell 2 (1-2) and (4) magnets (1-10). Press-fit 1 magnet into designed hole, test another magnet to find which end will *ATTRACT.* This test

FIG. 23A

Additional legs can improve the structure and can offer little to no wobbling when under weight.

FIG. 23B

The legs can remain spring loaded, can be attached at the main hinge and side rails can guide the legs to their open / closed positions.

This can improve the overall integrity of the product, while remaining semi-automatic.

FIG. 23C

The legs can remain spring loaded, can be attached at the main hinge and side rails guide the legs to their open / closed positions.

This can improve the overall integrity of the product, while remaining semi-automatic.

PRODUCT FOR HOLDING ITEMS AND METHOD FOR MAKING SAME

CROSS-REFERENCE TO RELATED APPLICATIONS

This application is a continuation-in-part of and claims priority to U.S. application Ser. No. 15/930,909, filed on May 13, 2020, which claims priority to U.S. Provisional No. 62/907,822 filed Sep. 30, 2019. This application also claims priority to, U.S. Provisional Application No. 63/069,443 filed Aug. 24, 2020, now U.S. Pat. No. 11,058,215, U.S. Provisional Application No. 63/085,573 filed Sep. 30, 2020, and U.S. Provisional Application No. 63/131,629 filed Dec. 29, 2020. This application is also related to International Patent Application No. PCT/US2020/053494 filed Sep. 30, 2020, U.S. Design application No. 29/734,515 filed May 13, 2020, U.S. Design application No. 29/747,612 filed Aug. 24, 2020, and US Design application No. 29/776,462 field Mar. 30, 2021. The contents of all of the above-mentioned applications are herein incorporated by reference in their entirety.

BRIEF DESCRIPTION OF THE FIGURES

FIG. 3A-3D illustrate an example enclosure that can be used to hold the product, according to aspects of the disclosure.

FIGS. 10A-F illustrate an example method for making the stand, according to aspects of the disclosure.

FIGS. 16A-16E set forth additional information related to the product, according to various embodiments of the disclosure.

FIGS. 17-20H set forth additional example details of the product and making the product, according to aspects of the disclosure.

FIG. 21A illustrates an example description of aspects of the disclosure.

FIG. 21D illustrates example microban and materials, according to aspects of the disclosure.

FIG. 21E-21F illustrate example views of assembly for the product, according to aspects of the disclosure.

FIGS. 22A-23C disclose example feature of the product, according to aspects of the disclosure.

DETAILED DESCRIPTION OF ASPECTS OF THE DISCLOSURE

Figure 1A:
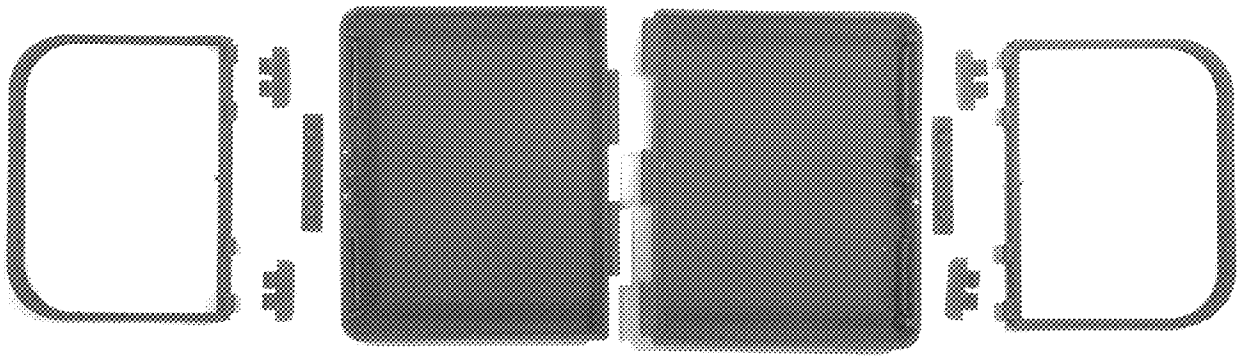
FIGS. 1A-1B illustrate various components of a product (Bagceit) used to hold items, according to aspects of the disclosure.
Figure 1B:
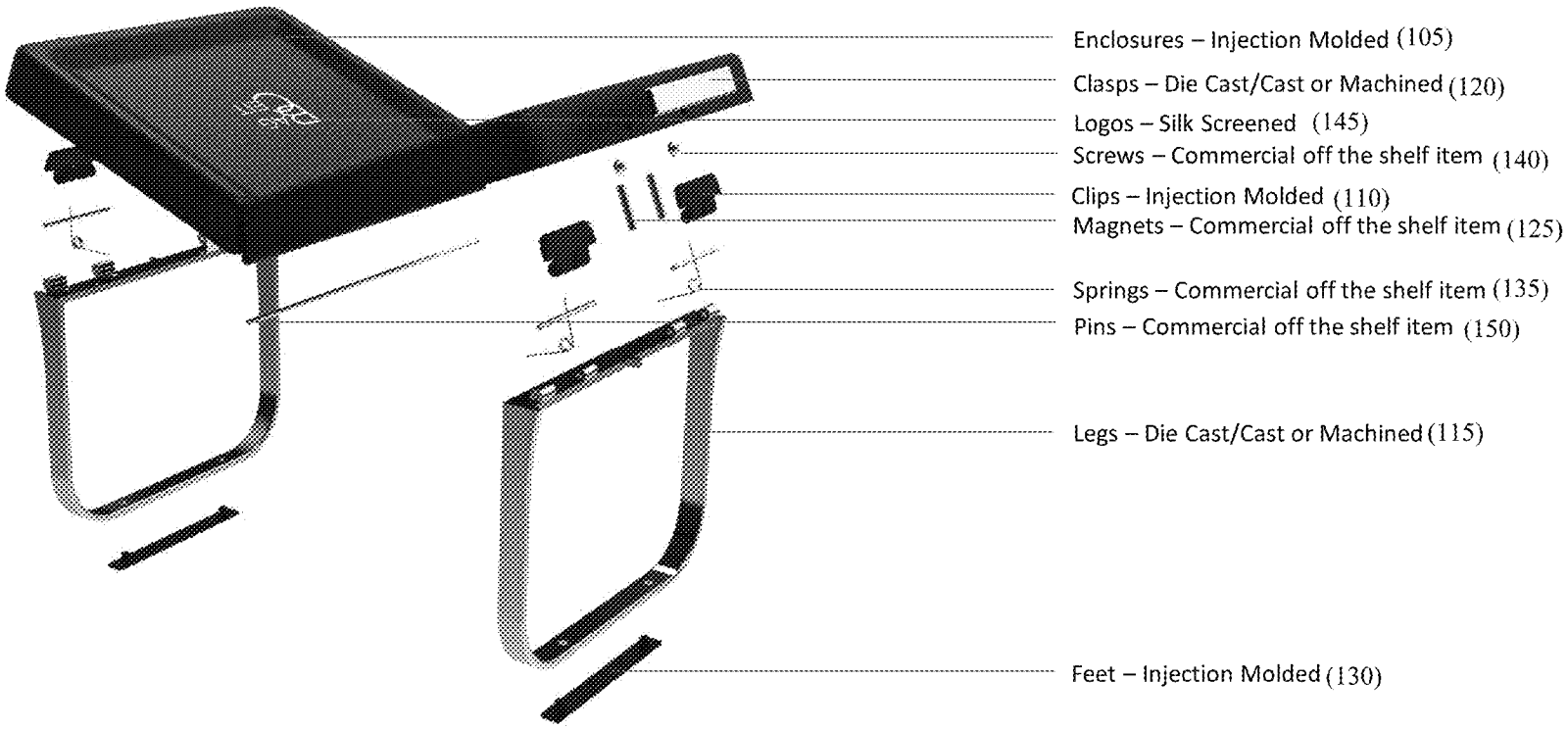

FIG. 1A illustrates various components of a product (also referred to as a stand) used to hold items, according to aspects of the disclosure. FIG. 1A illustrates a product that can comprise enclosure shells (105), clips (110), legs (115), clasps (120), and magnets (125), according to aspects of the disclosure. Feet (130), springs (135), and screws (140) can also be included. FIG. 1B illustrates another view of the product that can comprise: enclosures (e.g., injection molded); clasps (e.g., die case or machined), logos (145) (e.g., silk screened), screws (140) (e.g., commercial off the shelf), clips (110) (e.g., injection molded), magnets (125) (e.g., commercial off the shelf), springs (135) (e.g., commercial off the shelf), pins (150) (e.g., commercial off the shelf), legs (115) (e.g., die cast or machined), feet (130) (e.g., injection molded).

Figure 2:
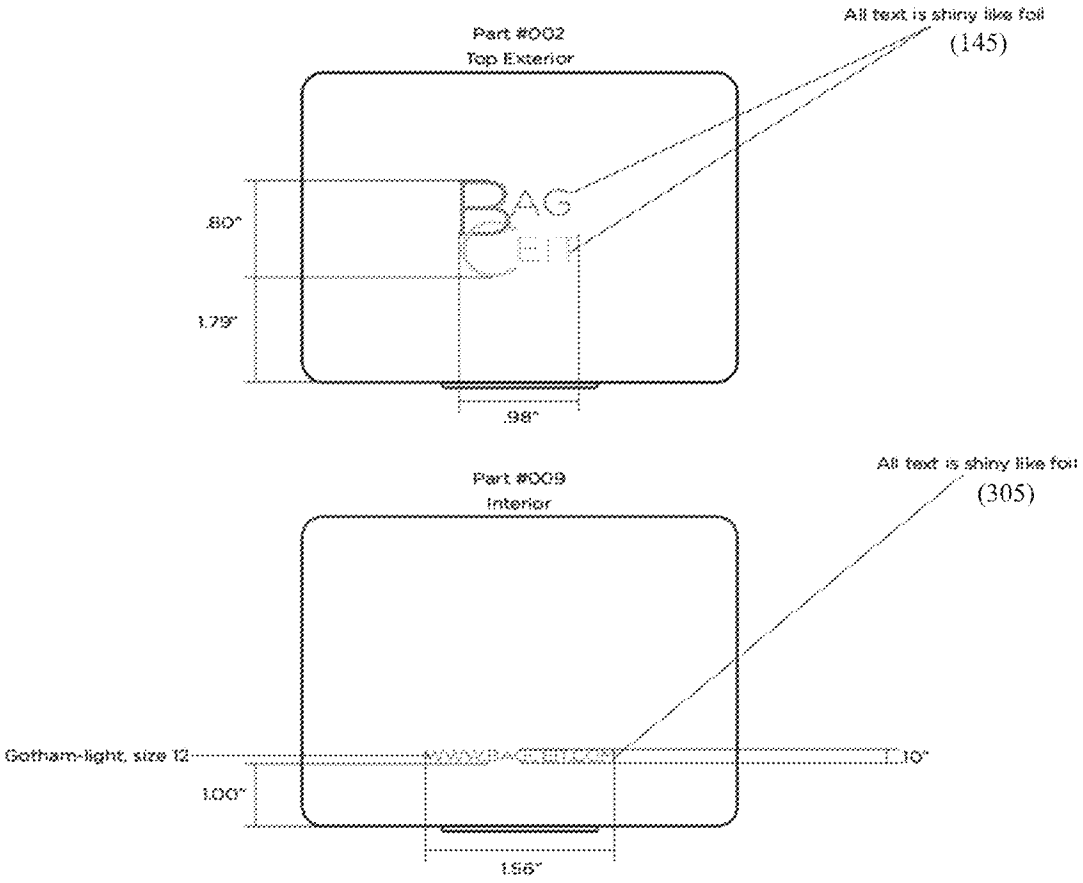
FIGS. 2 illustrates a product used to hold items, according to aspects of the disclosure.

FIG. 2 illustrates various views of a product used to hold items, according to aspects of the disclosure. FIG. 3 shows how information (e.g., logos (145), web site address (305)) can be displayed on the product. The logo can be shiny (e.g., like foil).

Figure 3B:
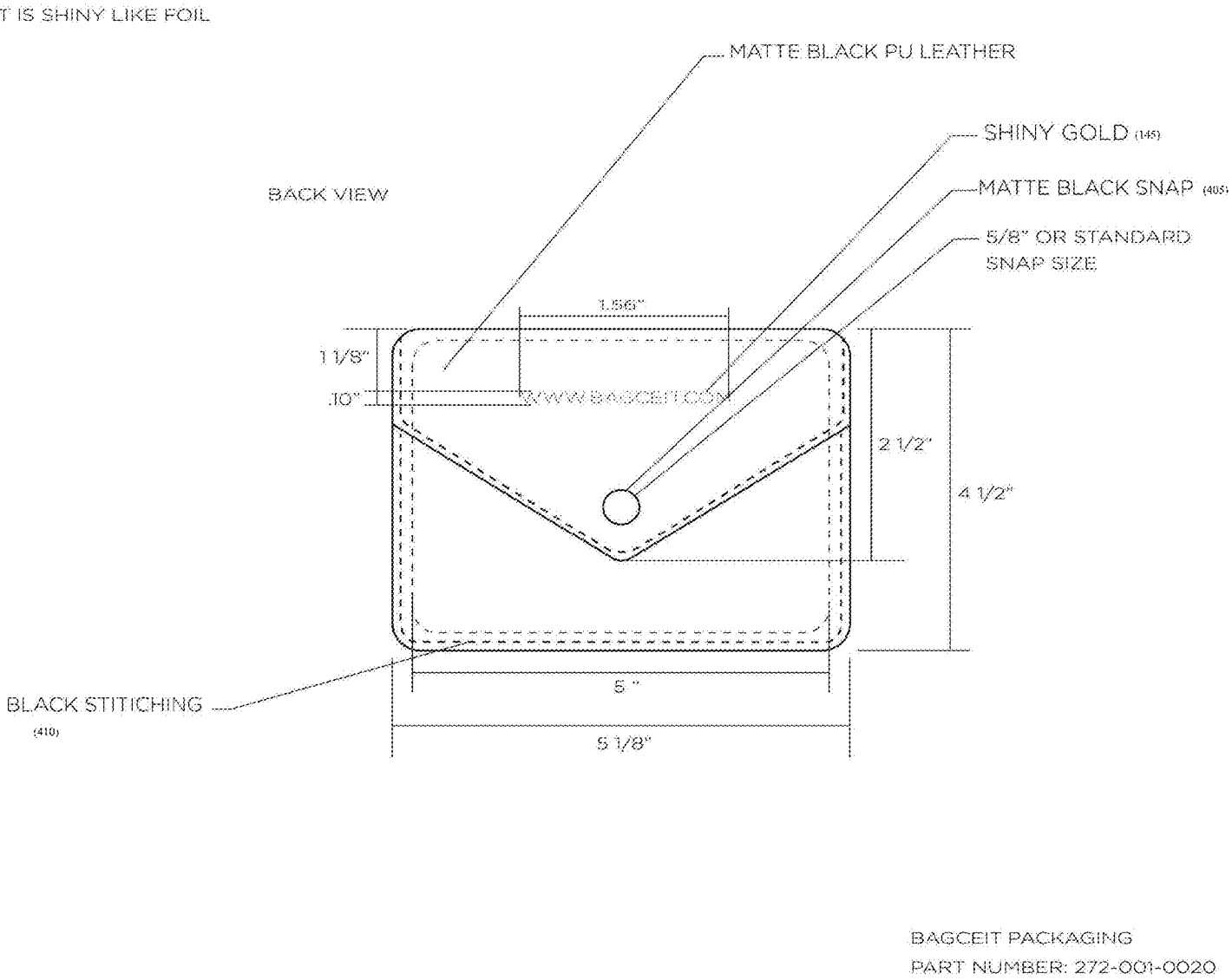
Figure 3C:
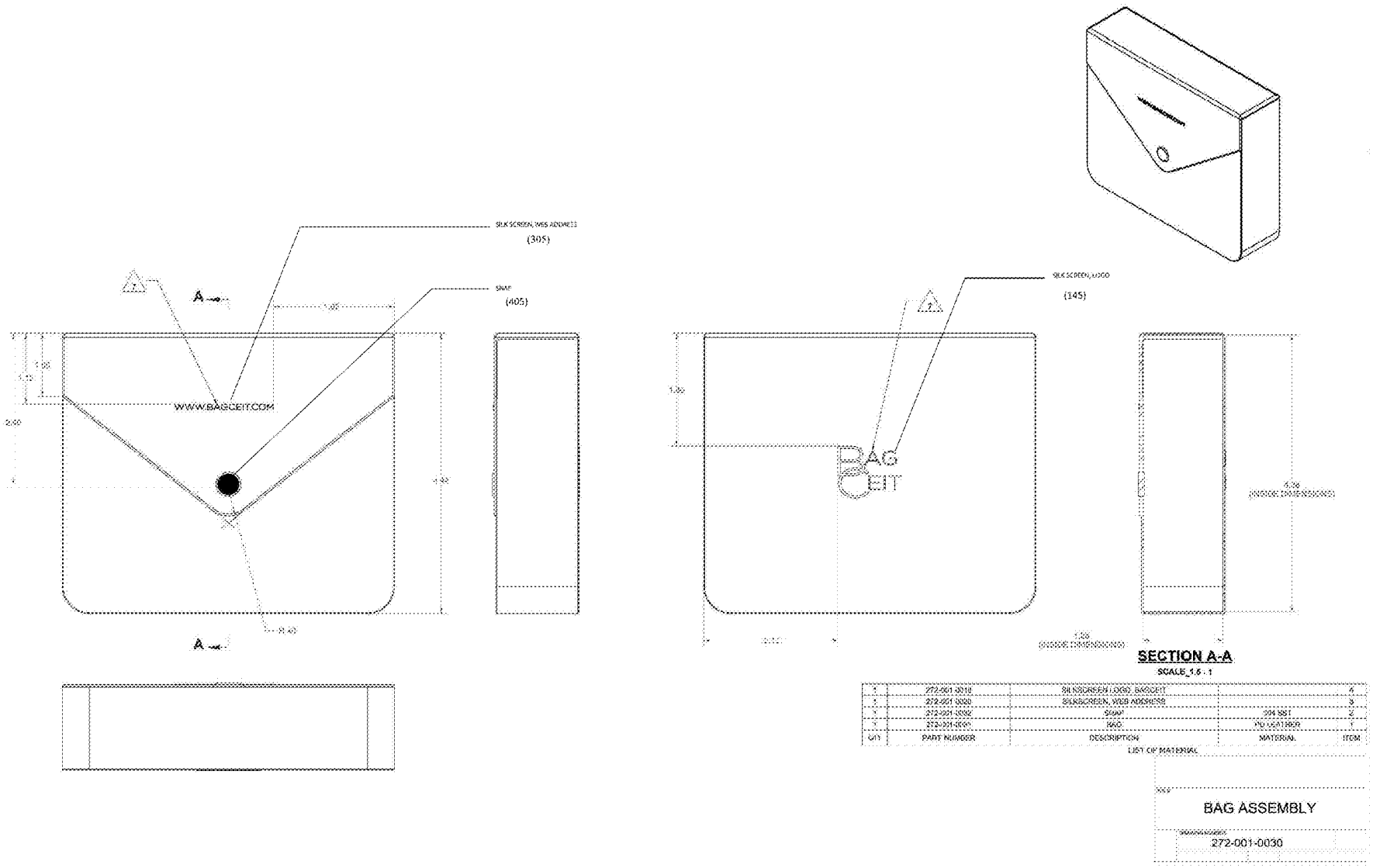
Figure 3D:
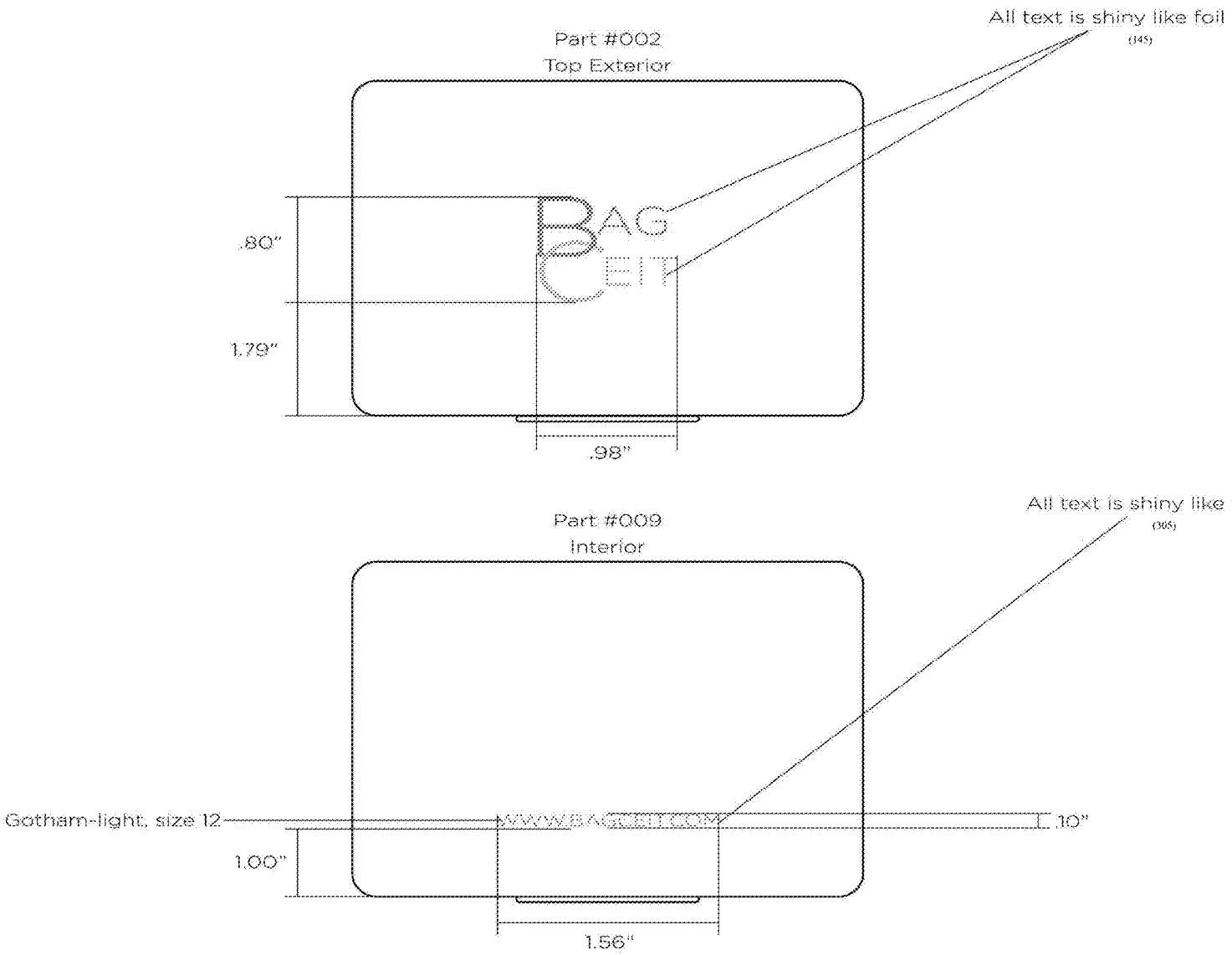

FIG. 3A illustrates an enclosure that can be used to hold the product, according to aspects of the disclosure. Any type of enclosure may be used. For example, a baggie can be used in some aspects of the disclosure. The baggie can be made of: satin, silk, cotton, linen, polyester, leather, faux leather, or any combination thereof. Many other types of material can also be used. In other aspects of the disclosure, an envelope may be used. FIGS. 3A-3E illustrate an envelope (e.g., enclosure) that can be used to hold the product, according to aspects of the disclosure. FIG. 3B illustrates an example front and side view of the envelope. Information (e.g., a logo 145) can be included on the envelope. FIG. 3C illustrates an example back view of the envelope, with a logo (145), and a snap (405) used to close the envelope. FIG. 3D illustrates example engineering drawings of the envelope, which also illustrate the logo (145), web site address (305), and snap (405). FIG. 3E illustrates an example top exterior view and interior view of the envelope, and also illustrates the logo (145), email address (305) and snap (405). The envelope can be made of: satin, silk, cotton, linen, polyester, leather, faux leather, or any combination thereof. Many other types of material can also be used. In addition, many other types of holders for the product, other than a baggie or envelope, can be used in aspect of the disclosure.

The product can be made of plastic (e.g., black plastic). The hardware can be made of silver, gold, black, or any other color.

FIG. 4A-9 illustrates various engineering drawings for the product used to hold items, according to aspects of the disclosure. Note that the measurements disclosed in this application are merely example measurements, and that those of ordinary skill in the art will see that many other measurements may be used for any component of the product used to hold items. In some aspects of the disclosure, the product can hold an item (e.g., bag, computer, phone, shoes, coat) up to approximately 10 pounds. In other aspects, if measurements that are larger or smaller than those provided in the examples, the product can hold heavier (e.g., duffle bag, bigger computer) or lighter (e.g., cell phone) items.

Figure 4A:
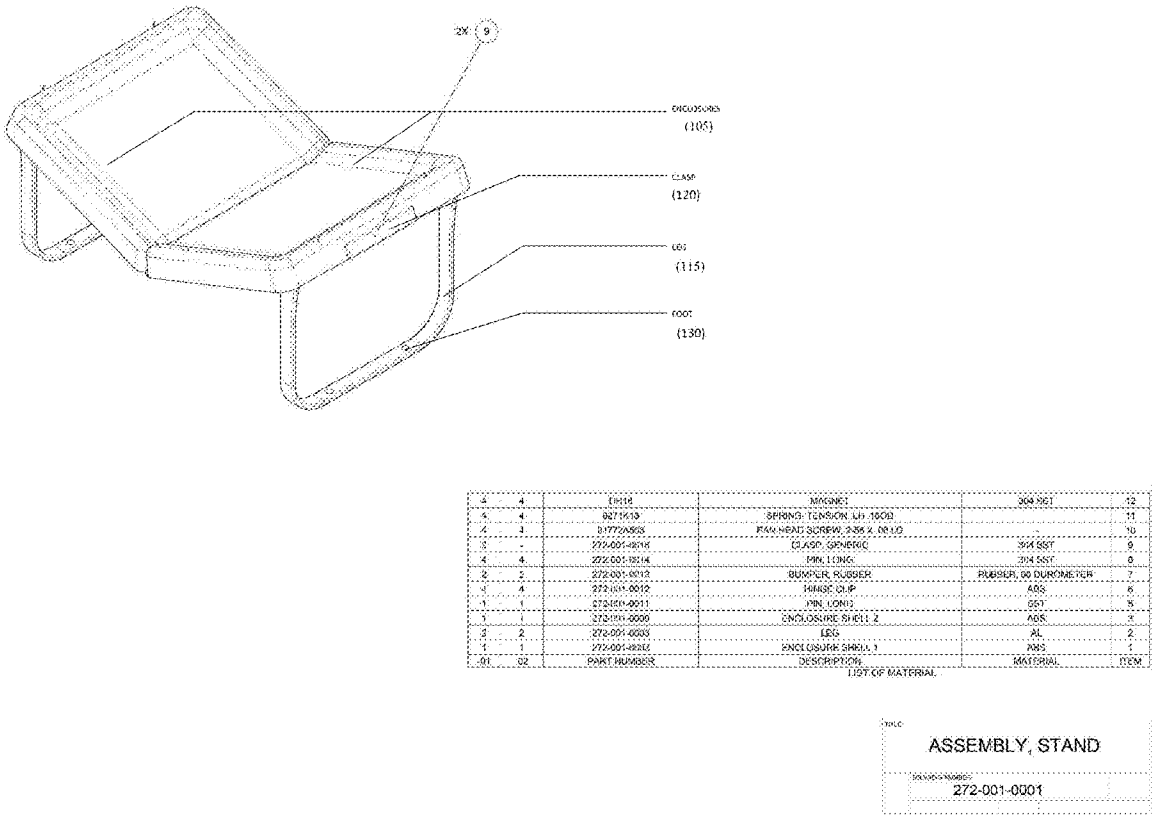
FIG. 4A-9 illustrate various engineering drawings for the product used to hold items, according to aspects of the disclosure.
Figure 4B:
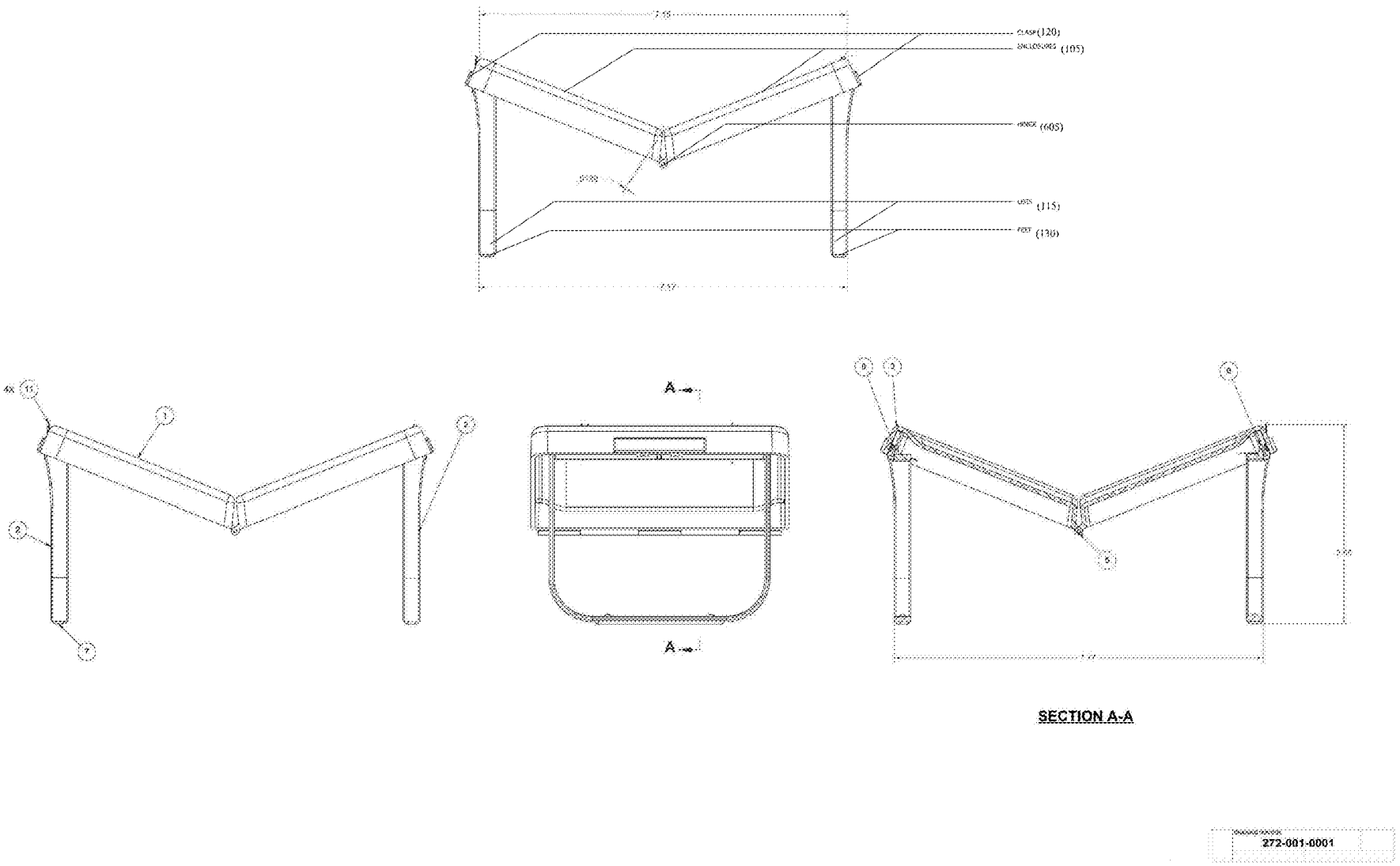
Figure 6A:
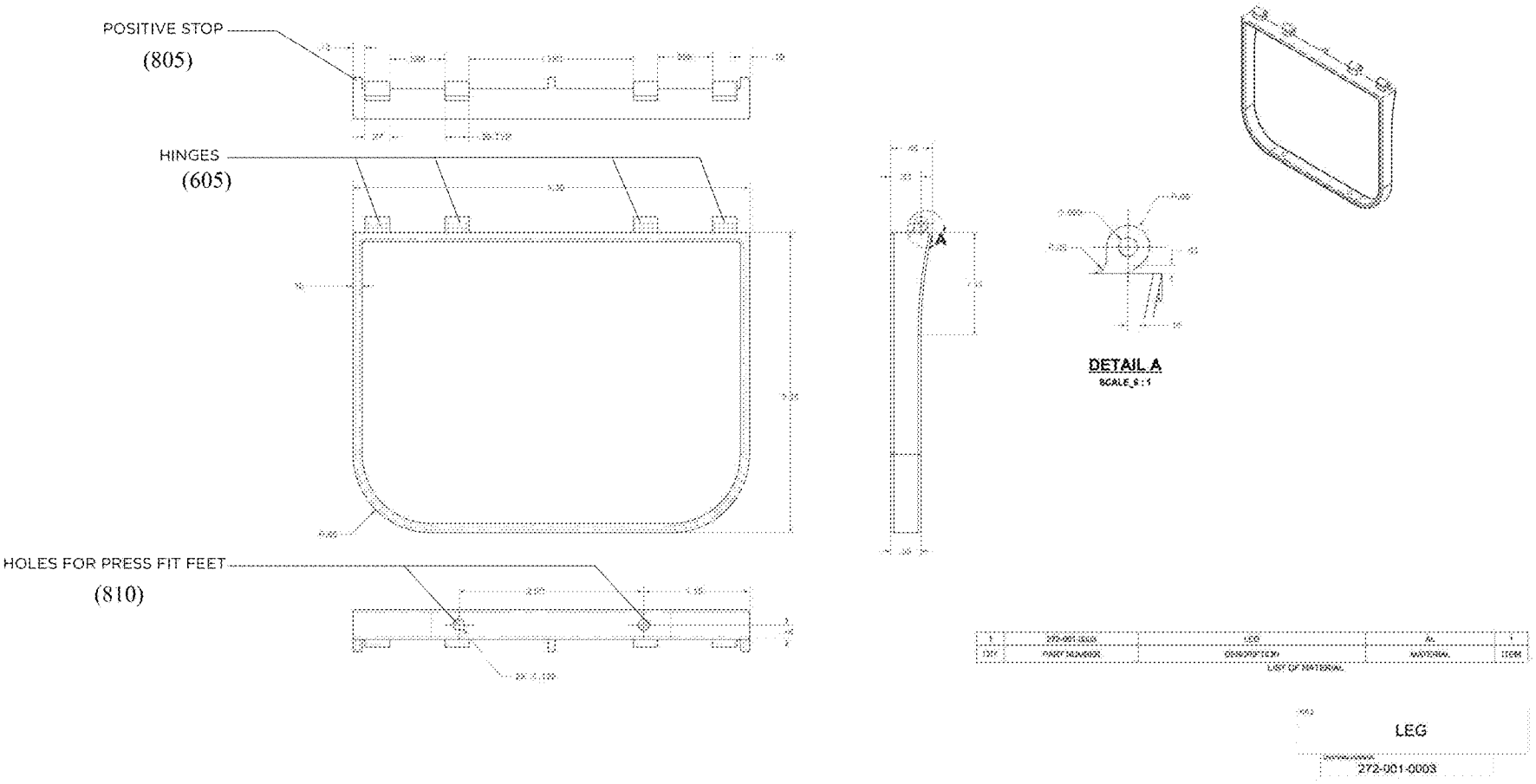
Figure 6B:
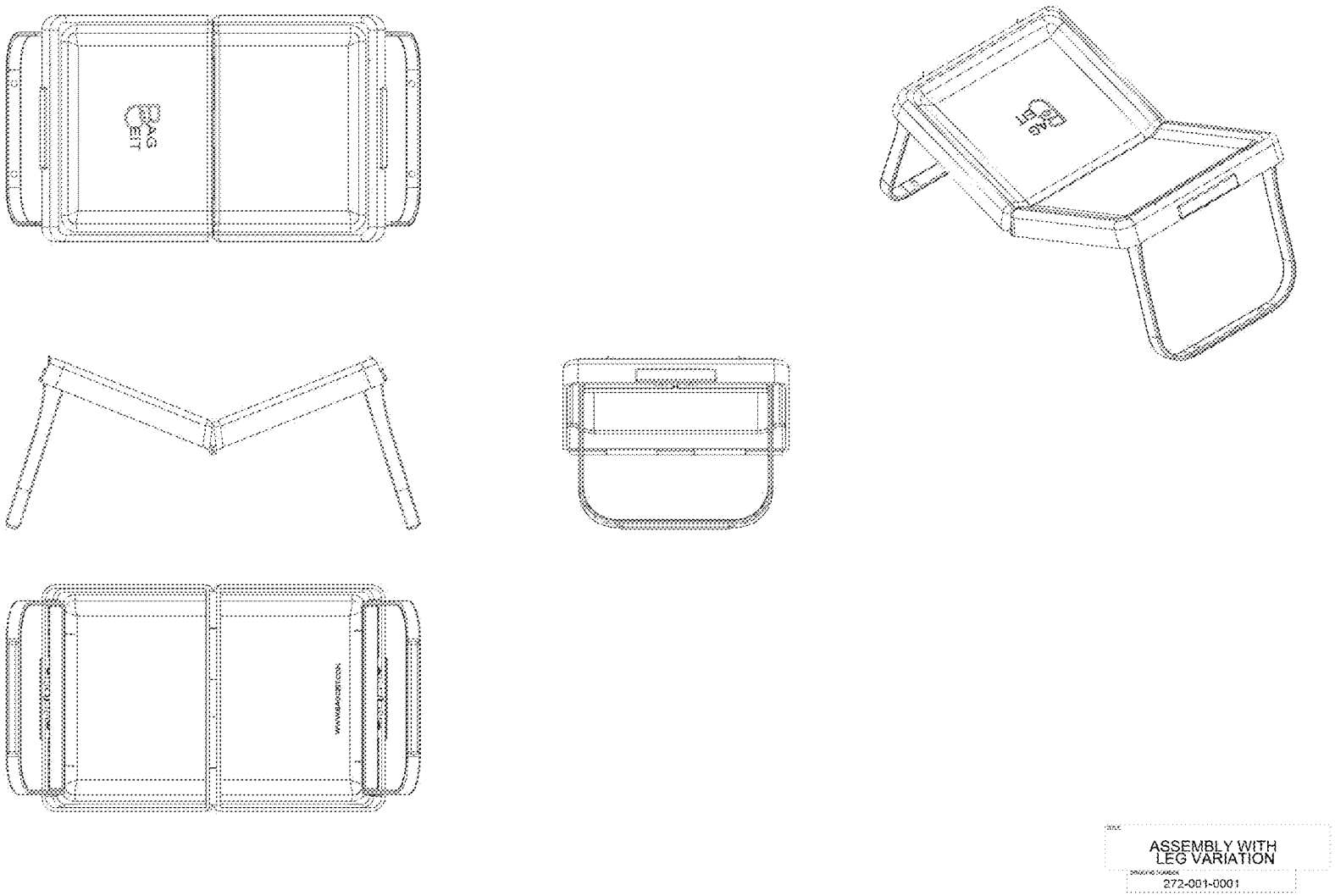

FIGS. 4A-4B illustrate an example stand with a v-shape surface for holding items, according to aspects of the disclosure. As shown in FIGS. 6A and 6B, the stand can include: a magnet (e.g., part number DH18 made of 304 SST); a tension spring (e.g., LH 160D, which can be part number 9271K13); a pan head screw (e.g., 2.56×0.06 LG, which can be part number 91772A503); a clasp (e.g., made of 304 SST), a pin (e.g., made of 304 SST), a bumper (e.g., made of 90 durometer rubber), a hinge clip (e.g., made of ABS), enclosure shells (e.g., made of ABS), or legs (e.g., made of), or any combination thereof. FIG. 6A illustrates the enclosures (105), a clasp (120), a leg (115) and a foot (130). FIG. 6B illustrates a clasp (120), enclosures (105), a hinge, legs (115), and feet (130).

Figure 5A:
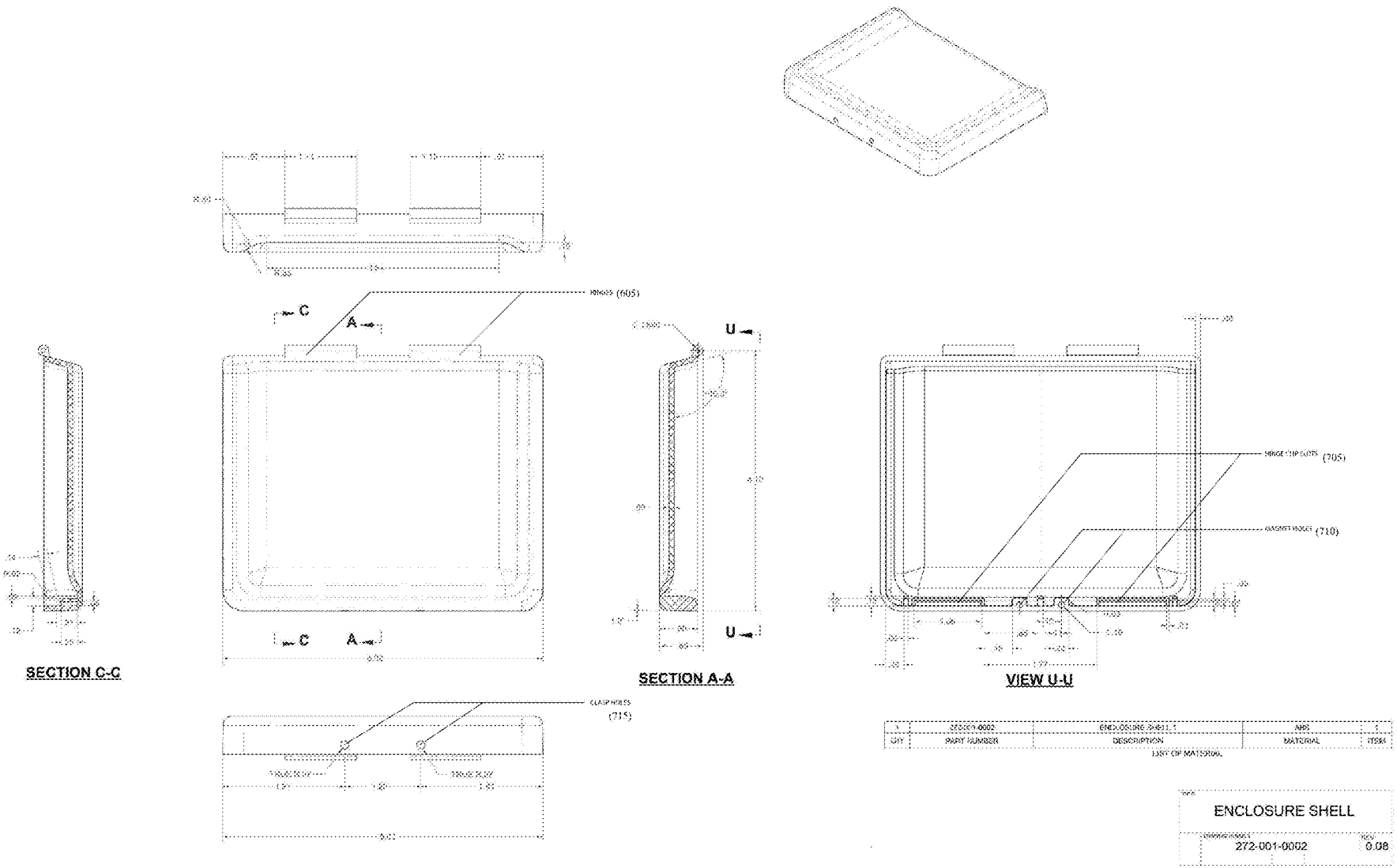
Figure 5B:
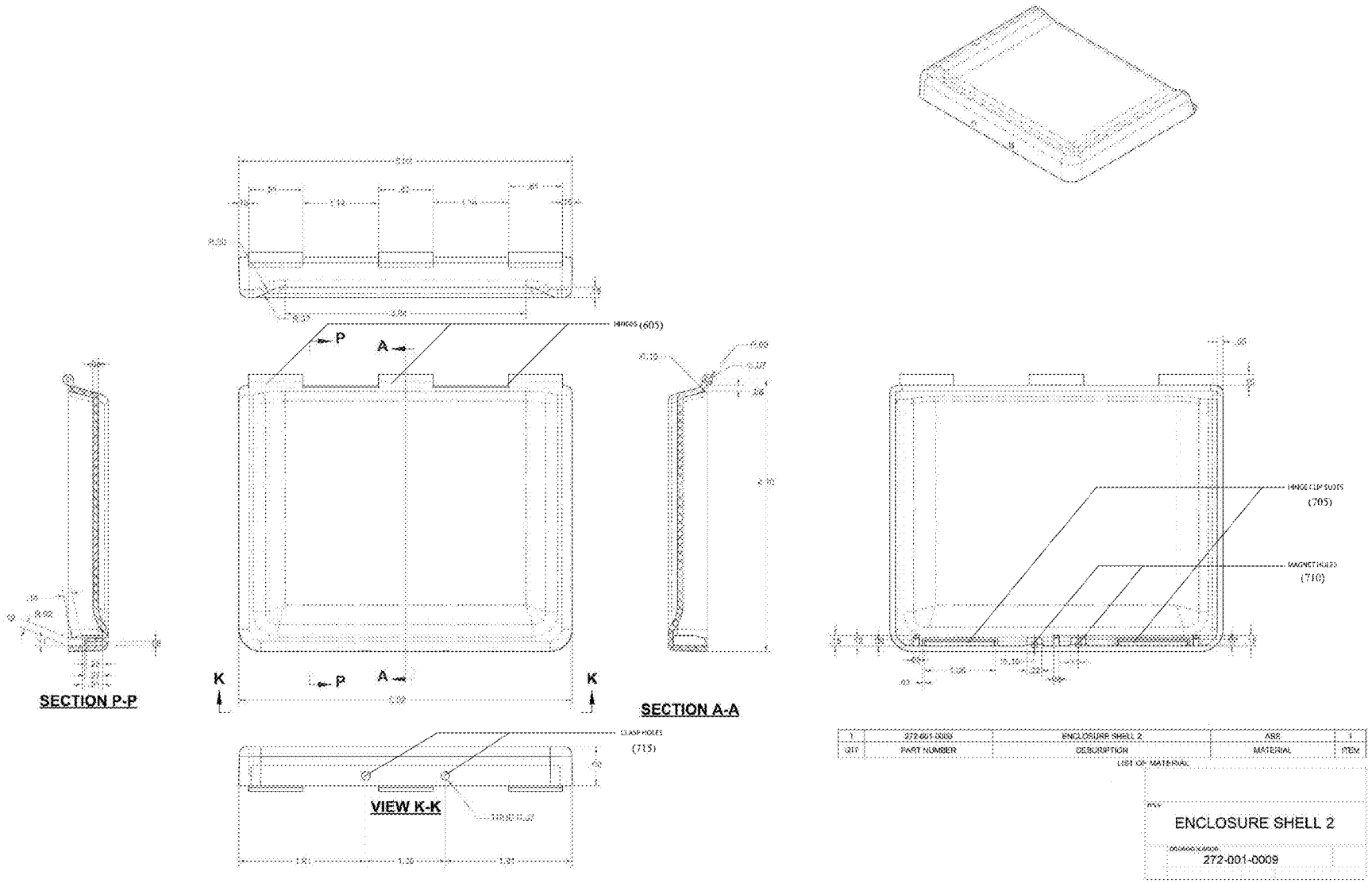

FIG. 5A illustrates various views of an example first enclosure shell, according to aspects of the disclosure. FIG. 5B illustrate various views of an example second enclosure shell, according to aspects of the disclosure. FIGS. 5A and 5B illustrate hinges (605), clasp holes (715), hinge cup slots (705), and magnet holes (710).

FIG. 6A illustrates an example leg, according to aspects of the disclosure. Positive stops (805), hinges (605), and holes for press feet (810) are illustrated. In the embodiment of 8A, the legs are approximately perpendicular with respect to the ground when the stand is opened. FIG. 6B illustrates an embodiment of the product with example legs different from the one in FIG. 6A. As shown in FIG. 6B, the legs are at an obtuse angle with respect to the ground when the stand is open.

Figure 7:
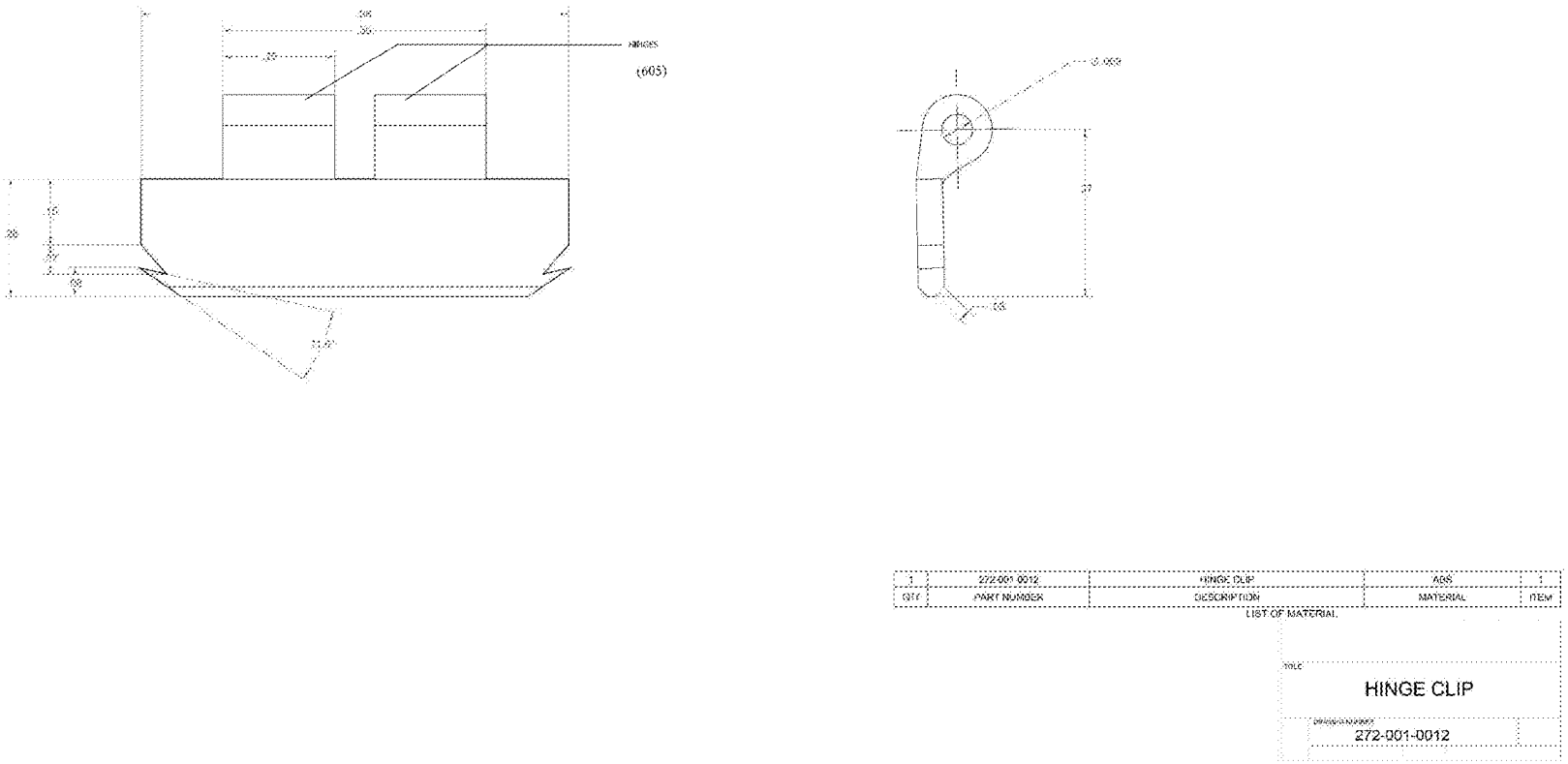
Figure 8:
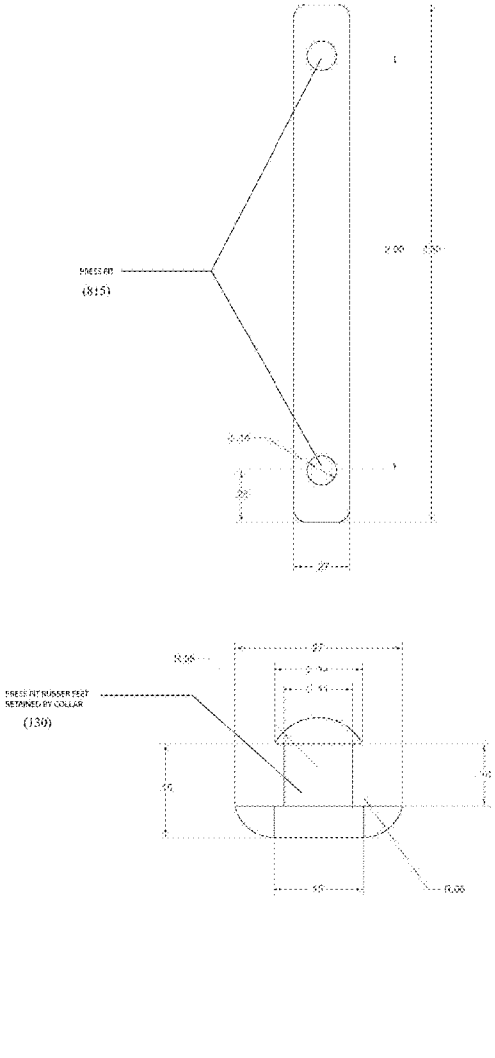

FIG. 7 illustrates an example hinge clip, according to aspects of the disclosure. Example hinges (605) are shown. FIG. 8 illustrates an example bumper, according to aspects of the disclosure. An example press fit (815), and an example press fit rubber feet (130) retained by a collar are shown.

Figure 9:
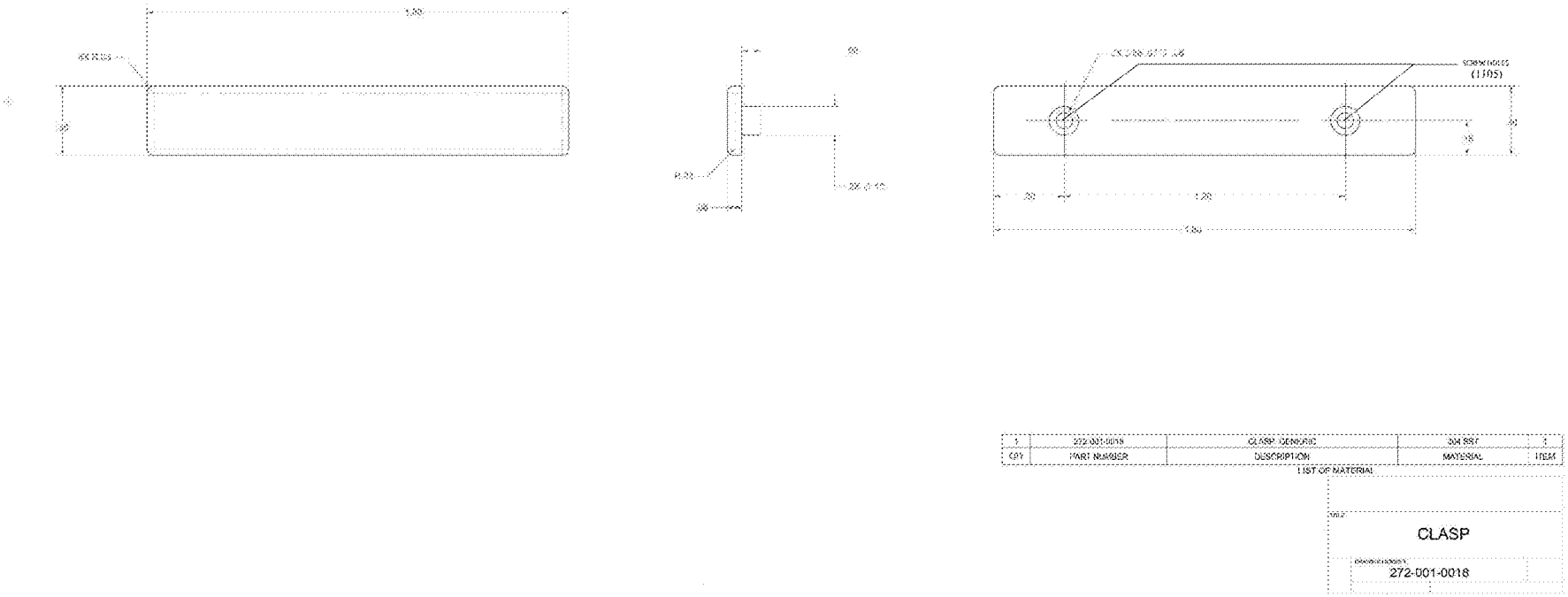

FIG. 9 illustrates an example clasp, according to aspects of the disclosure. Example screw holes (1105) are shown.

FIGS. 10A-F illustrates an example method for making the stand, according to aspects of the disclosure. In 9.1 all necessary materials can be retrieved. An example list of materials is provided in 9.1. In 9.2, a long pin can be cut (e.g., 4.75 inches). And 4 short pins can be cut (e.g., 1.125 inches). Wire cutters can be used. Burrs and sharp edges can be removed with a metal file. The pin can be filed down so that both ends have flat faces. In 9.3, a long hinge of the enclosure shells 1 and 2 can be lined up and secured together by inserting a long pin with a hammer or mallet. Before inserting the pin, a fit of the pin can be tested in the hinge to ensure that it will be flushed with the out ends of the hinge. In some aspects of the disclosure, no part of the pin should be sticking out. The pin can be filed down until it is the correct size.

In 9.4, a small drop of glue (e.g., super glue) can be added into each designated magnet hole in an enclosure shell. Before the glue dries, magnets can be inserted into the magnet holes. A hammer or mallet and gently tap down until they are fully seated inside the holes.

In 9.5, for each of the installed magnets, they can be oriented and tested with another magnet to find which end will attract to the already installed magnet. This test magnet can be installed across into enclosure shell 2 with the same procedure as step 9.4, helping ensure that attracted magnet is facing up out of the hole.

In 9.6, a clasp can be installed onto the side of the enclosure shell using pan head screws. This can be repeated for the second enclosure shell.

In 9.7, a bumper can be inserted into holes at the bottom of a leg. This can be repeated to create two legs with bumpers.

In 9.8, a leg can be placed flat side down onto a table, and hinge clips can be installed with the flat side facing up using a short pin per hinge. With the pin partly installed, slide a spring (e.g., torsion spring) in the middle of the hinge clip so that the pin secures it in place. Ensure that the spring is installed with one end facing down and flush with the side of the leg. The spring can be trimmed with wire cutters so that the top end is flush with the hinge clip and the bottom end doesn't extend beyond the flat face of the leg. This can be repeated to create the leg assemblies.

In 9.9, the hinge clip(s) can be inserted into slots in the enclosure shells so that the flat face of the leg is facing towards the center of the assembly. The legs can be attached at any angle using the process described in 9.8 and 9.9.

In 10.0, the assembly can be inspected and a label can be placed. It should be noted that the above example method of assembly is only one example of how the product can be assembled. Many other methods of assembly can be performed.

In addition, multiple other parts can be used to replace the parts described in FIG. 10A-F. For example, the clasp can be connected to enclosures using screws, a press fit (e.g., such feet), a glue or other adhesive, a mold that clasps into place, a design of two interlocking plastic parts, or a rivet, or any combination thereof. As another example, the legs can be shut with a user's fingers, or with a pocket knife mechanism, or a cam lock of the legs (e.g., fold over legs so they snap in place), or any combination thereof. As another example, the hinge can be self closing (e.g., spring loaded and/or with a pin), a piano hinge, a boss on one piece that the other piece can snap onto, no hinge (e.g., merely interlocking), a living hinge, or a self-opening hinge (e.g., spring loaded), or any combination thereof. As other example, the product can be closed using magnets, with a clasp with a locking mechanism, a cam lock (e.g., lid with snap feature) to lower the body, a strap (e.g., around the product), a clasp lock (e.g., jewelry box lock), snap hooks, or a spring load hinge with an open and closed position (e.g., such as a glasses case), or any combination thereof.

Figure 11:
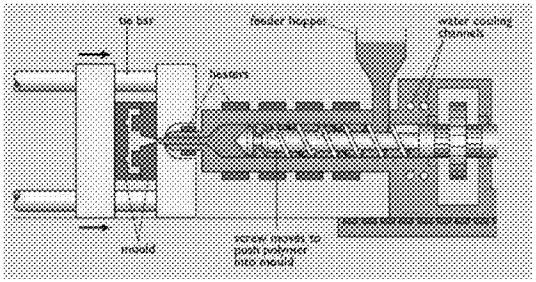
FIG. 11 illustrates an example injection molding process that can be used for enclosures, clips and/or feet, according to aspects of the disclosure.

FIG. 11 illustrates an example injection molding process that can be used for enclosures, clips and/or feet, according to aspects of the disclosure. In 1301, the molds can close and the cycle can begin. In 1302, heated plastic can be injected into the mold. In 1303, the part can be given cooling time. In 1304, the screw can retract while drawing in new plastic for the next part. In 1305, the molds can open, and the ejector pins can push the part out of molds, and the cycle can end.

Figure 12:
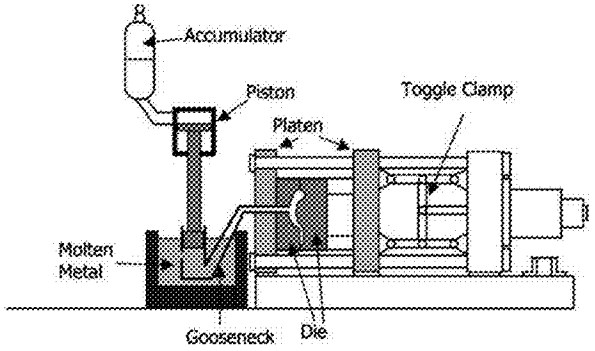
FIG. 12 illustrates an example die casting process that can be used for legs and/or clasps, according to aspects of the disclosure.

FIG. 12 illustrates an example die casting process that can be used for legs and/or clasps, according to aspects of the disclosure. In 1401, the dies can be closed and a new cycle can begin. In 1402, heated metal can be injected into the mold. In 1403, the part can be given cooling time. In 1404, the piston can retract. In 1405, the molds can open, and the ejector pins can push the part out of mold, the flash can be removed, and the cycle can end.

Figure 13:
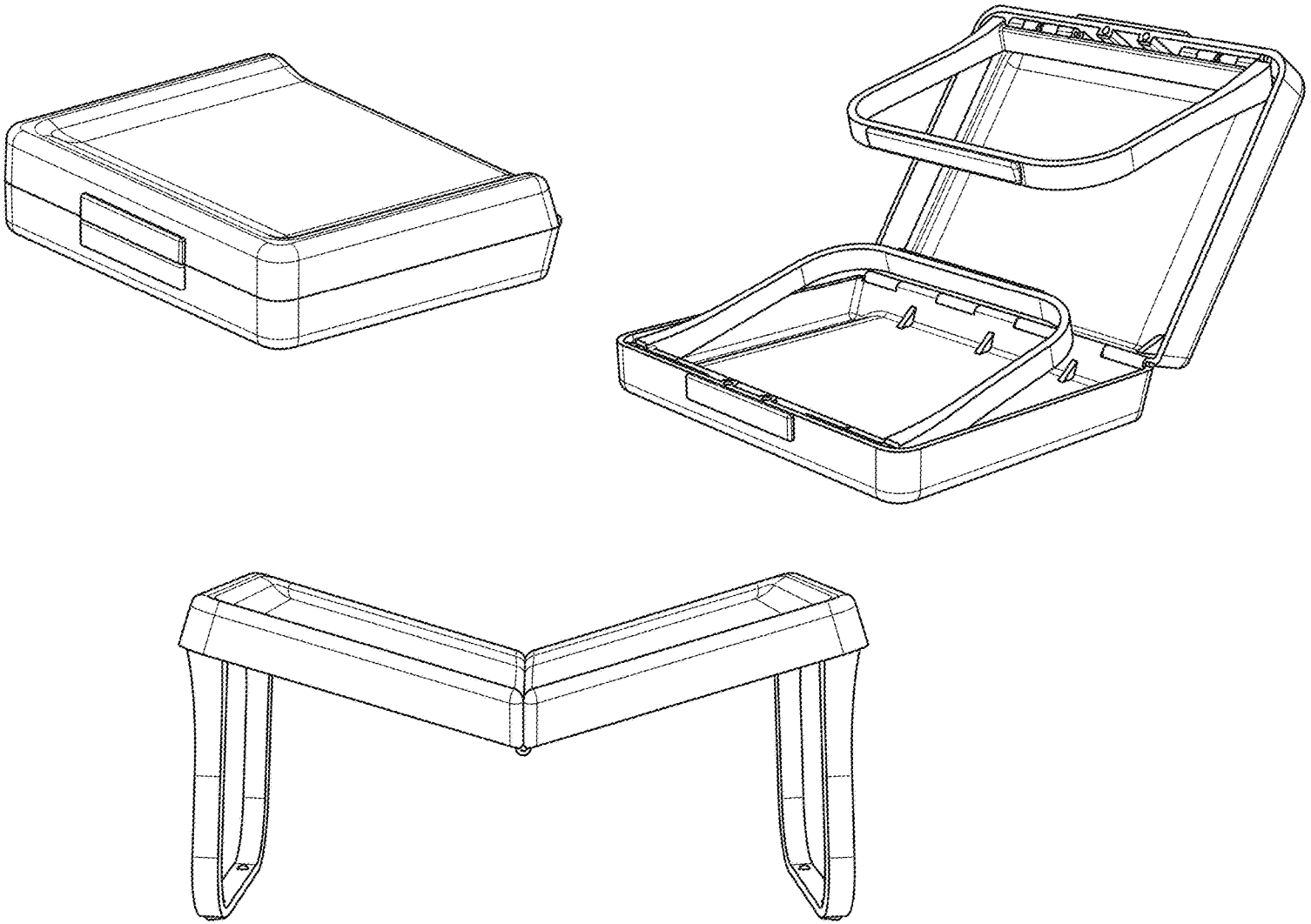
FIG. 13 illustrates an example method of opening the product used to hold items, according to aspects of the disclosure.

FIG. 13 illustrates an example method of opening the product used to hold items, according to aspects of the disclosure. In 1, the product can be removed from anything used to hold it (e.g., a bag, cover, etc.—or nothing) and opened. In 2, the legs can fold out automatically as the product is opened. In this way, the user does not need to touch the bottom of the legs (e.g., the part of the legs that touch the ground) in order to open the product. In 3, the product can be flipped over and is ready for use.

Figure 14:
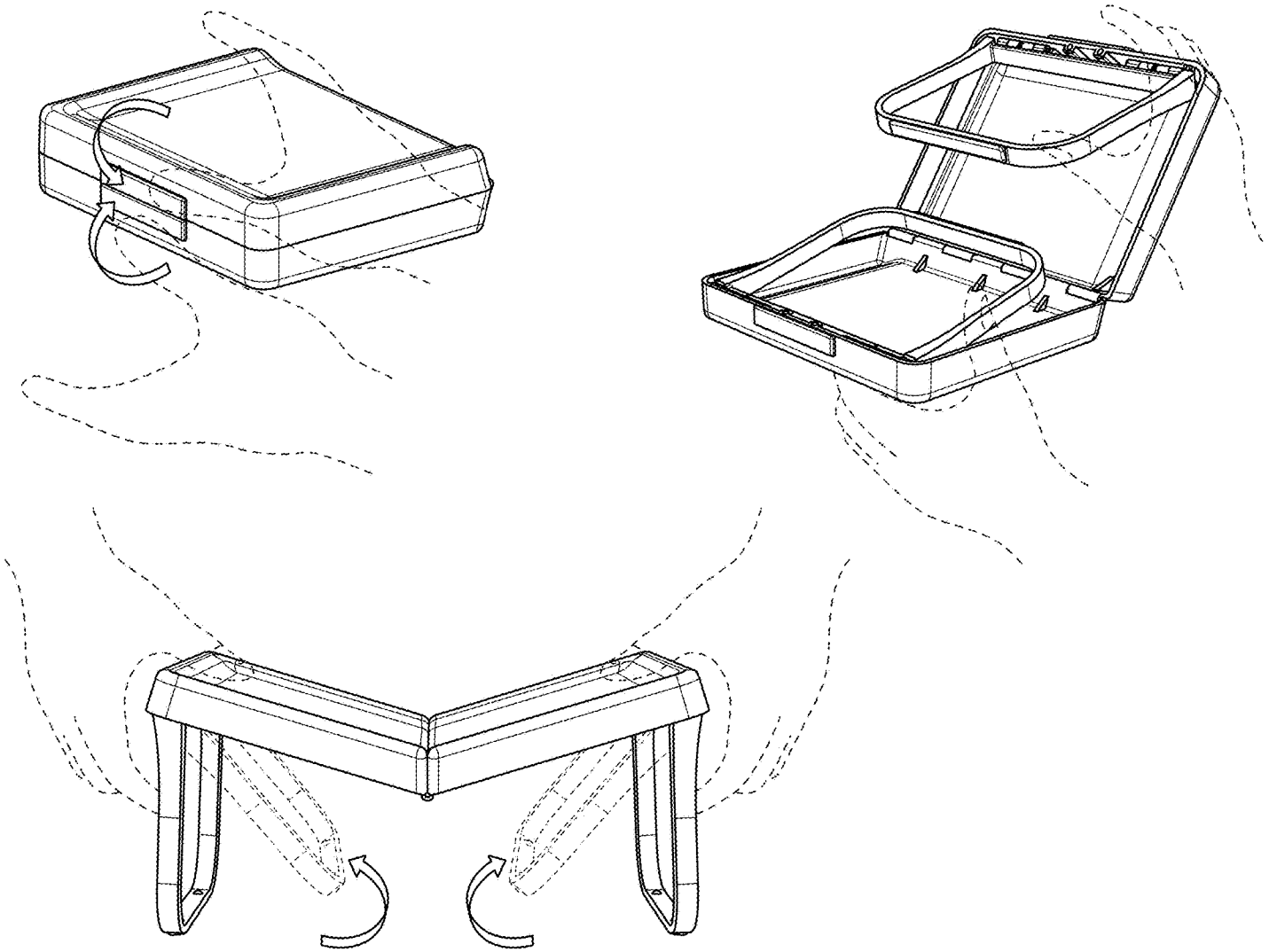
FIG. 14 illustrates an example method of closing the product used to hold items, according to aspects of the disclosure.

FIG. 14 illustrates an example method of closing the product used to hold items, according to aspects of the disclosure. In 4, the user can press on the side(s) of the legs, and the legs then close, so that the user does not need to touch the bottom of the legs (e.g., so that the user may never have to touch a dirty surface). In 5, the product can be flipped over while continuously pushing in the legs. In 6, the product can be closed (e.g., using magnets). It may be placed in a bag, cover or other item.

Figure 15A:
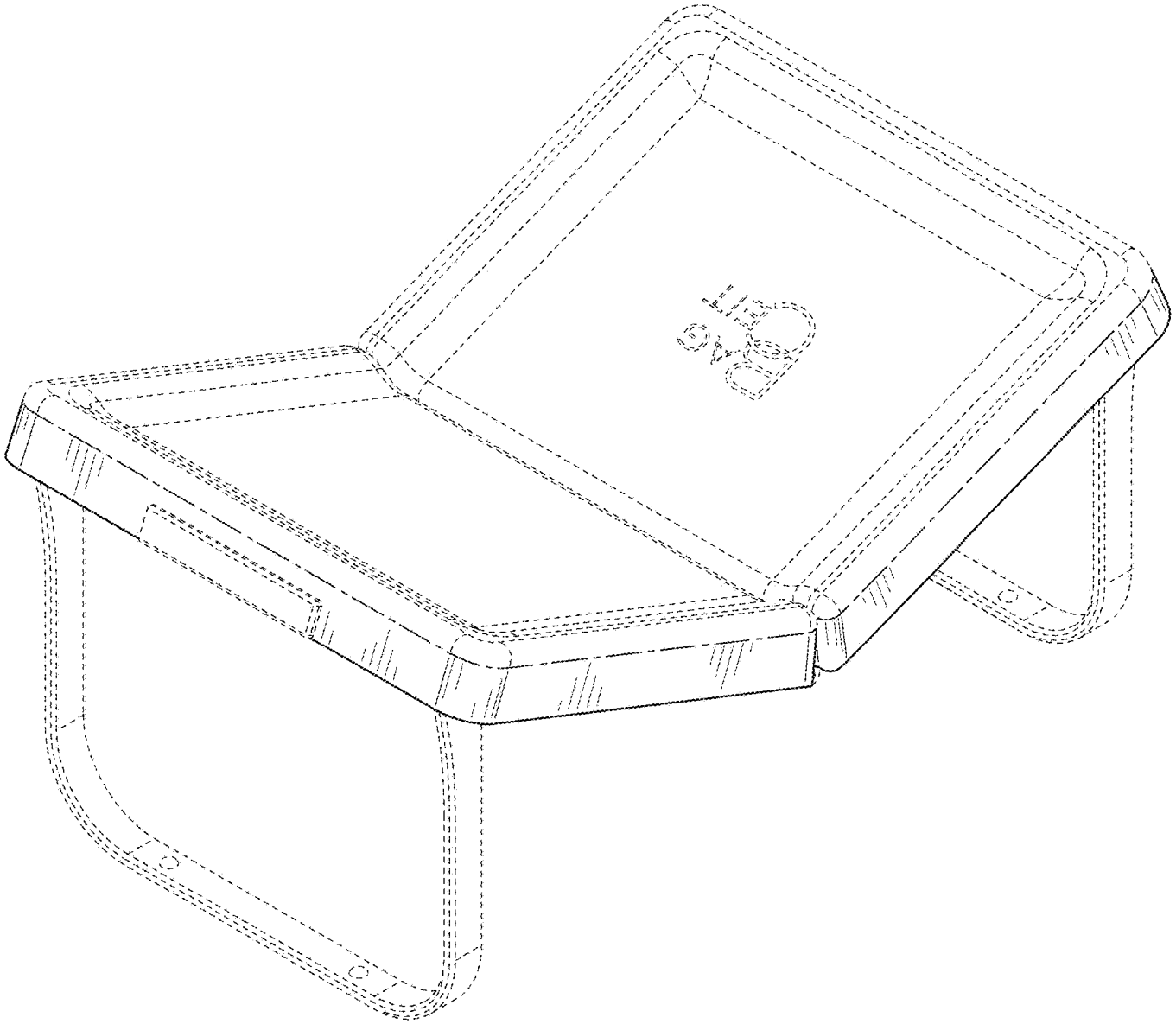
FIGS. 15A-15TT illustrate various views of various aspects/embodiments of the disclosure.
Figure 15B:
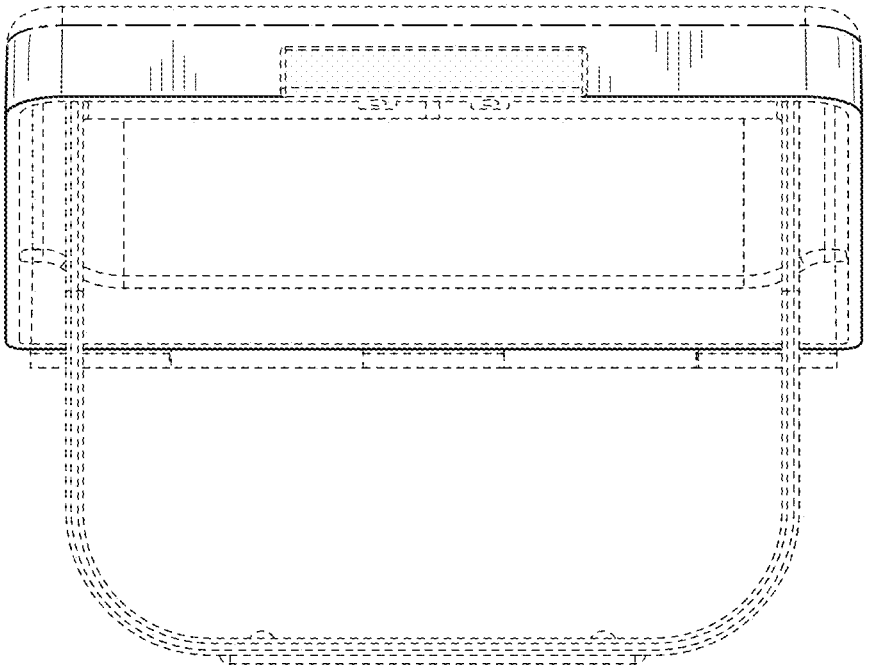
Figure 15C:
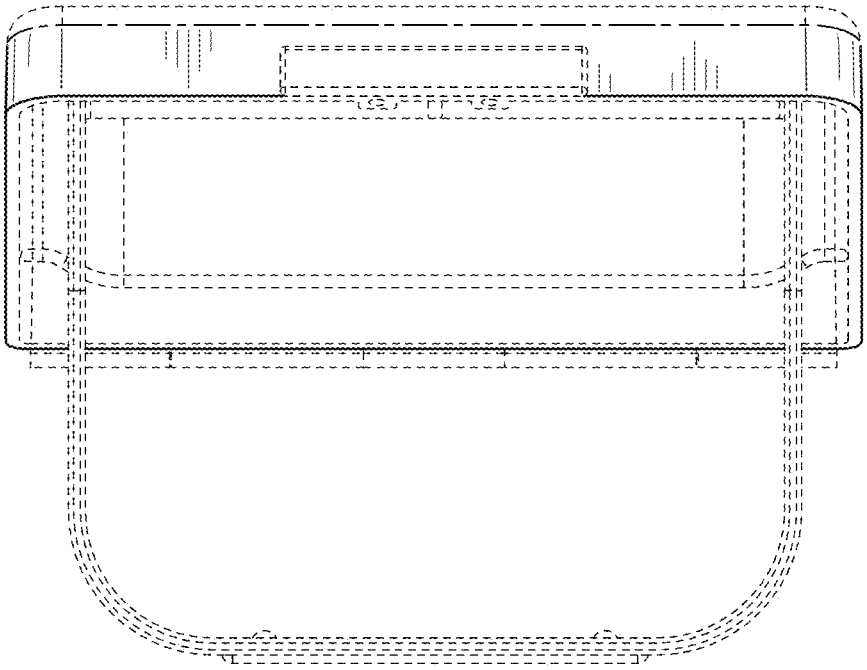
Figure 15D:
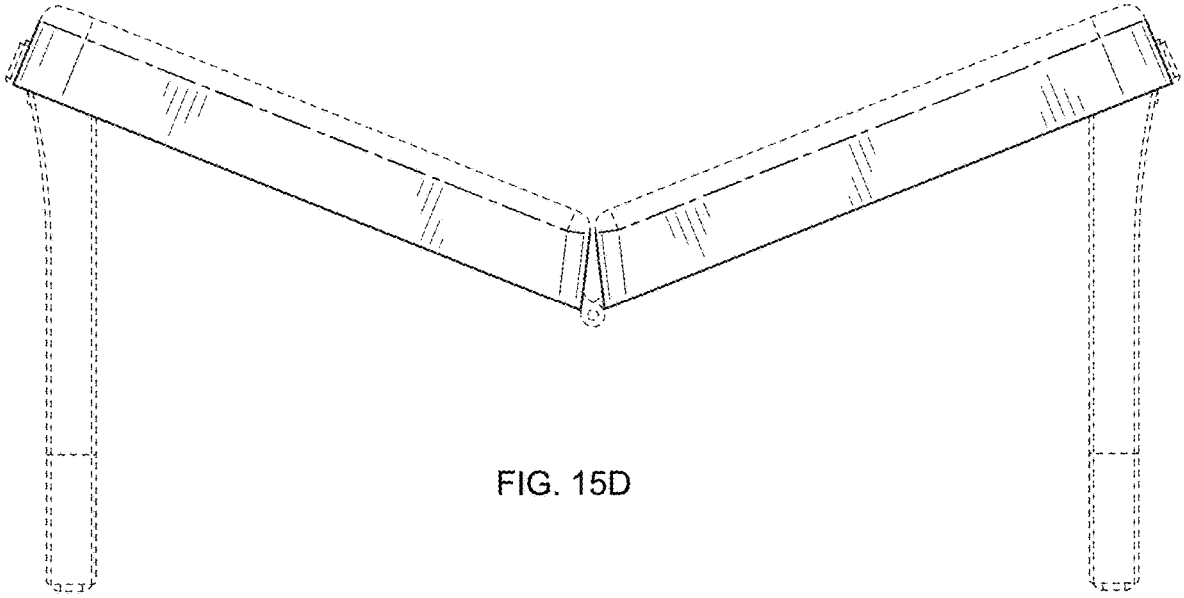
Figure 15E:
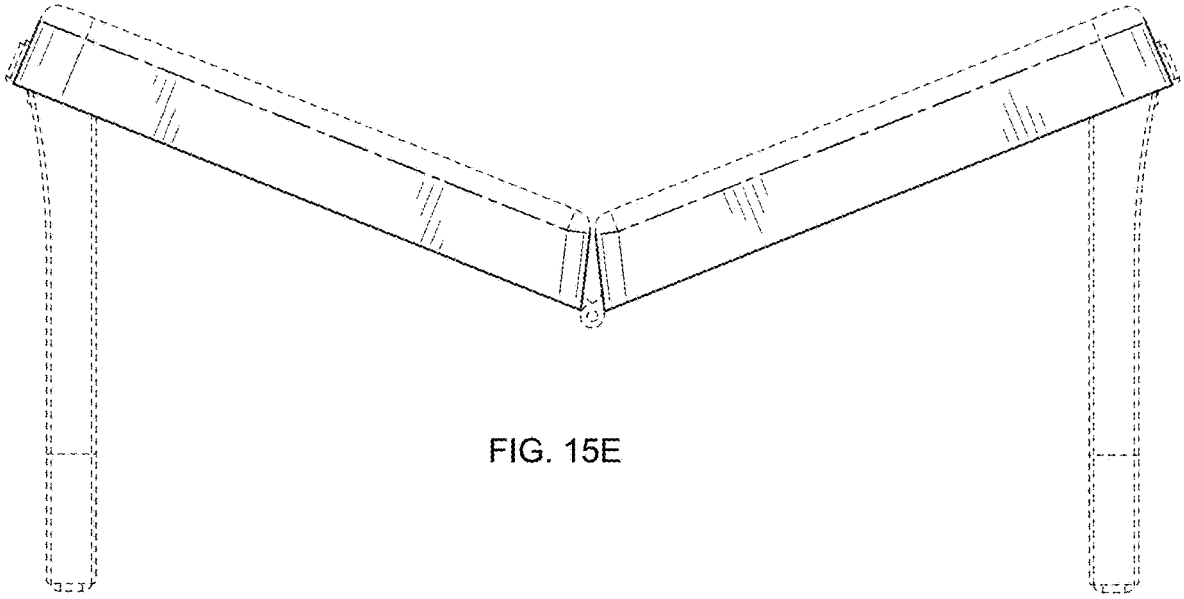
Figure 15F:
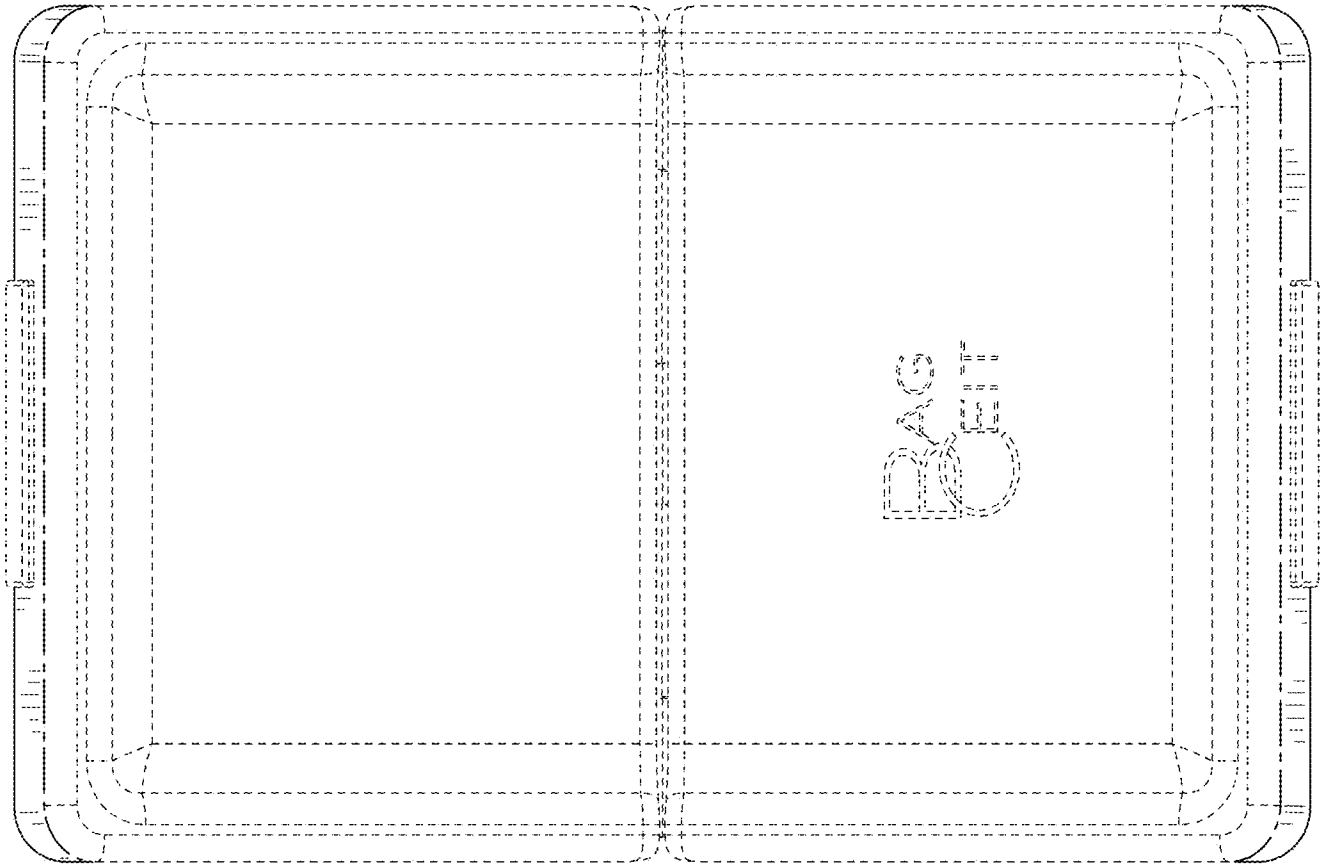
Figure 15G:
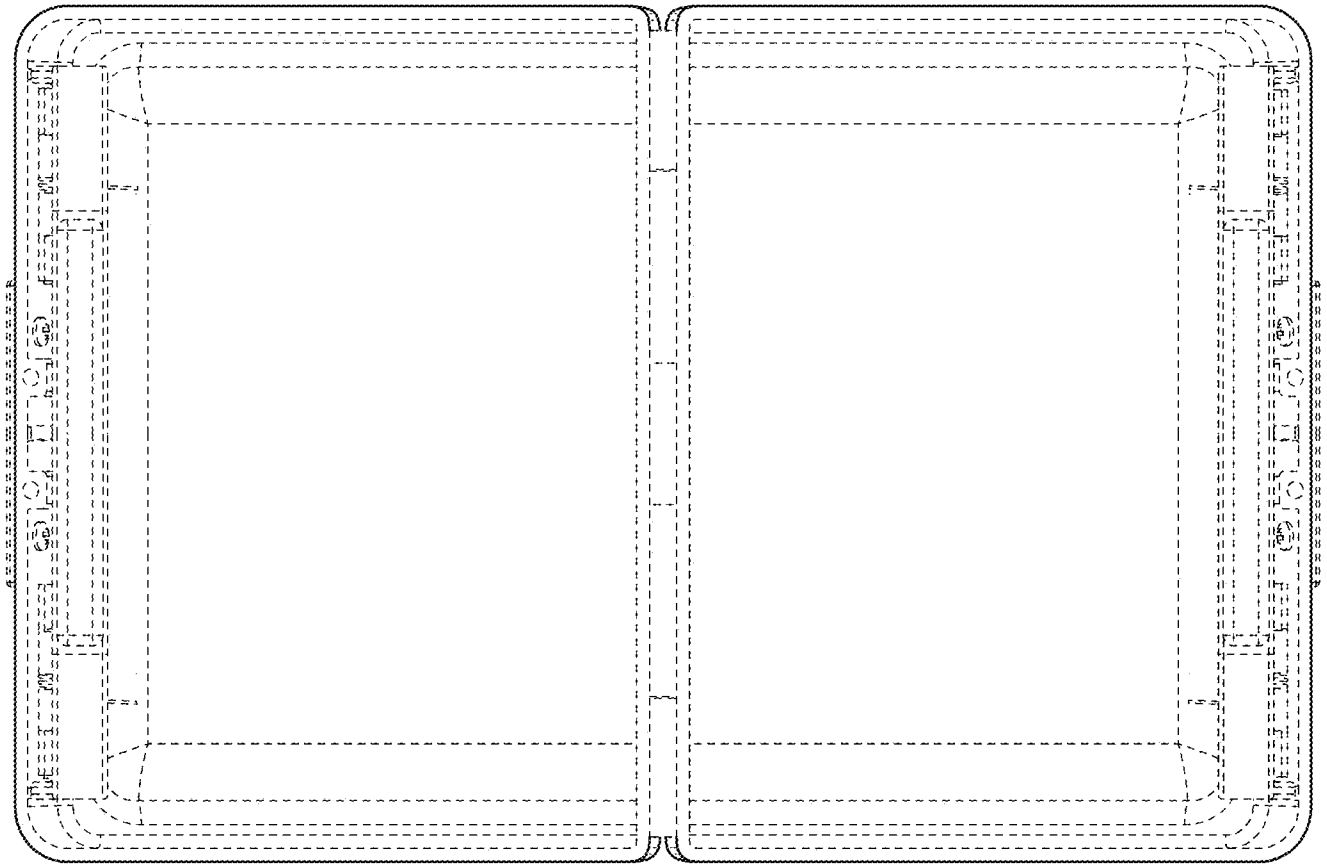
Figure 15H:
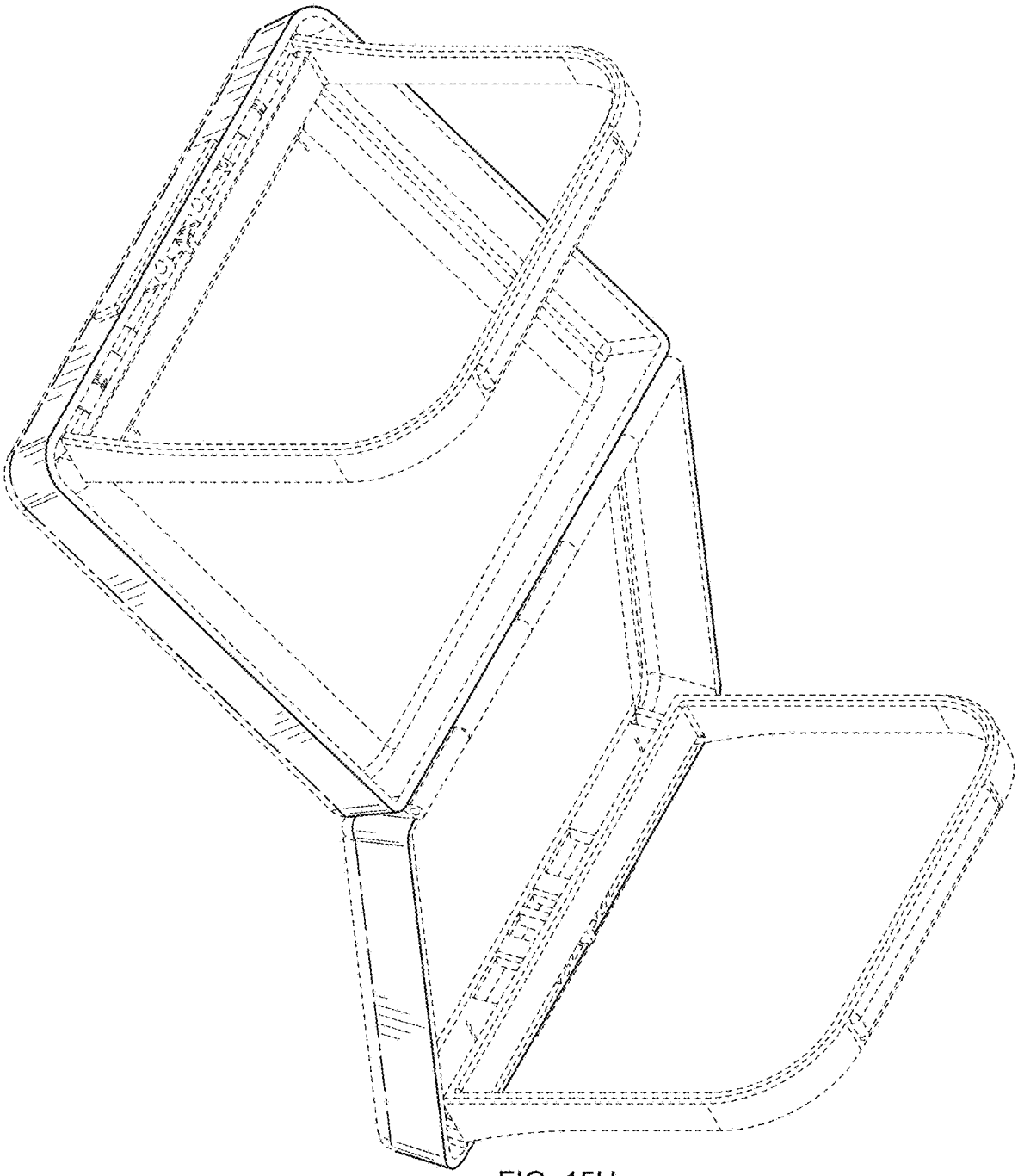
Figure 15I:
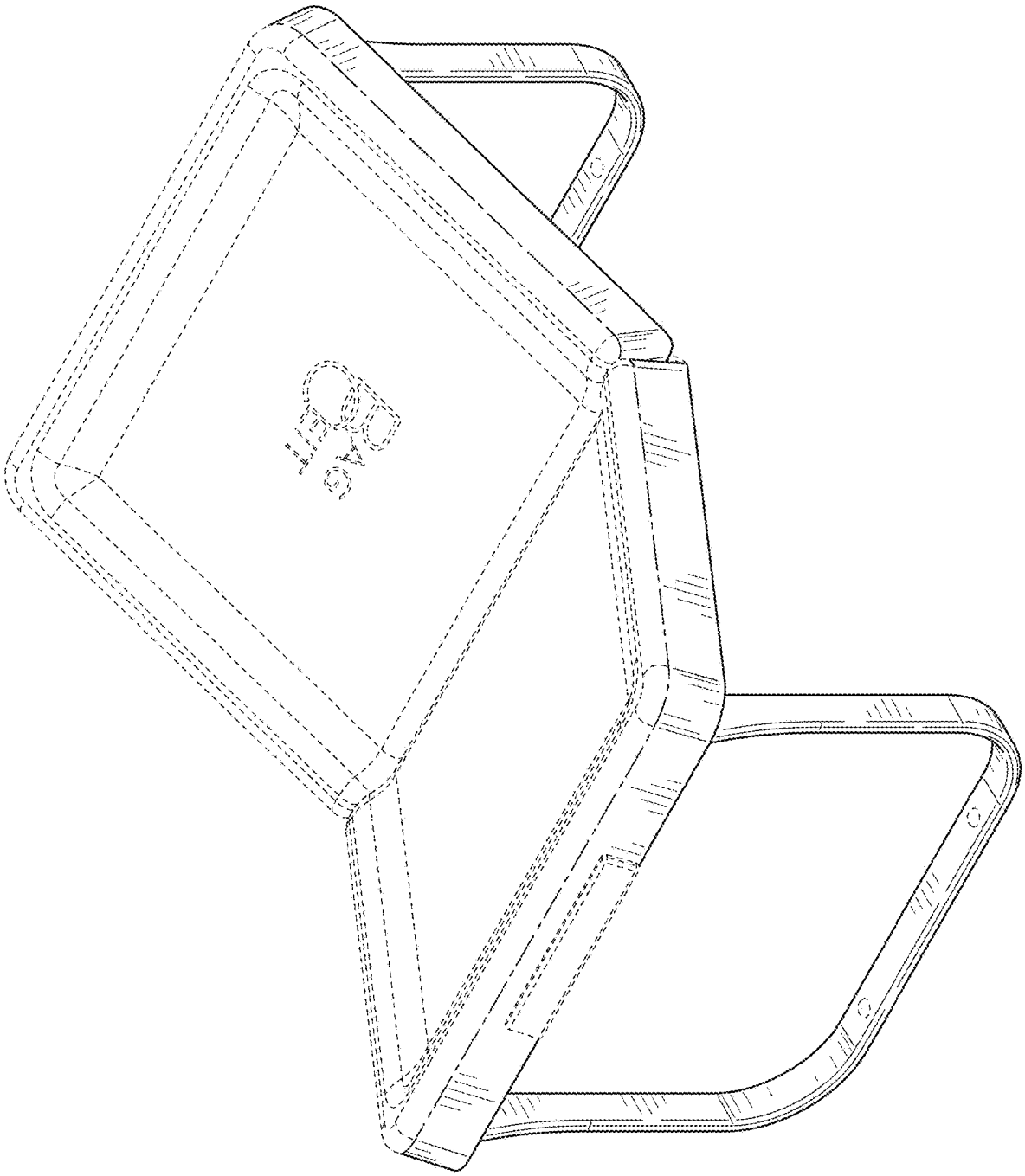
Figure 15J:
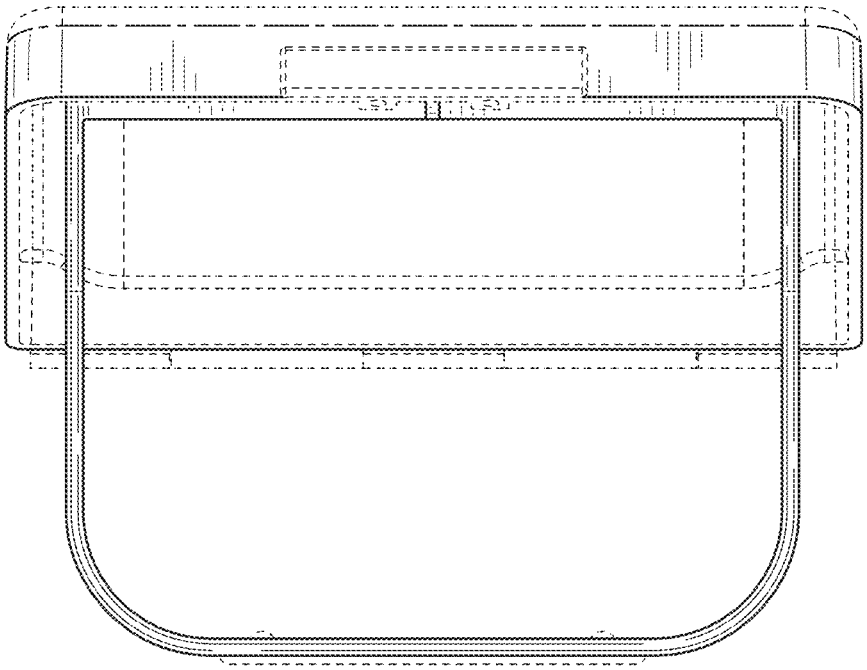
Figure 15K:
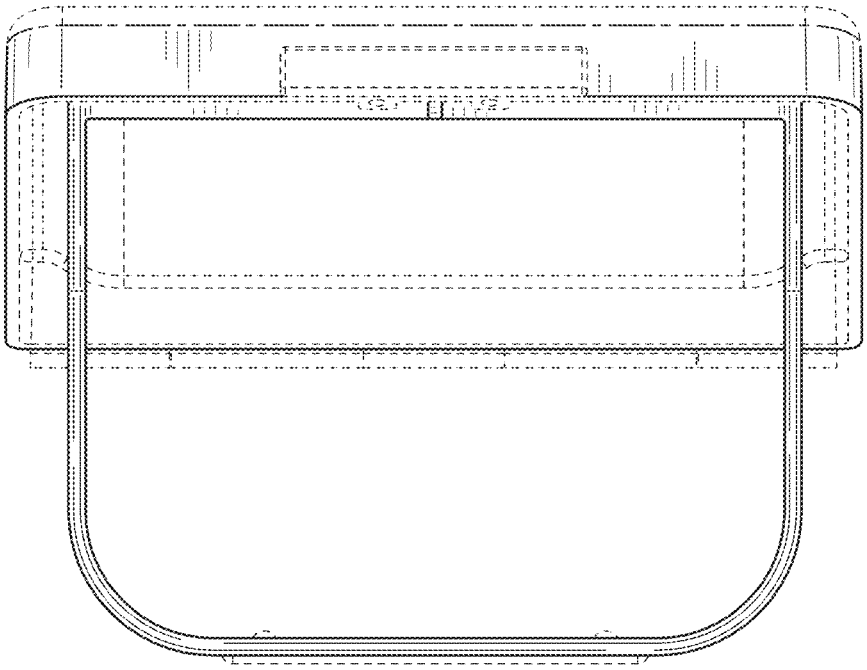
Figure 15L:
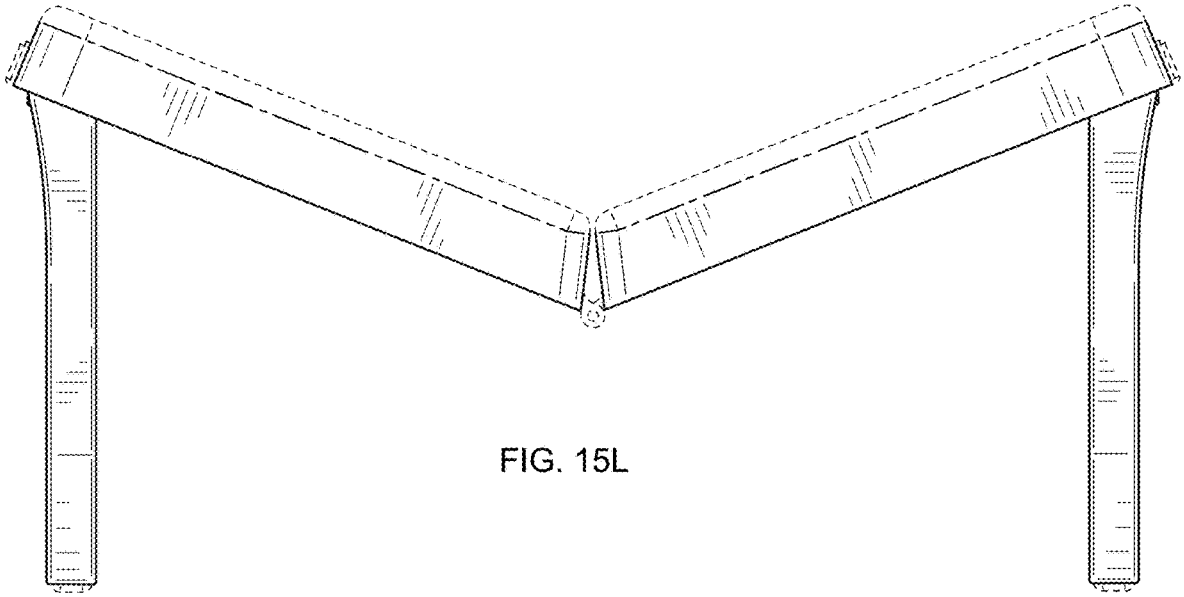
Figure 15M:
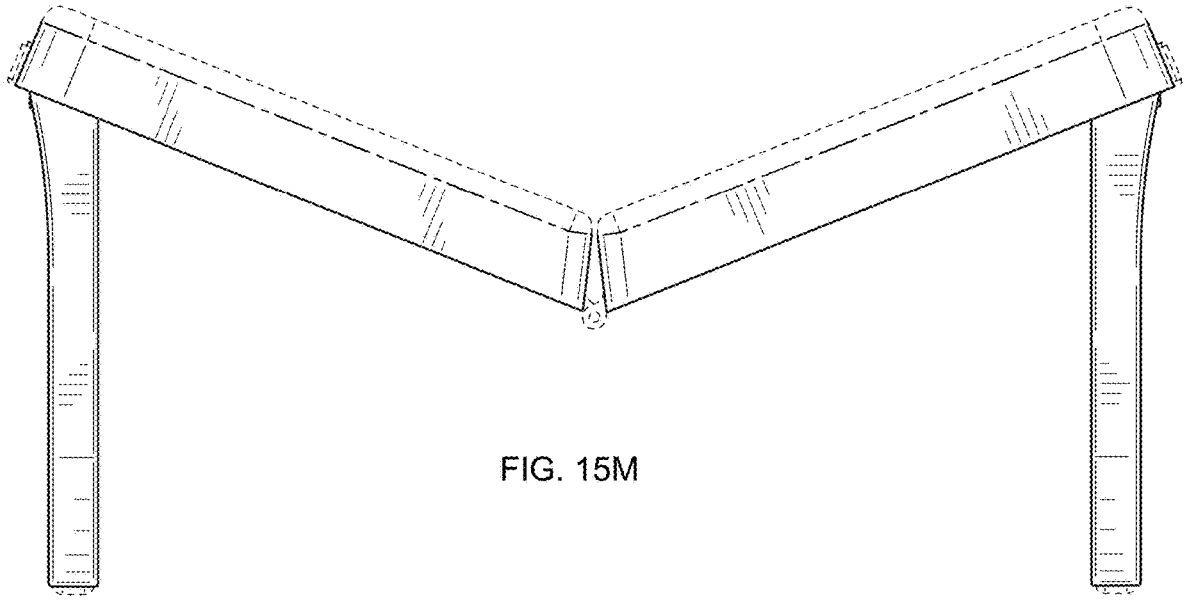
Figure 15N:
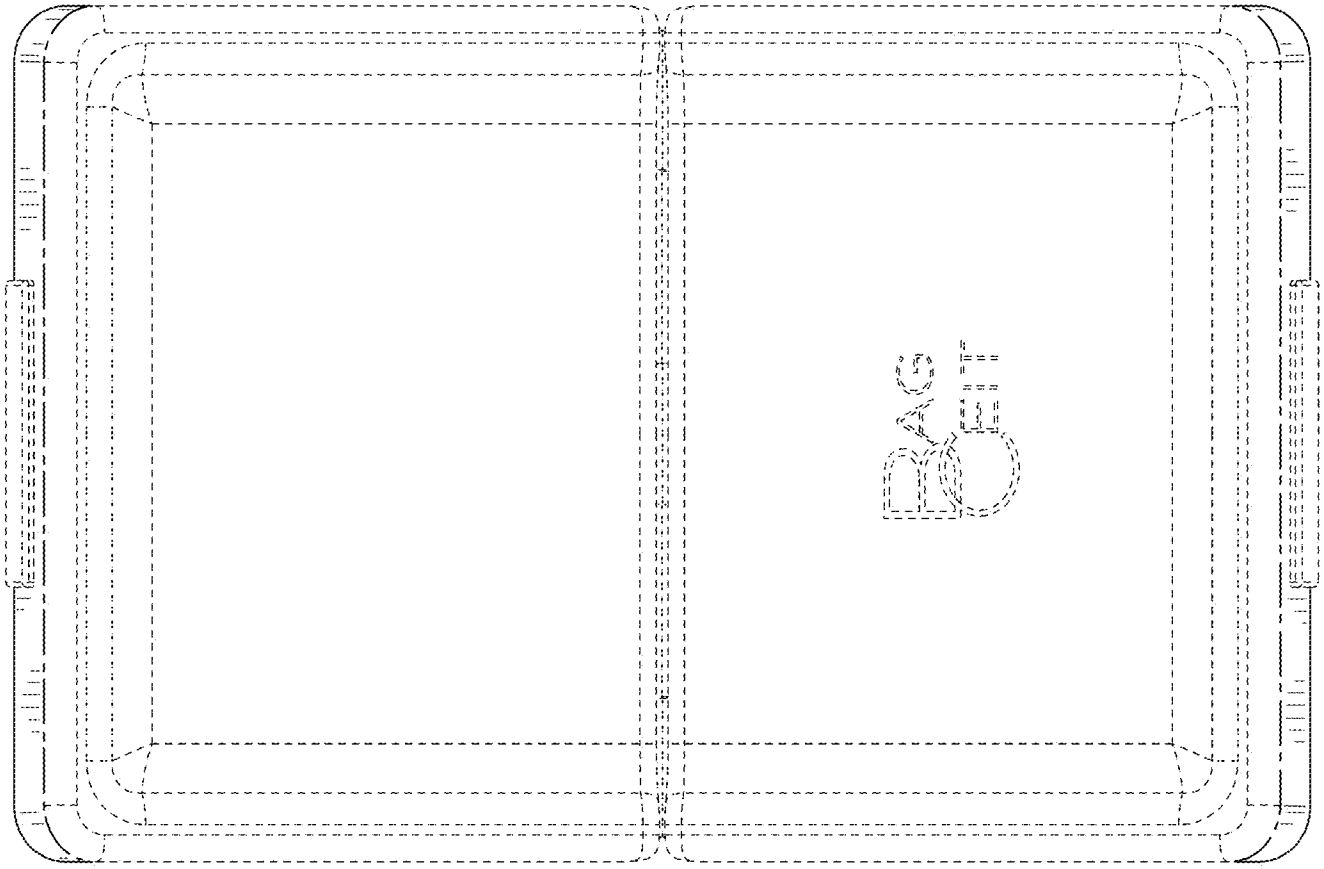
Figure 15O:
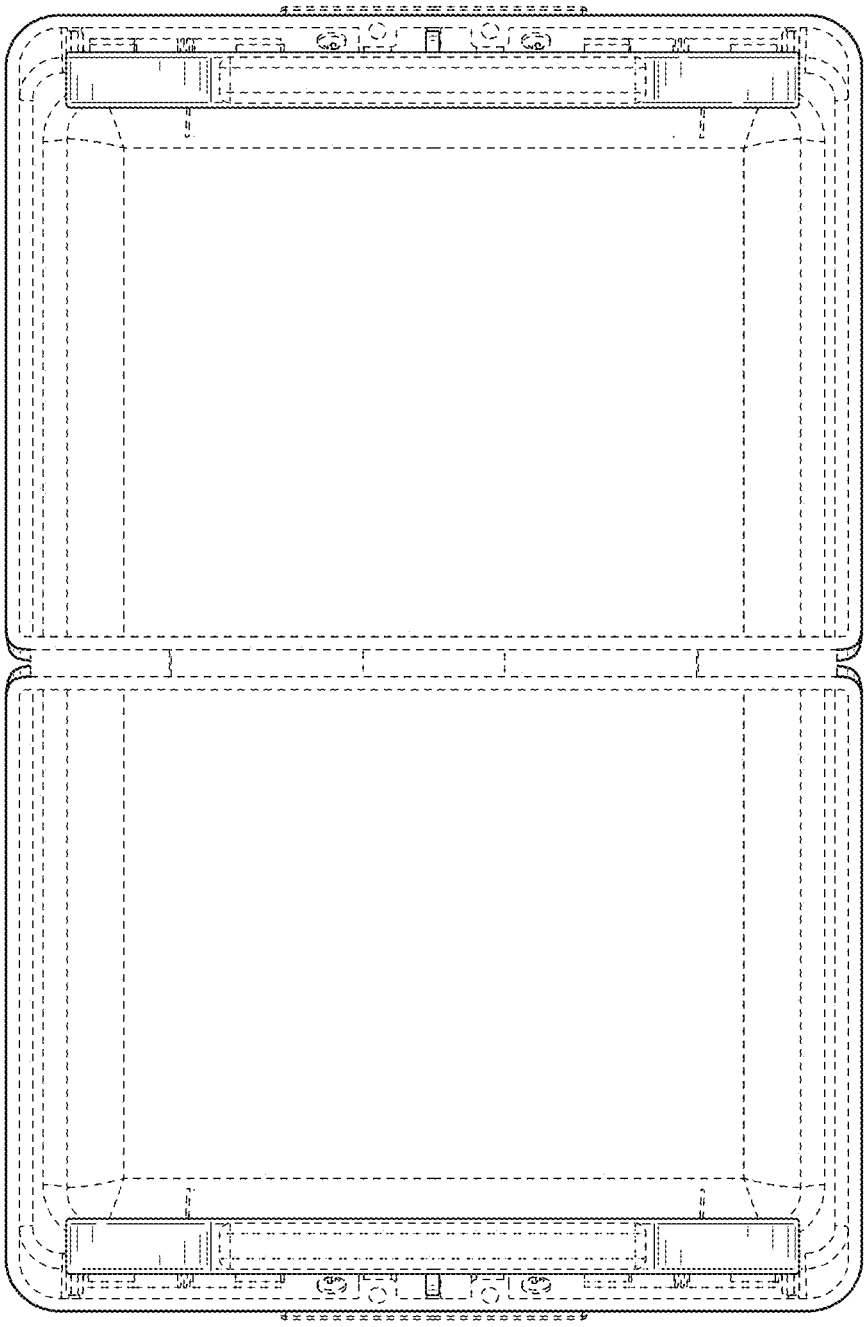
Figure 15P:
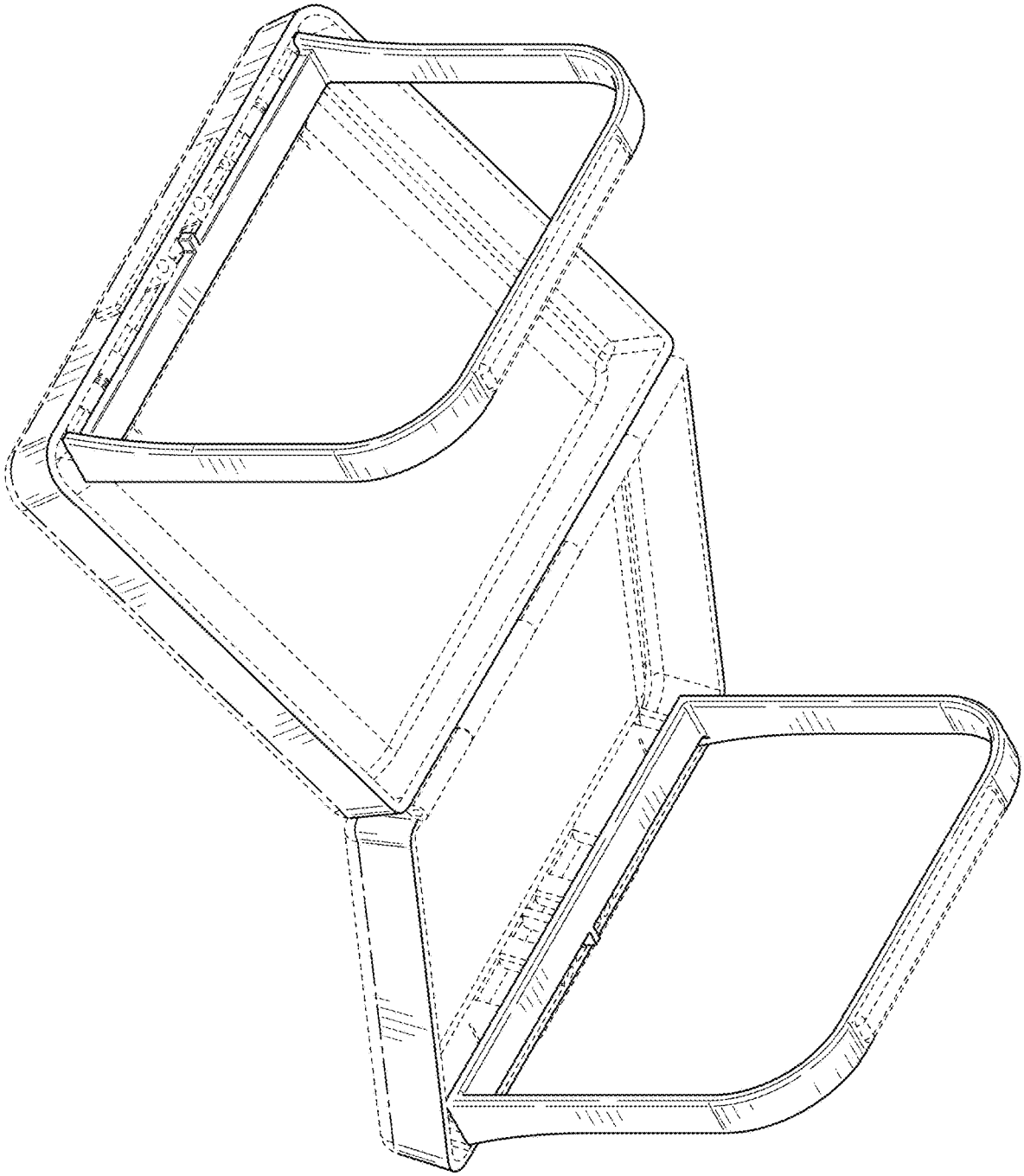
Figure 15Q:
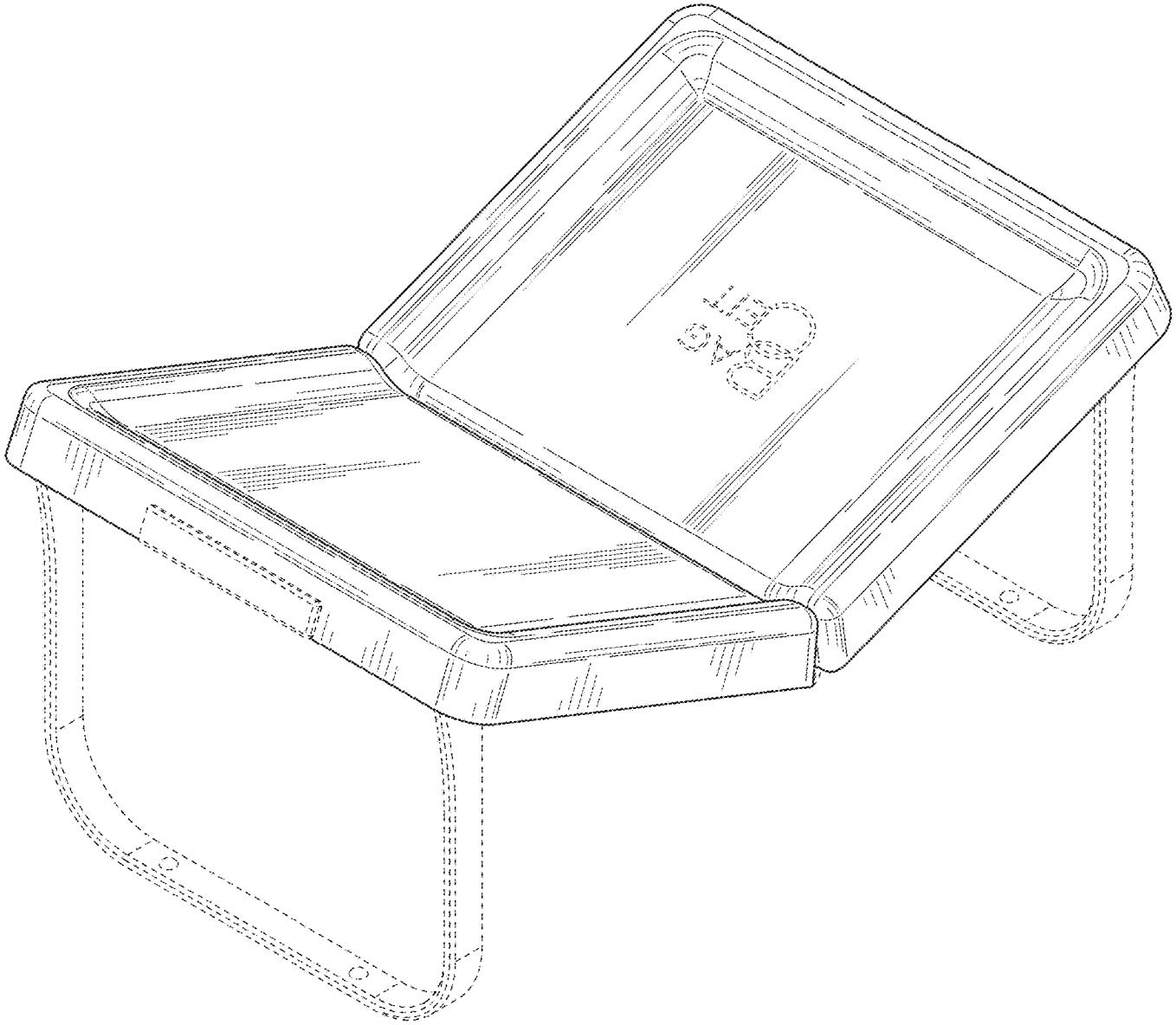
Figure 15R:
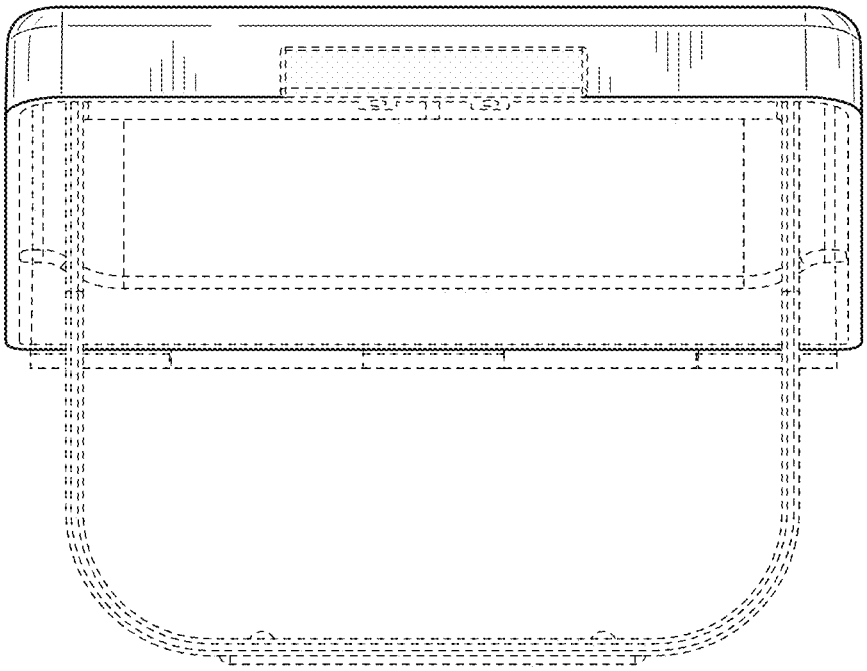
Figure 15S:
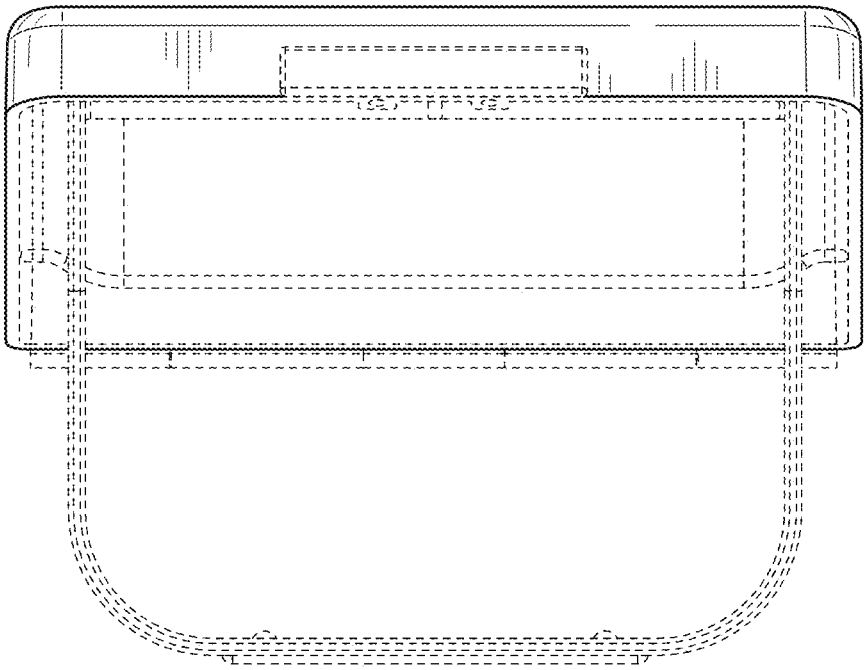
Figure 15T:
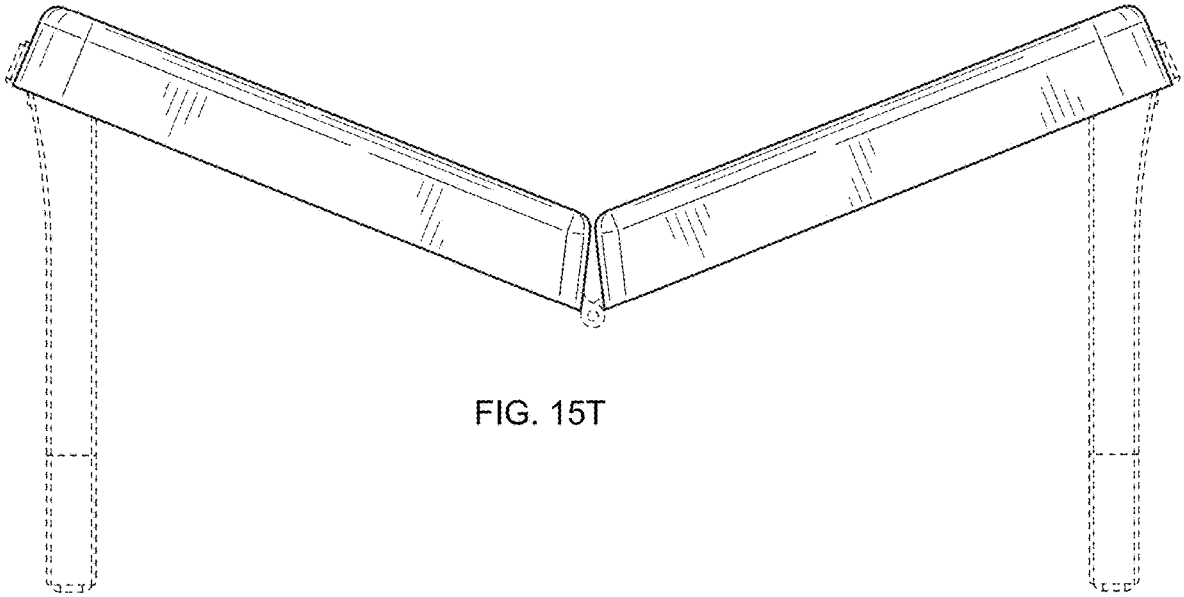
Figure 15U:
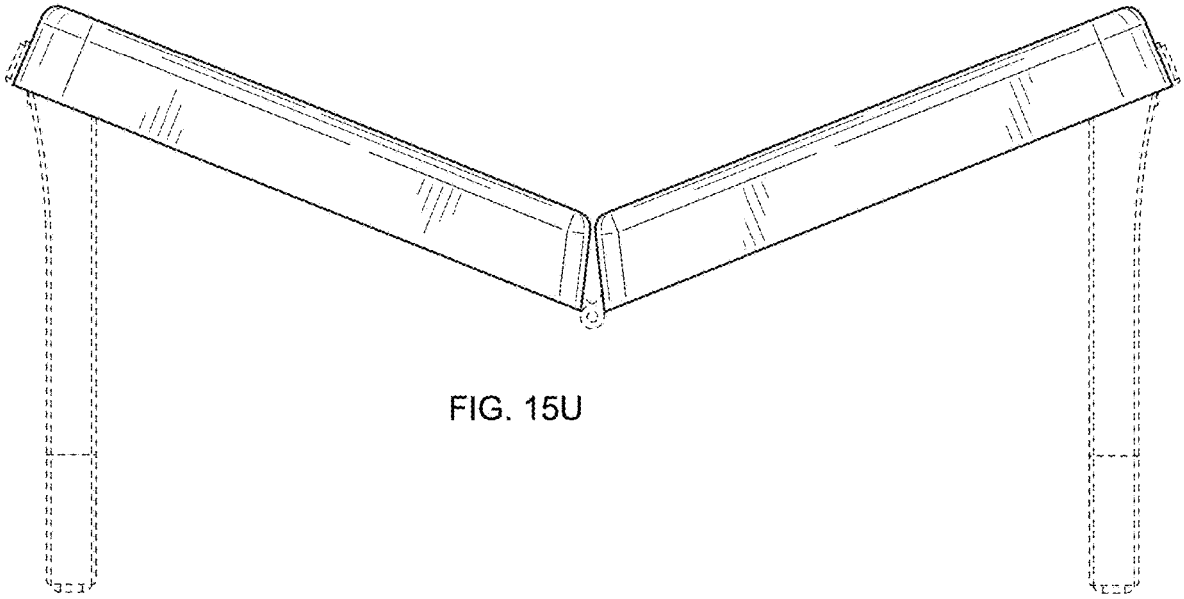
Figure 15V:
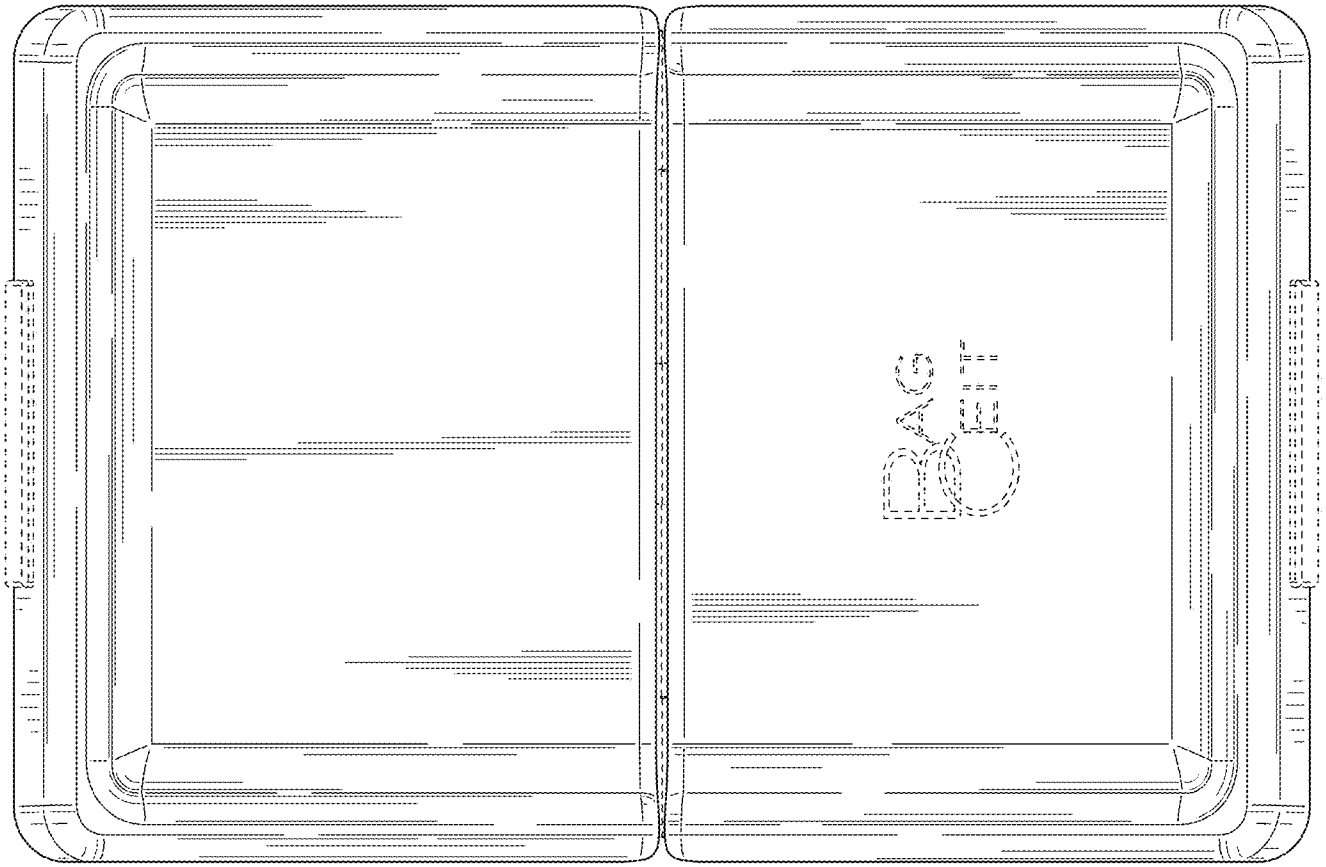
Figure 15W:
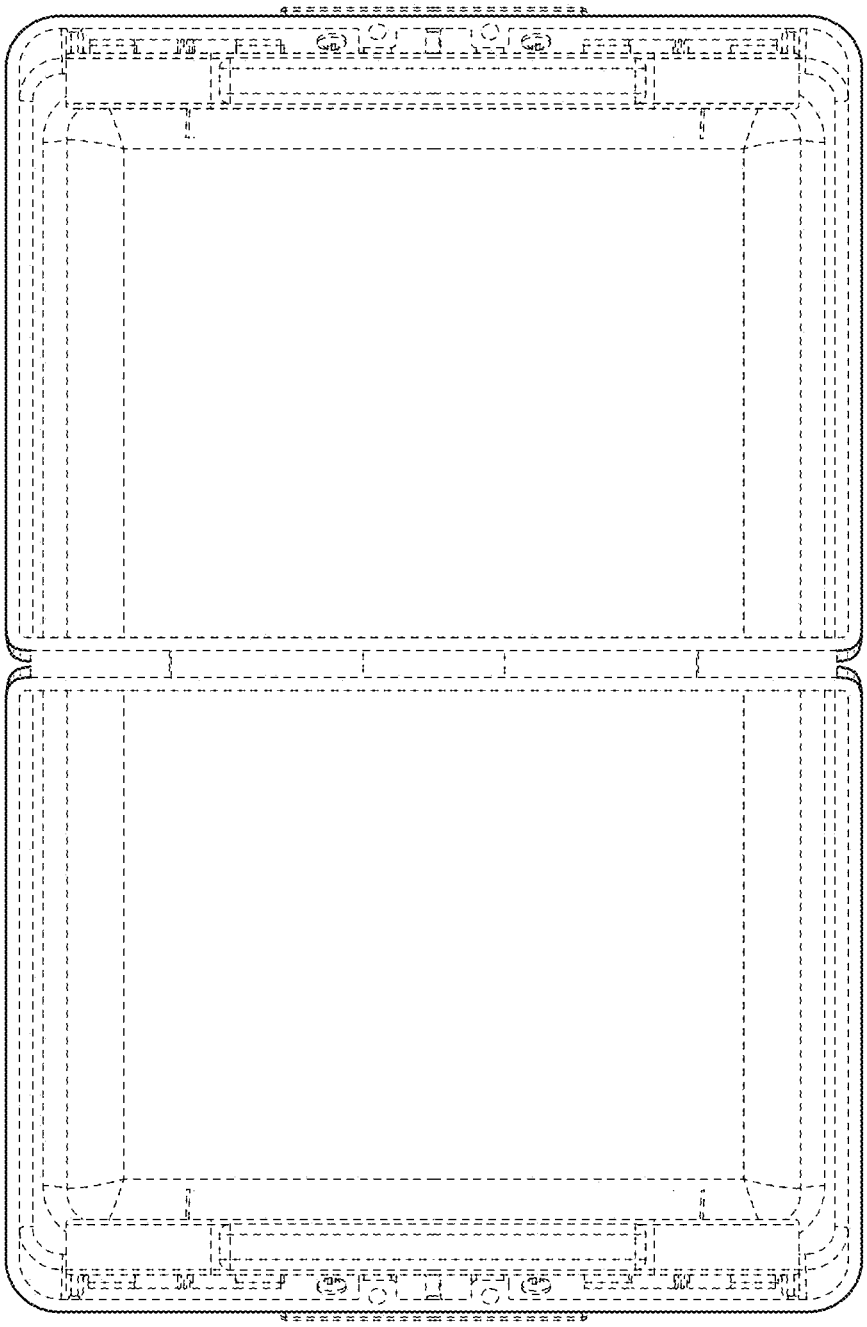
Figure 15X:
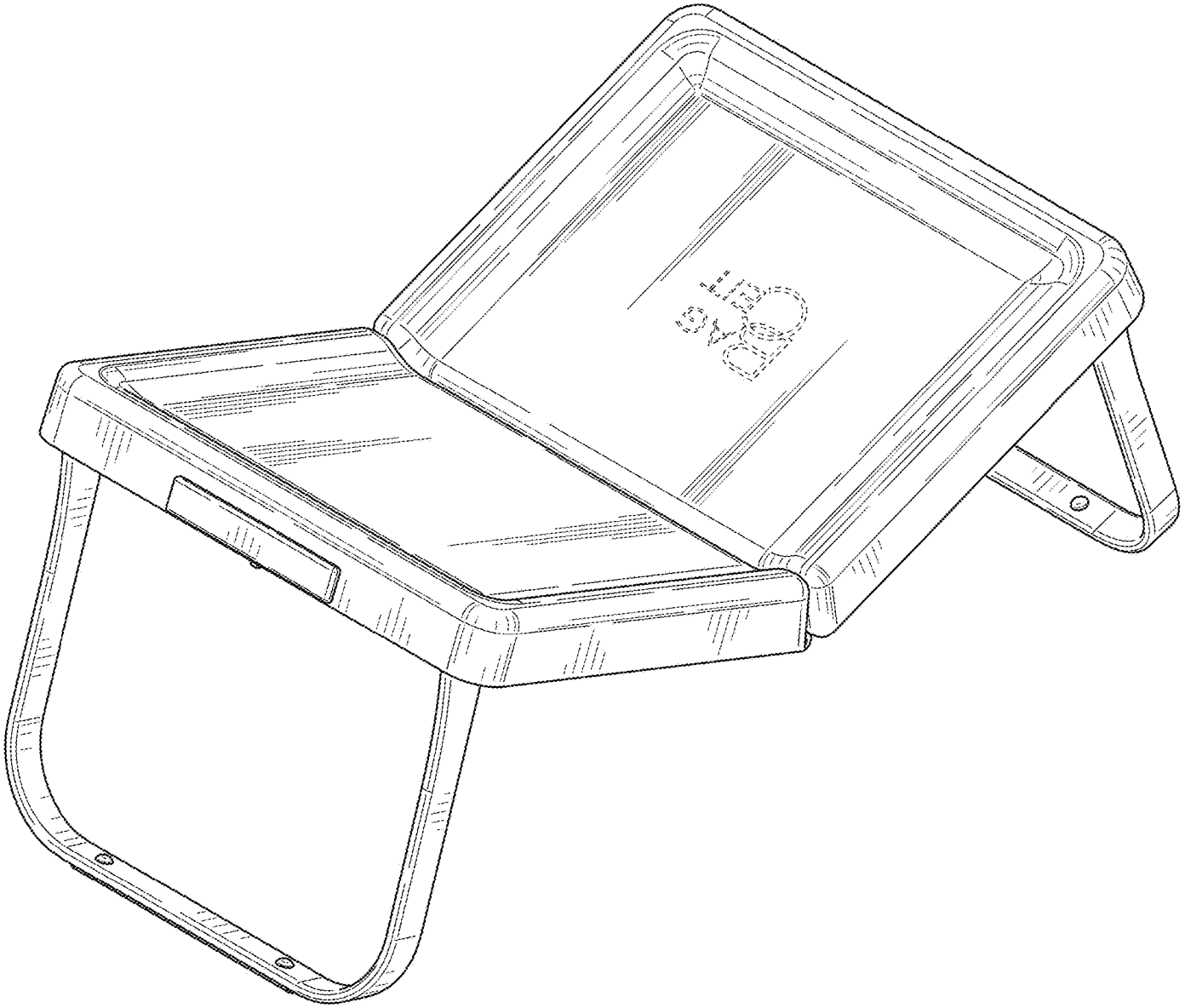
Figure 15Y:
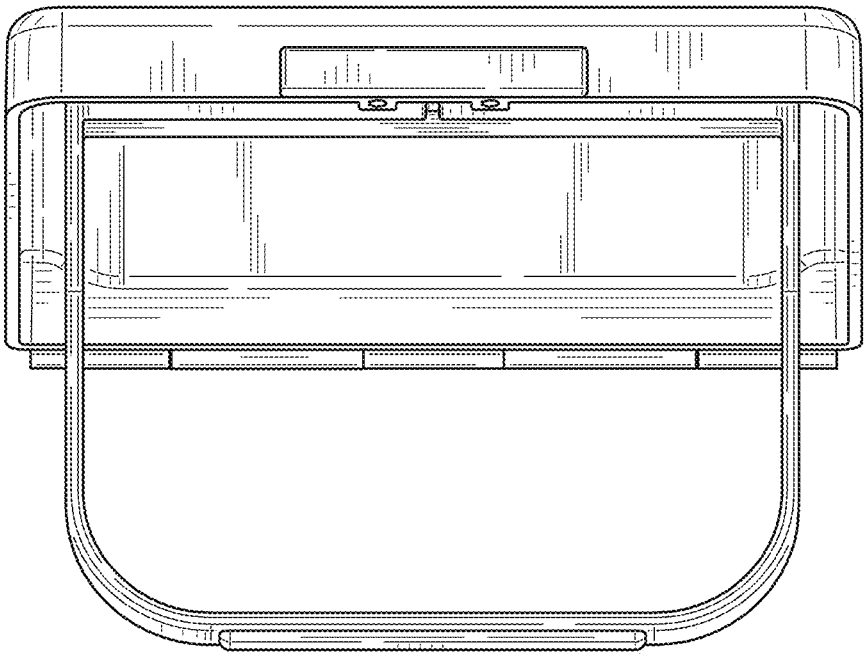
Figure 15Z:
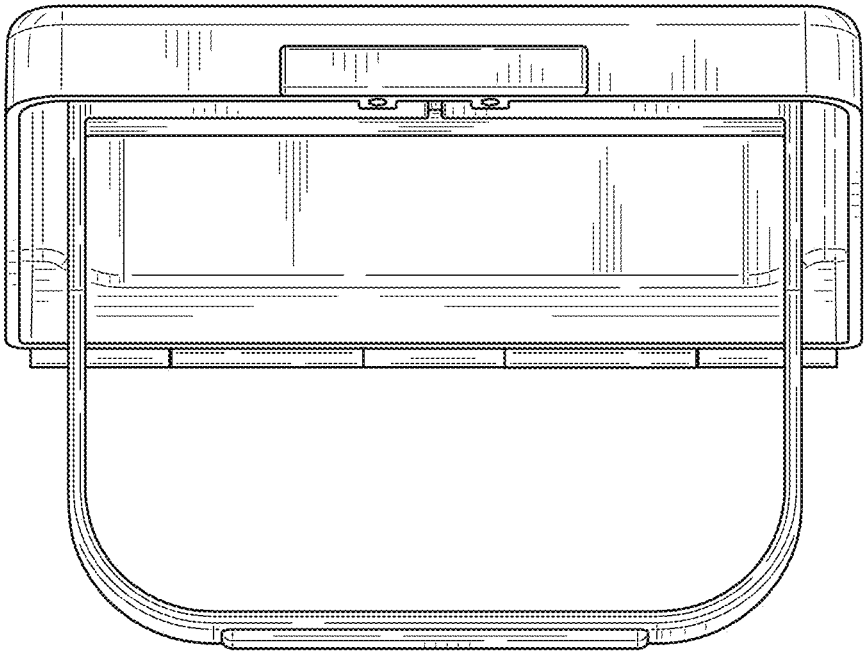
Figure 15A:
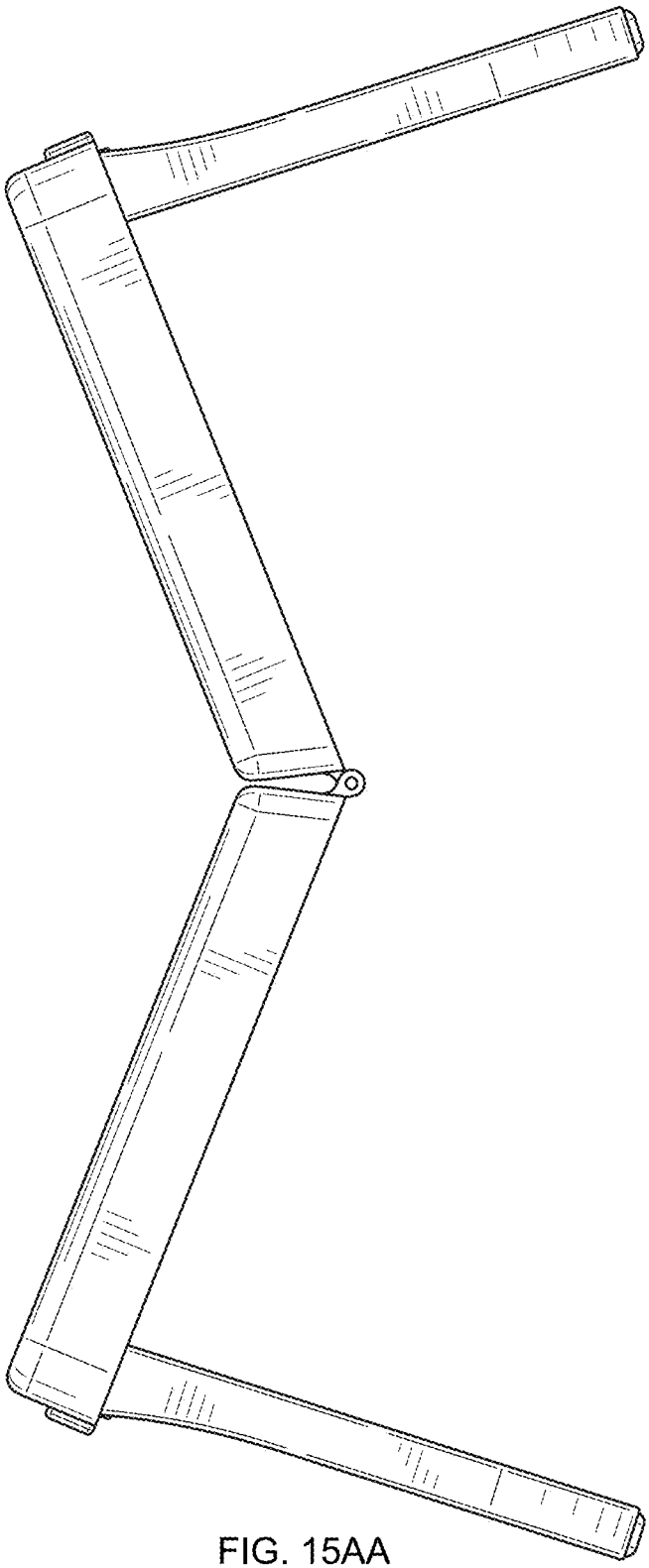
Figure 15B:
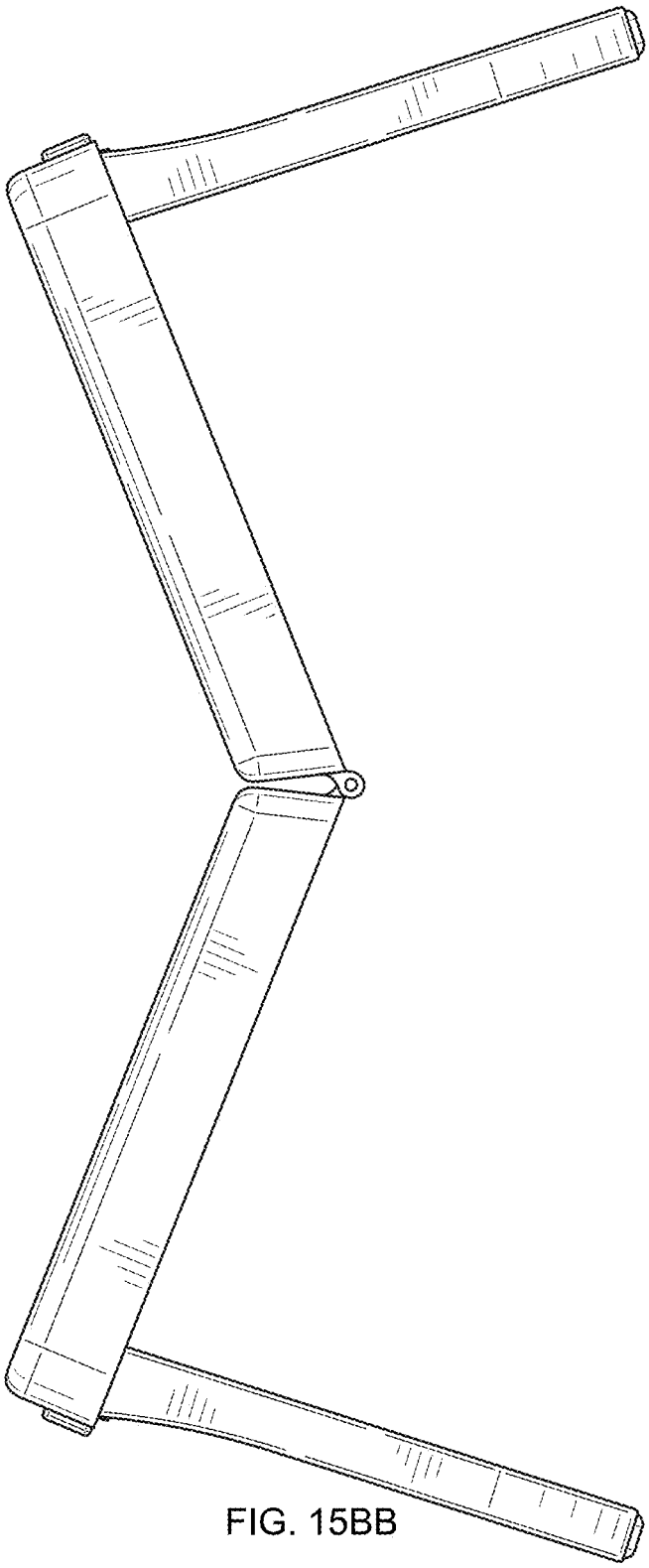
Figure 15C:
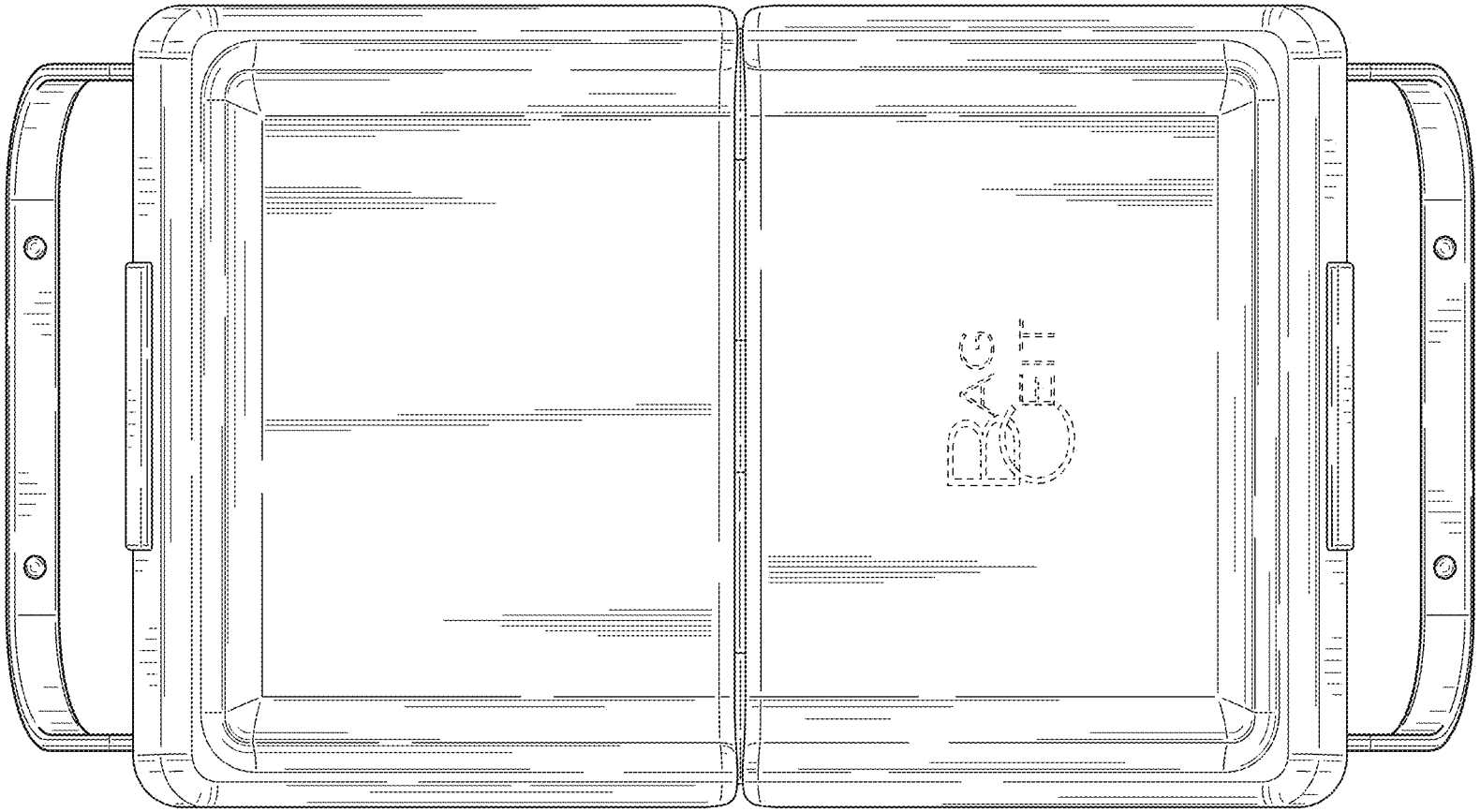
Figure 15D:
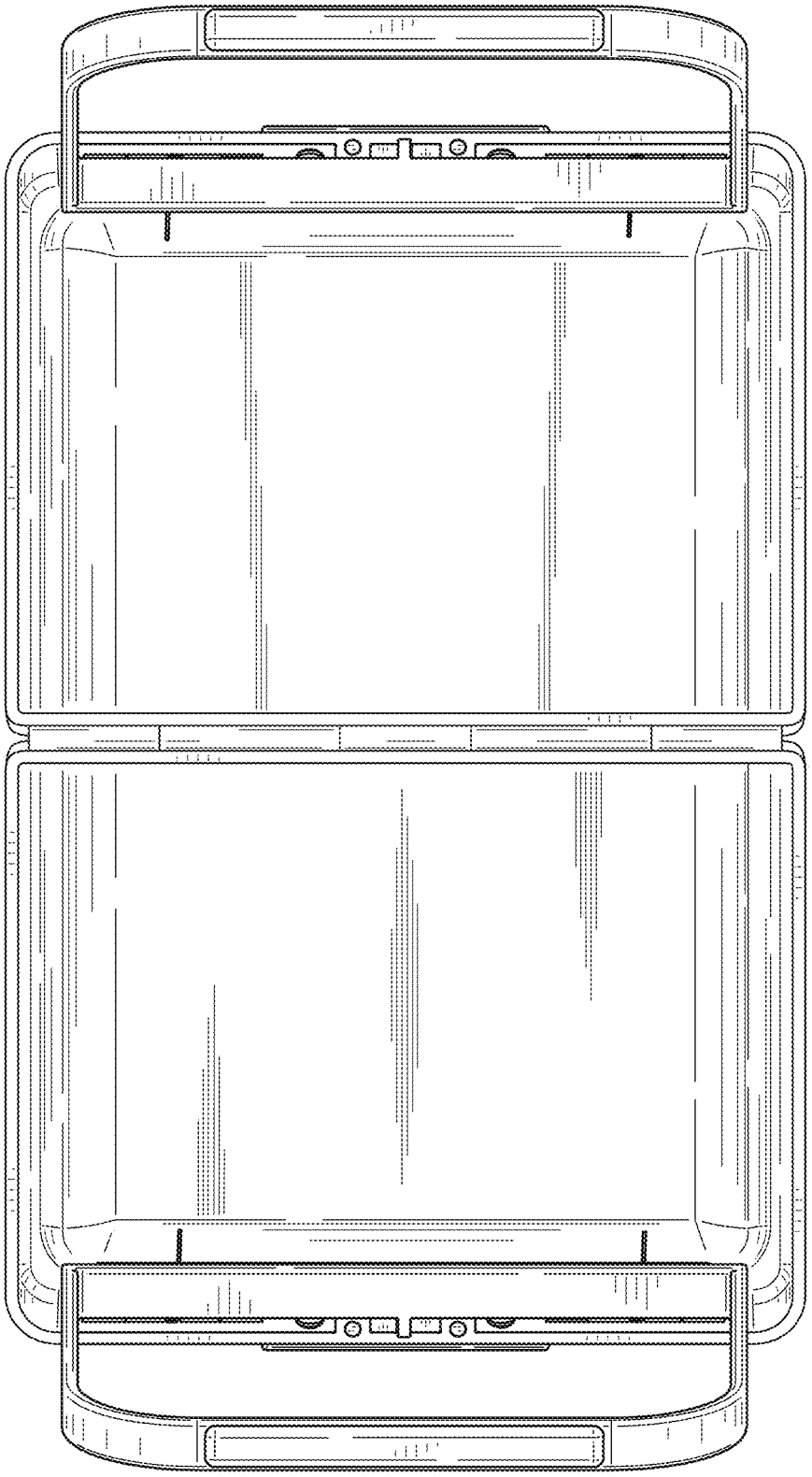
Figure 15E:
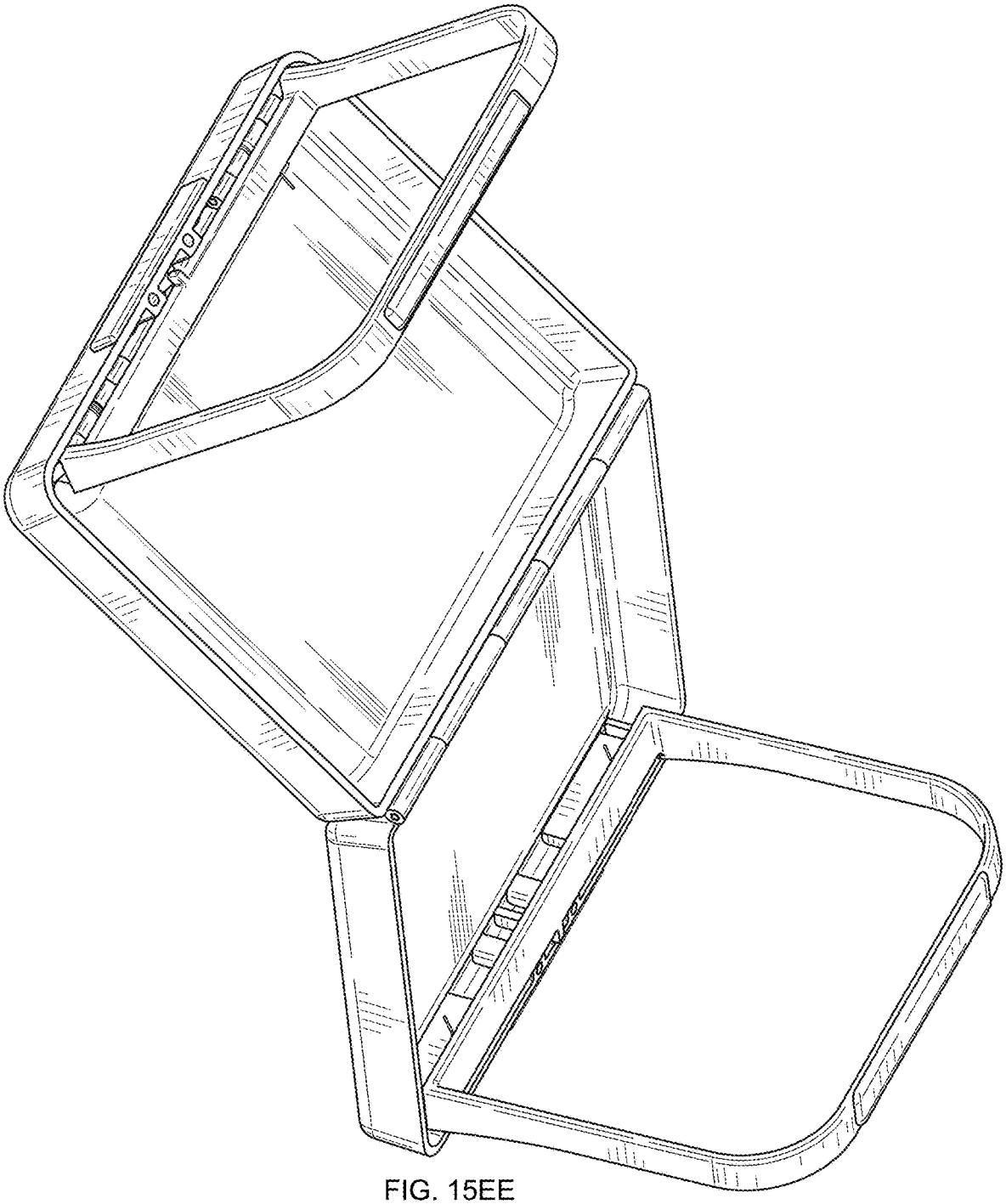
Figure 15F:
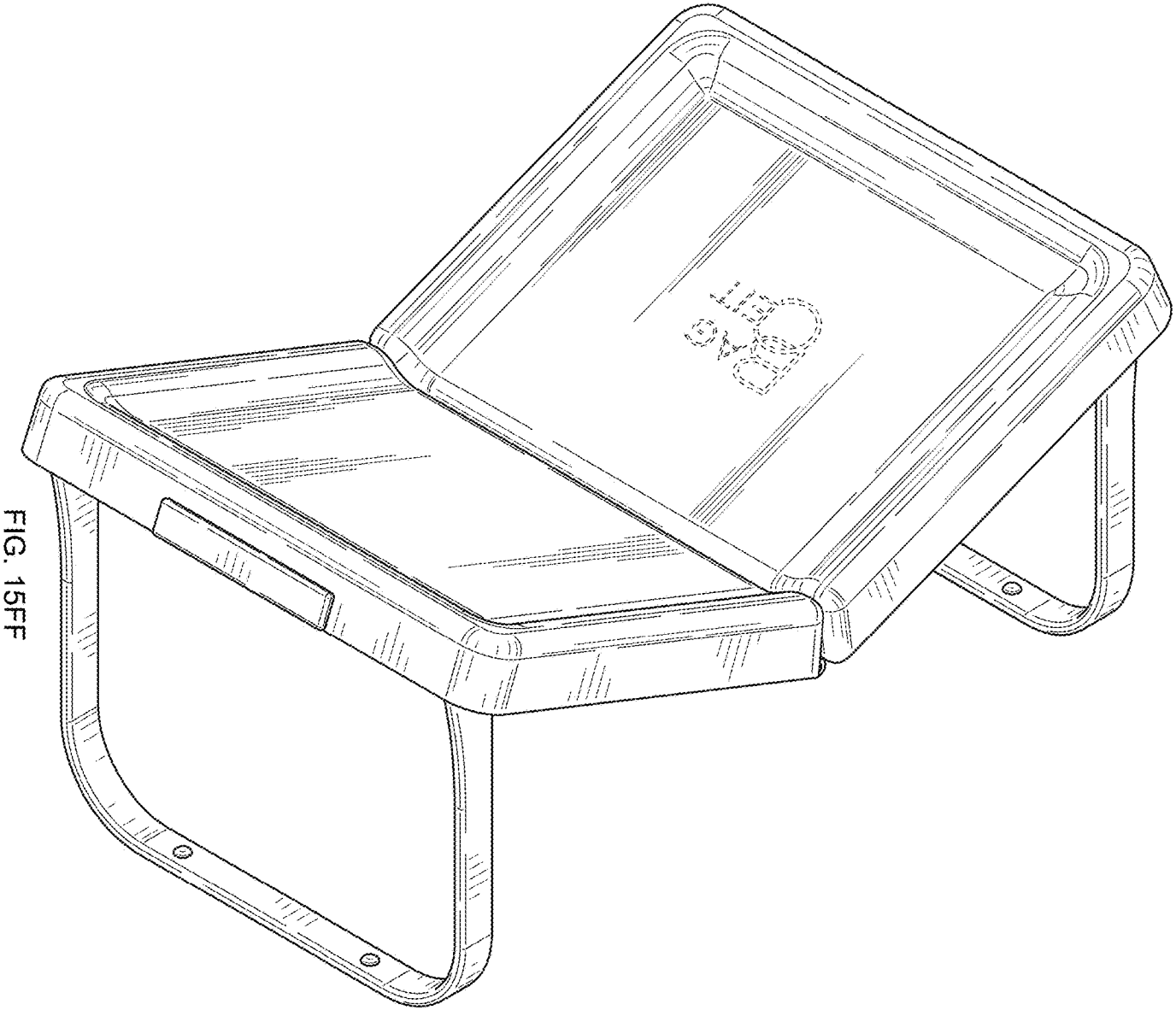
Figure 15G:
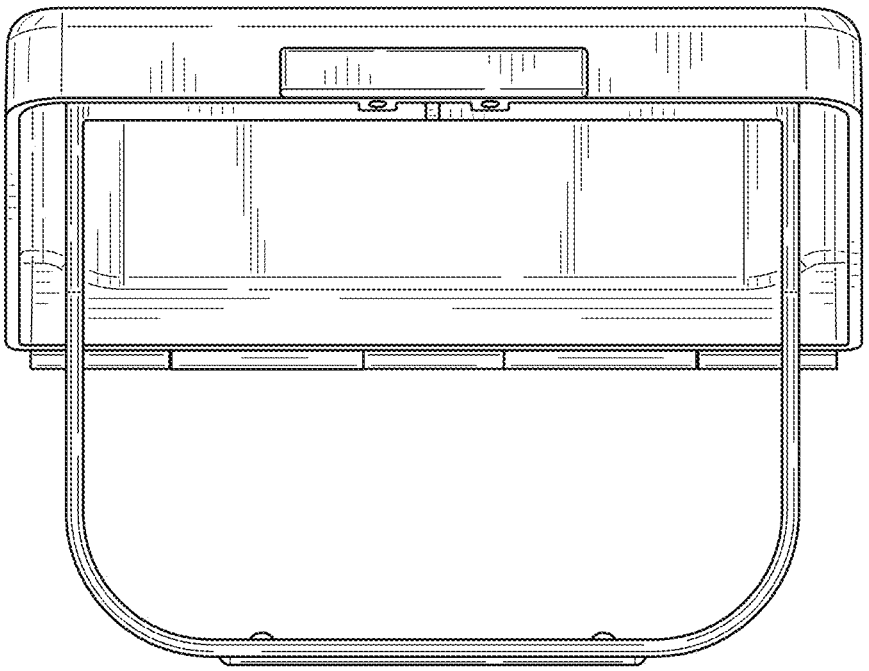
Figure 15H:
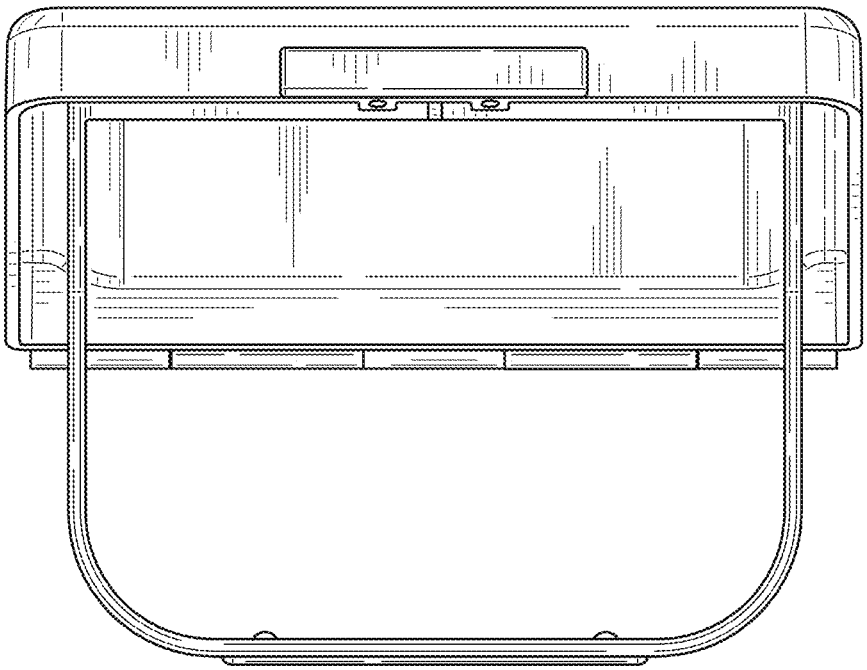
Figure 15I:
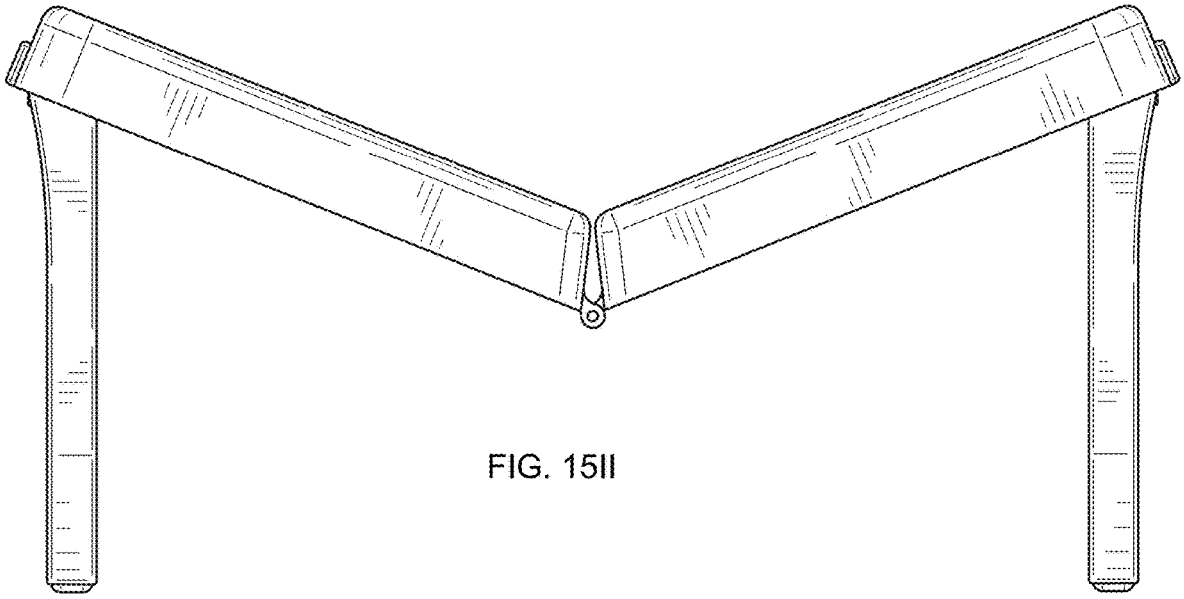
Figure 15J:
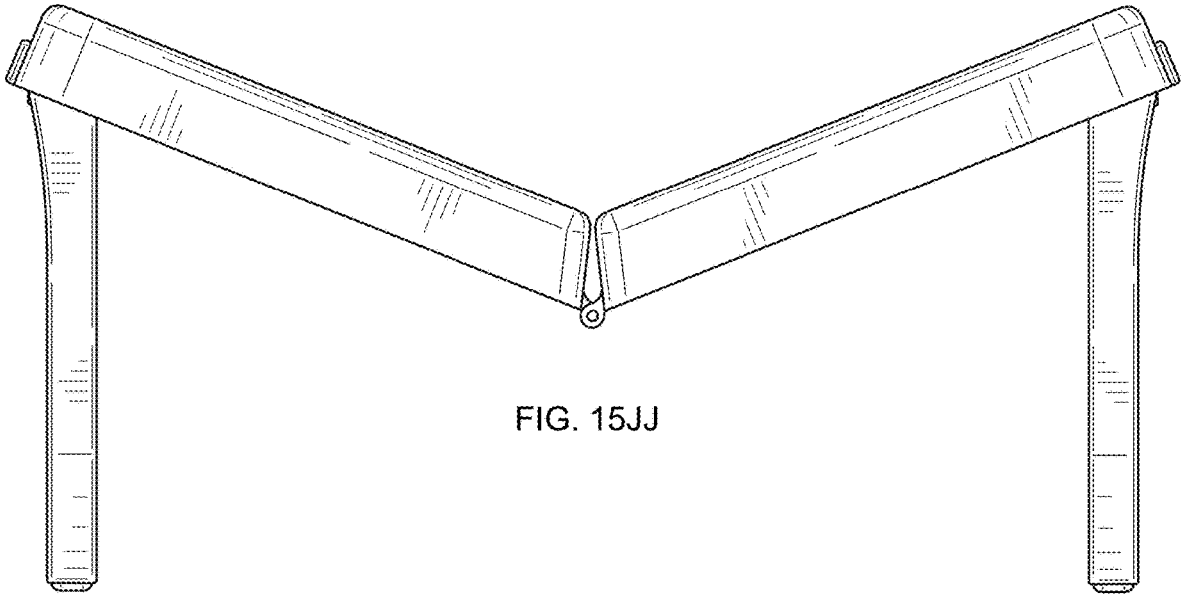
Figure 15K:
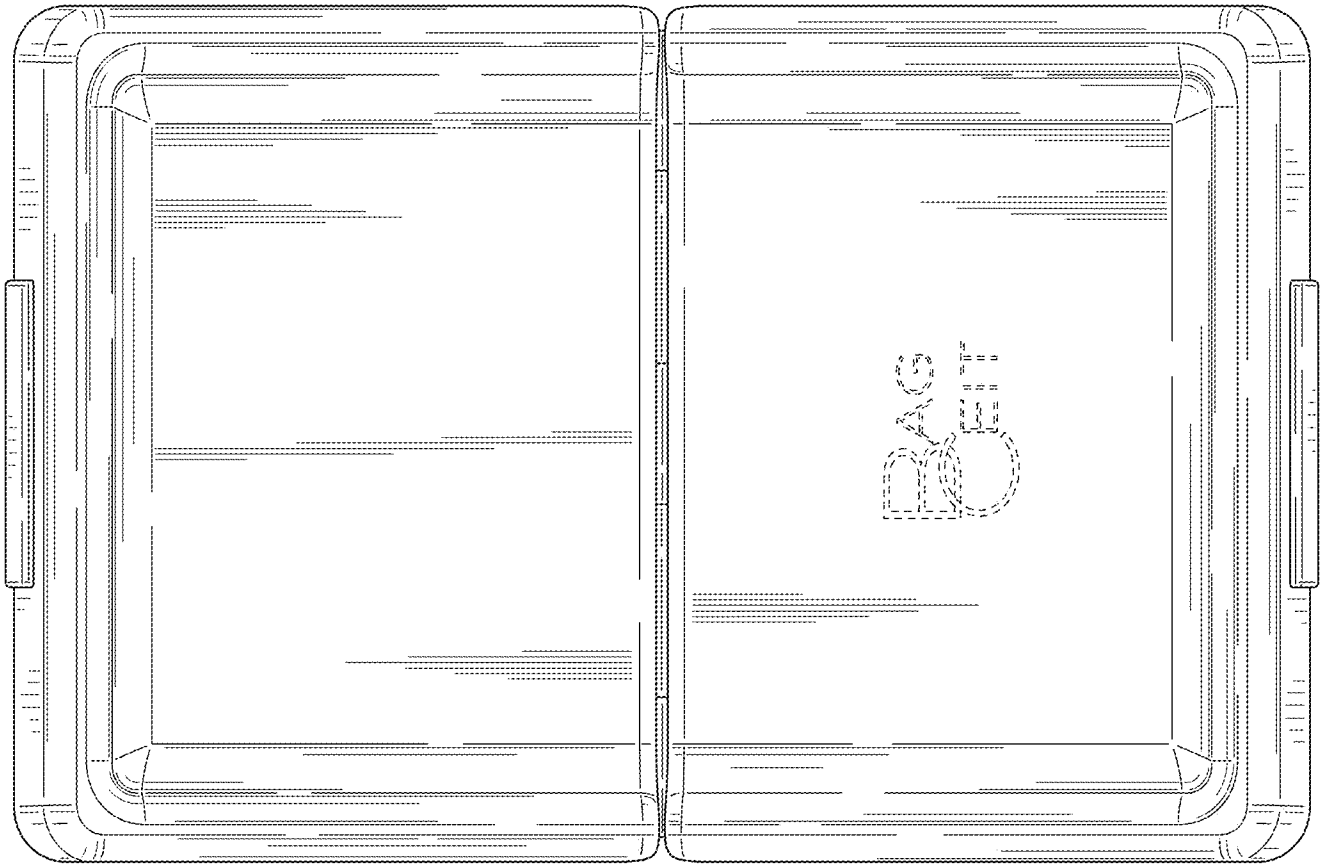
Figure 15L:
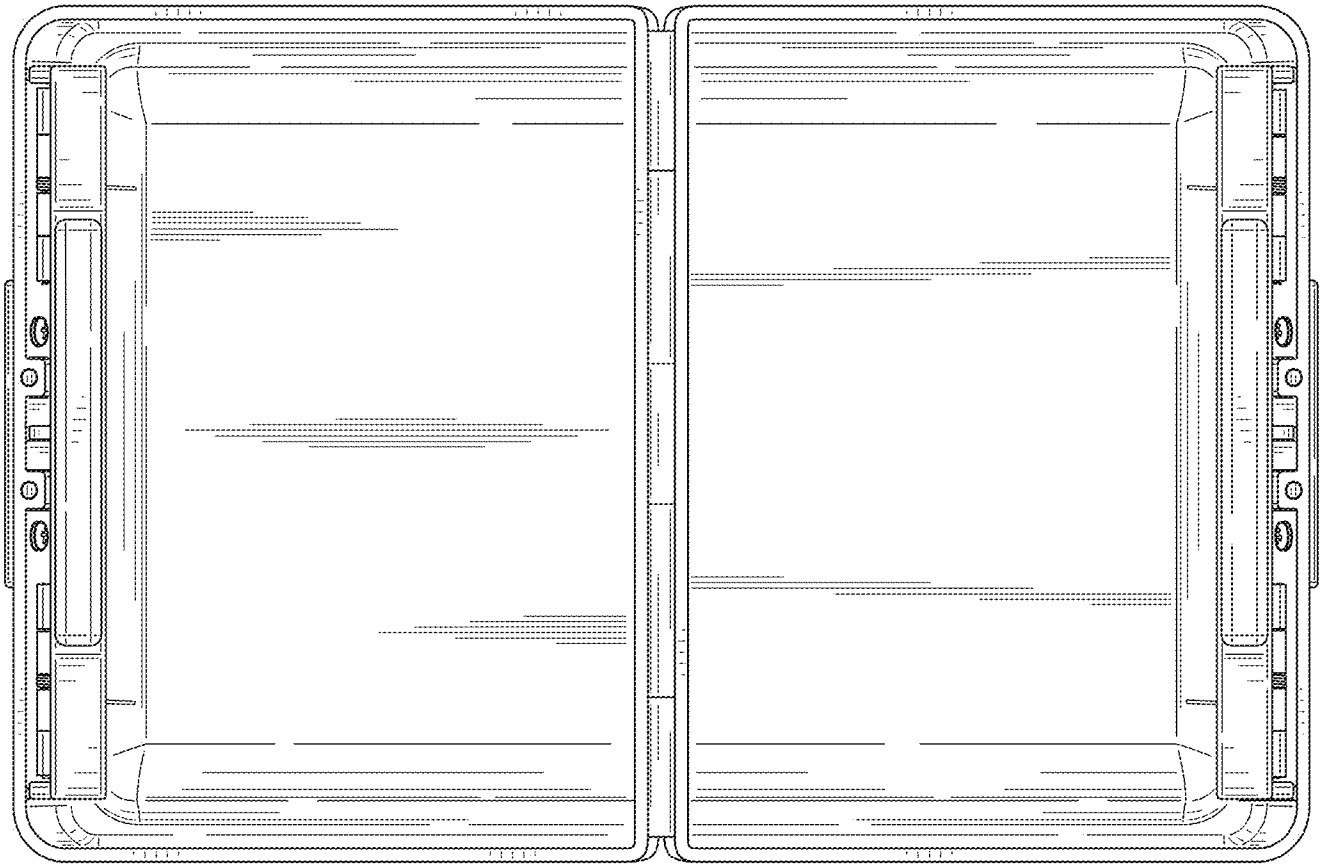
Figure 15M:
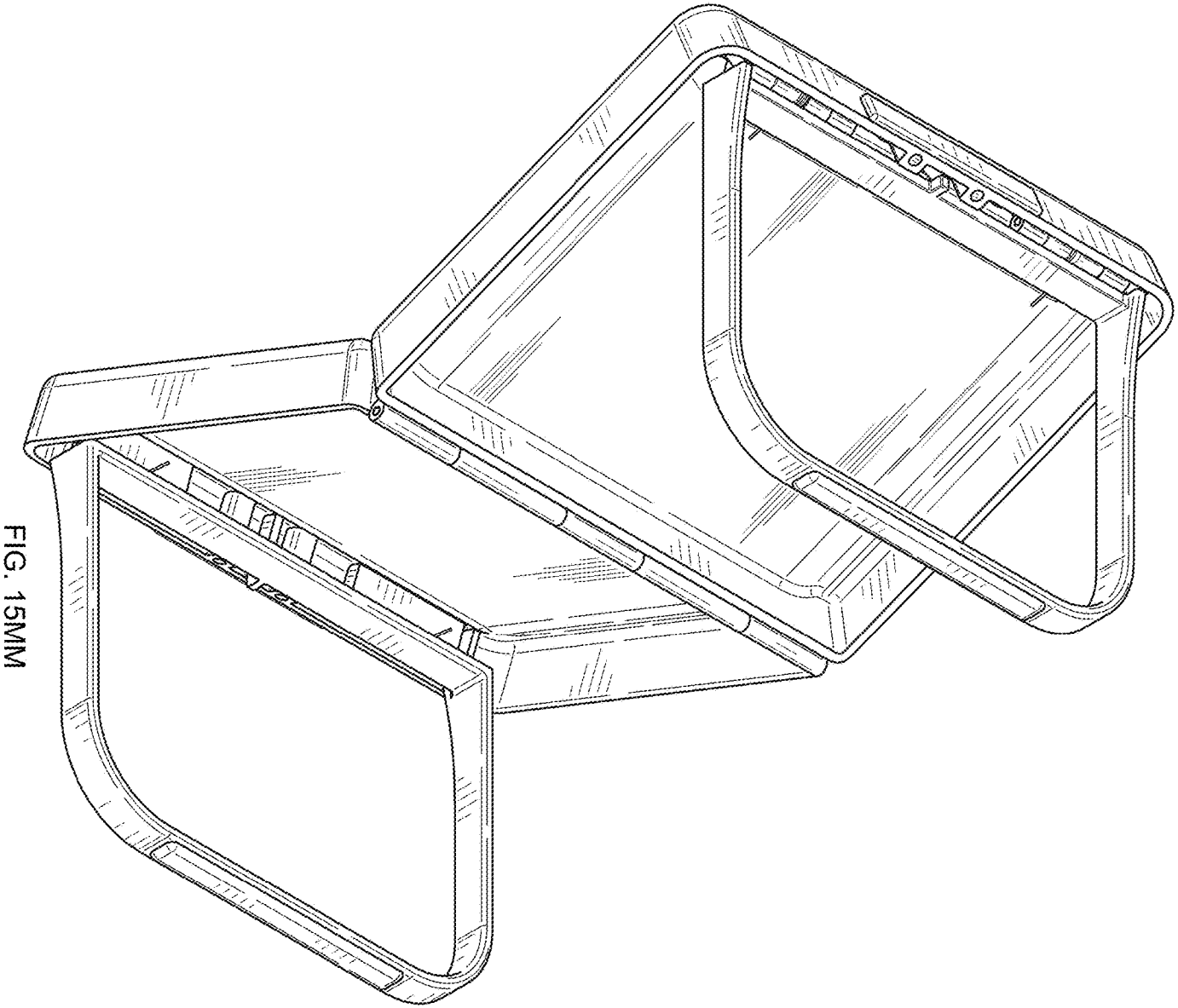
Figure 15N:
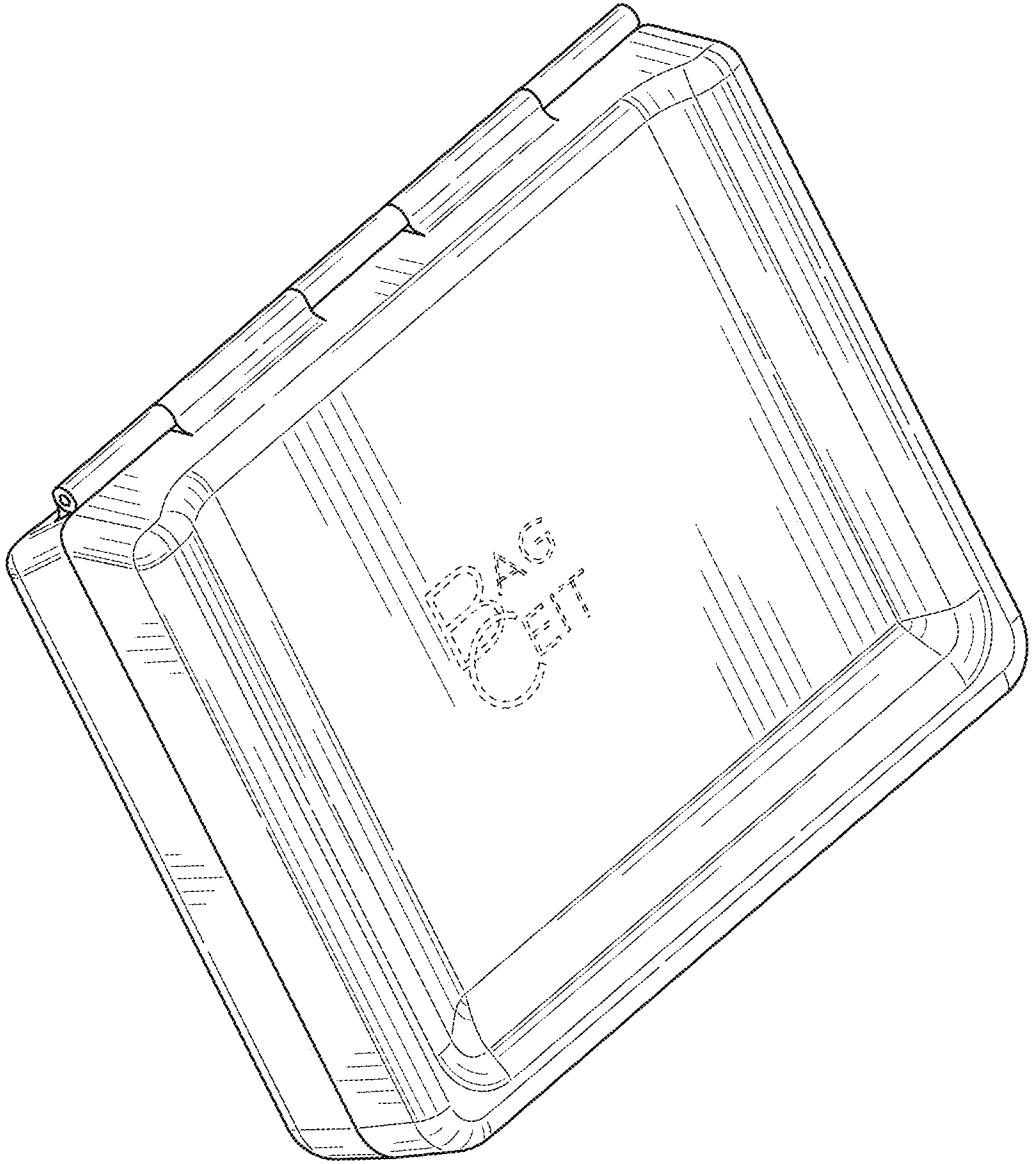
Figure 15O:
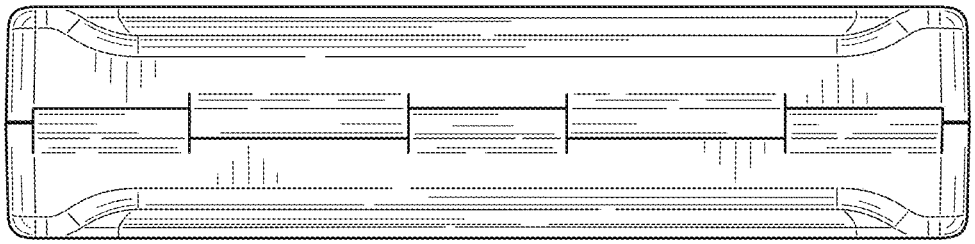
Figure 15P:
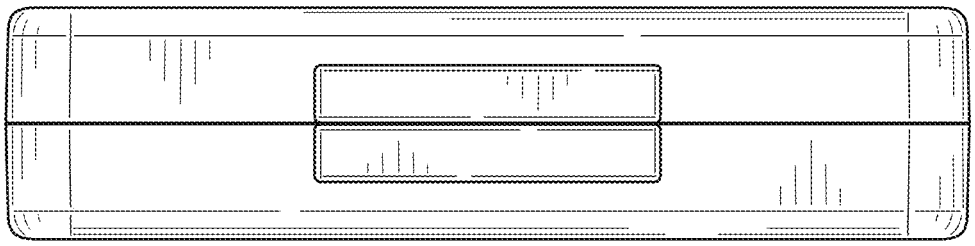
Figure 15Q:
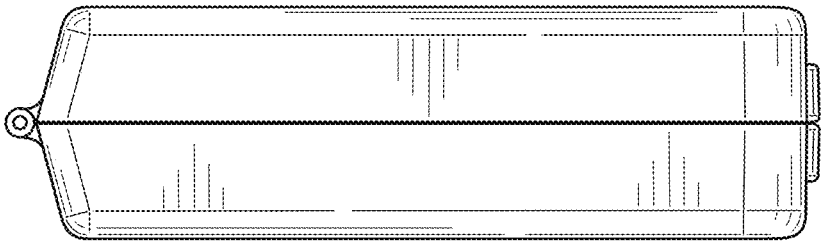
Figure 15R:
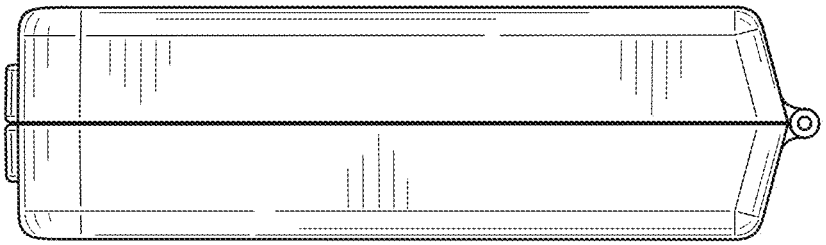
Figure 15S:
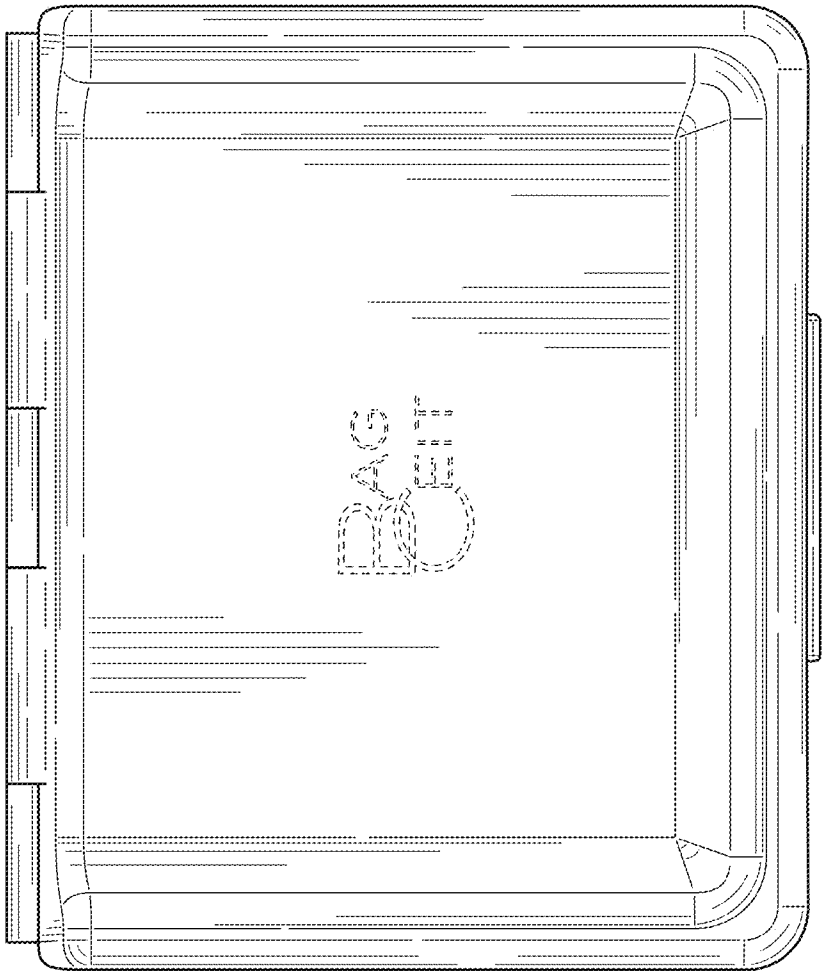
Figure 15T:
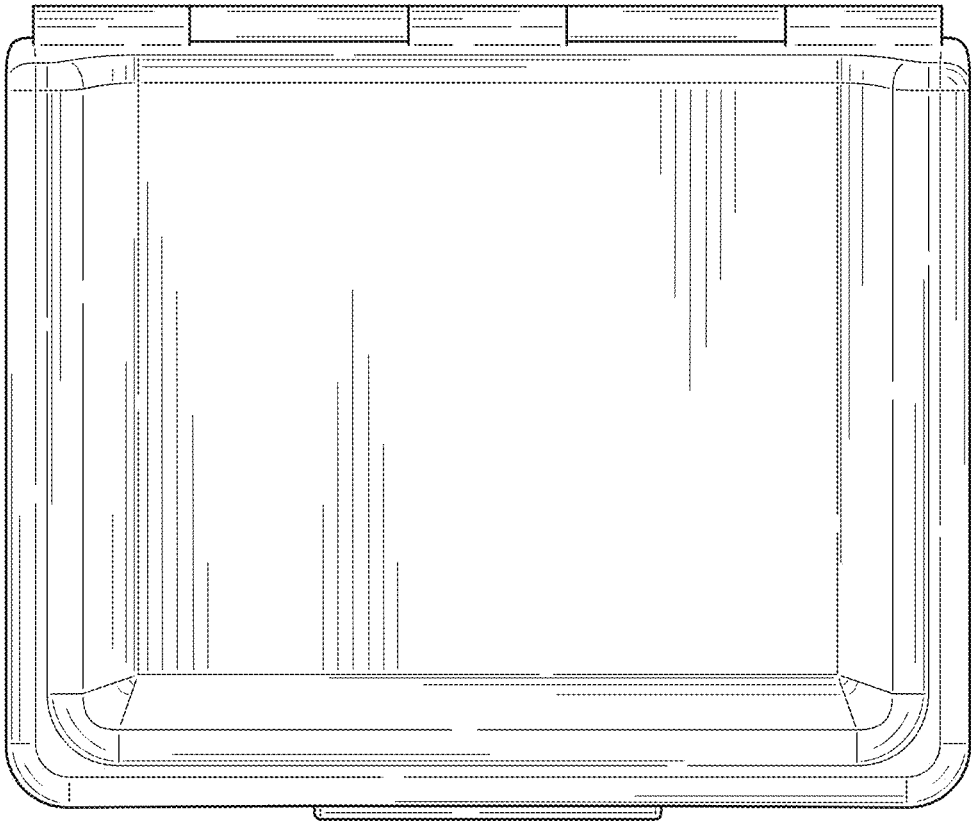
Figure 16A:
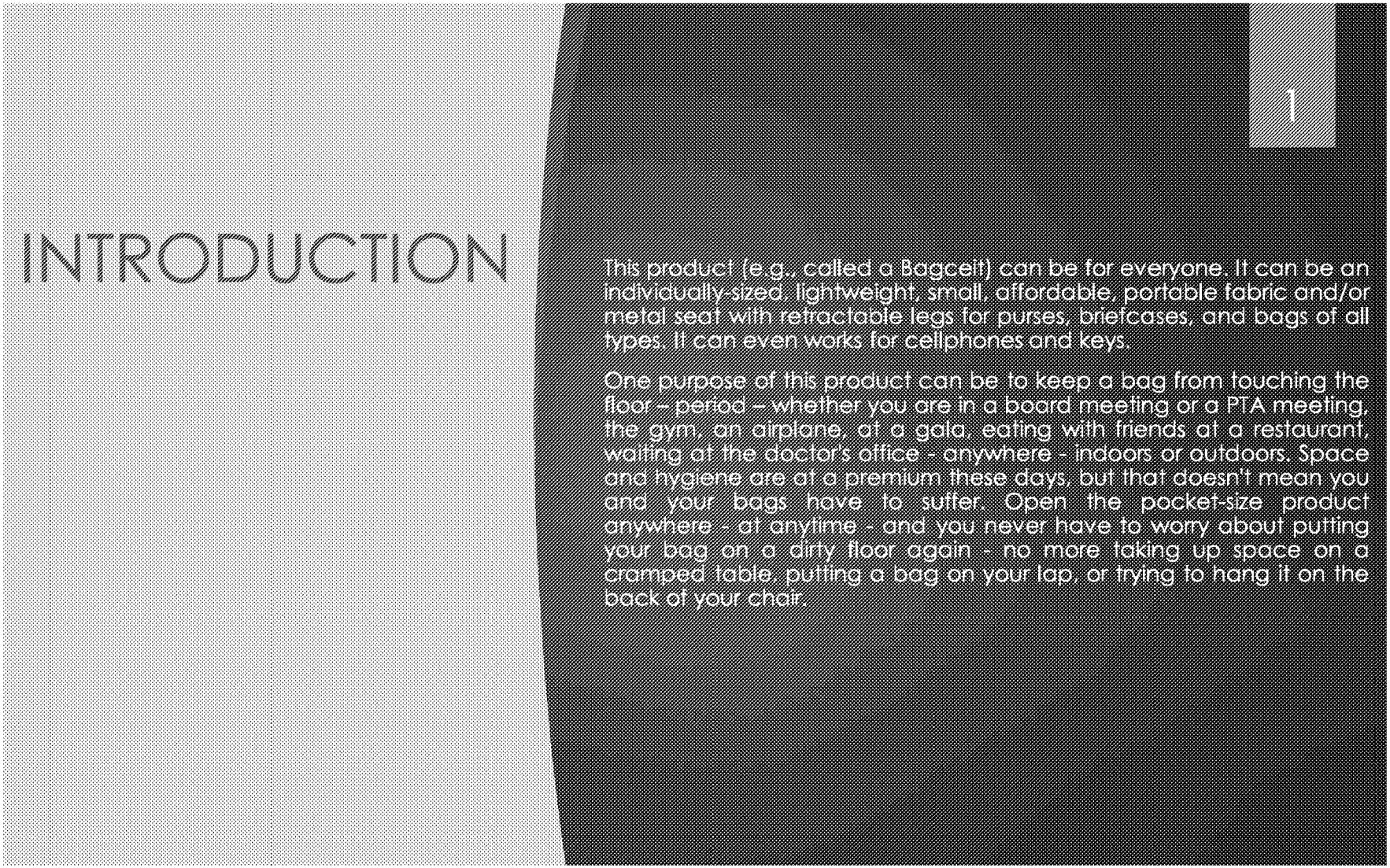
Figure 16C:
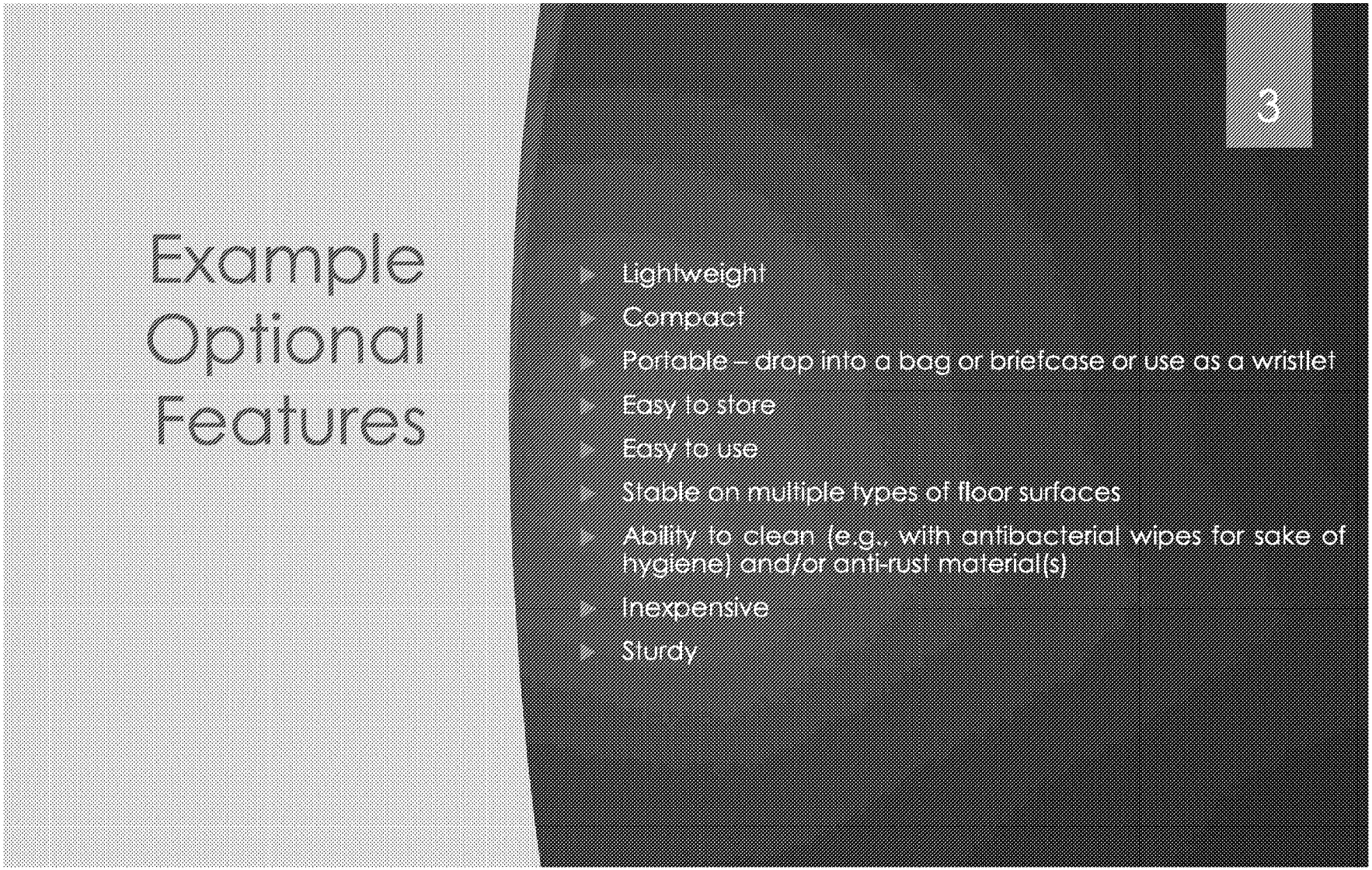
Figure 16D:
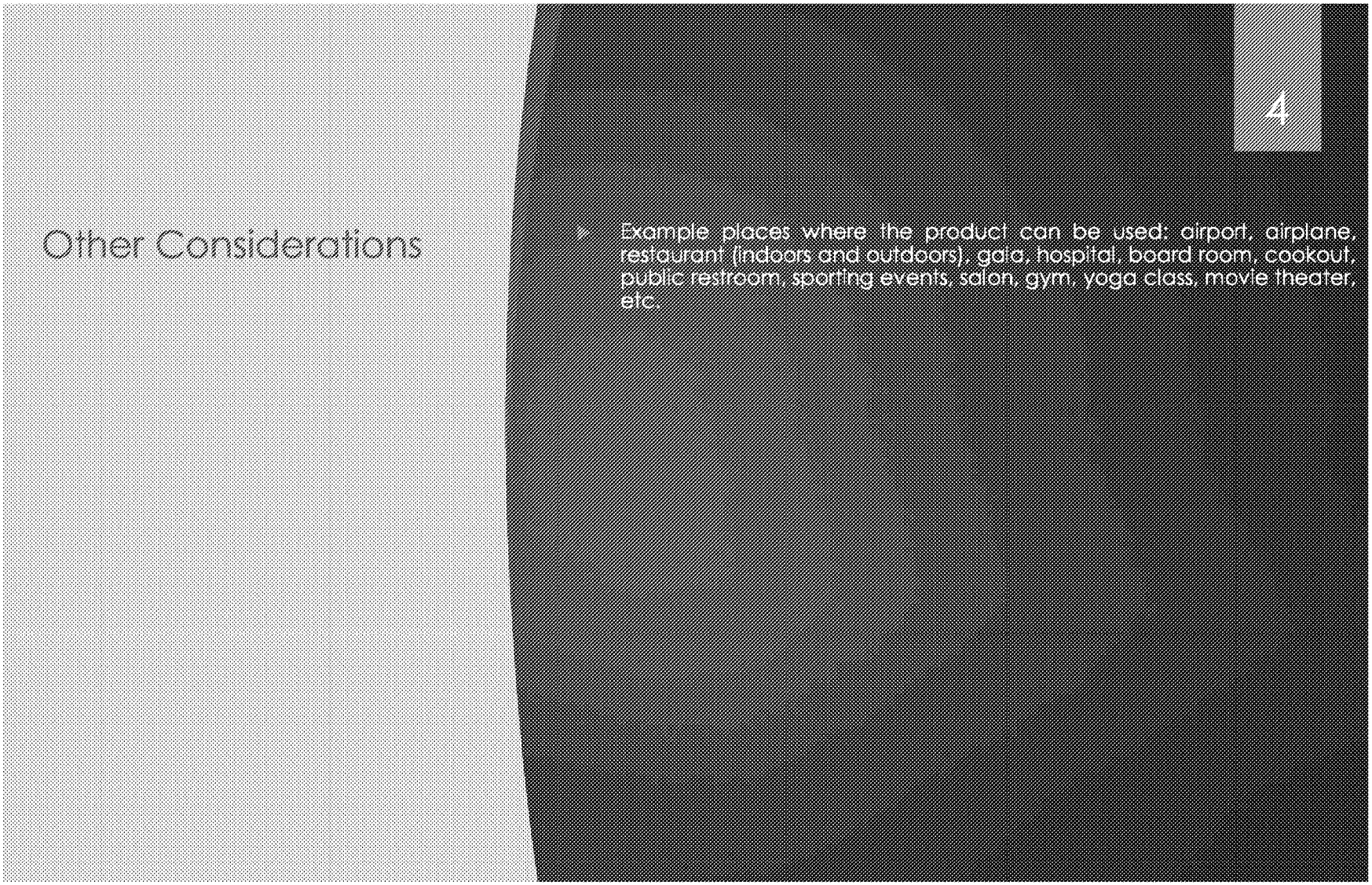
Figure 17:
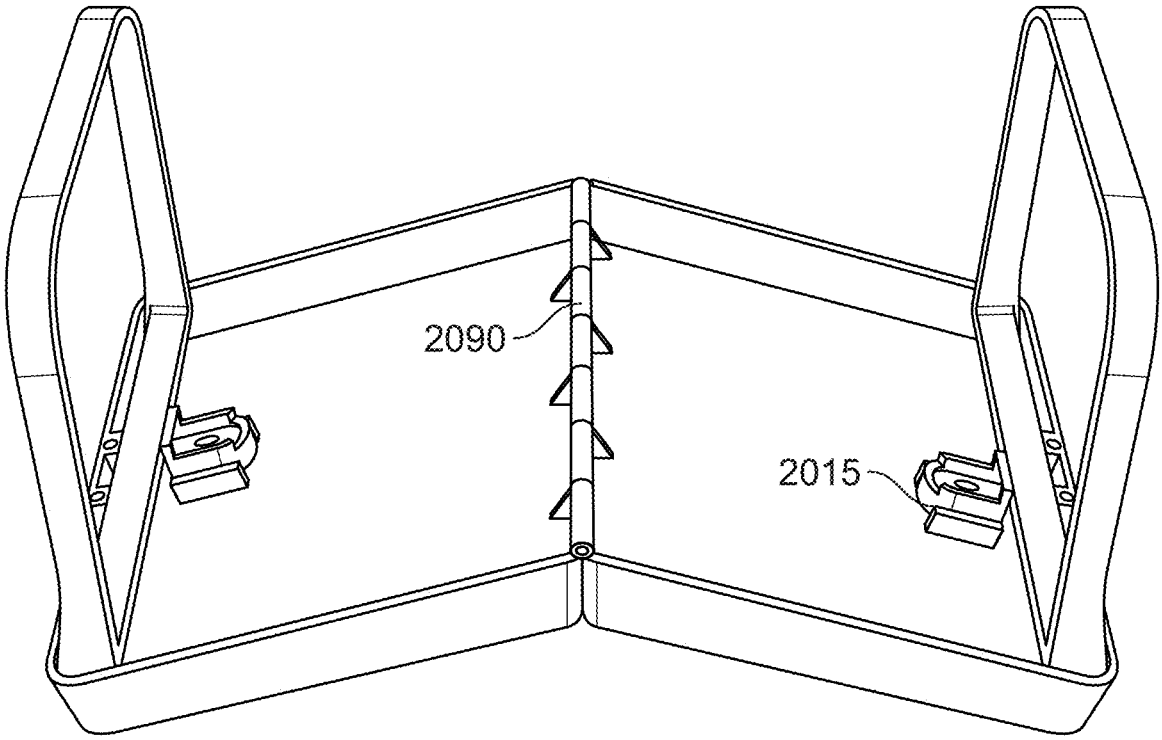
Figure 17:
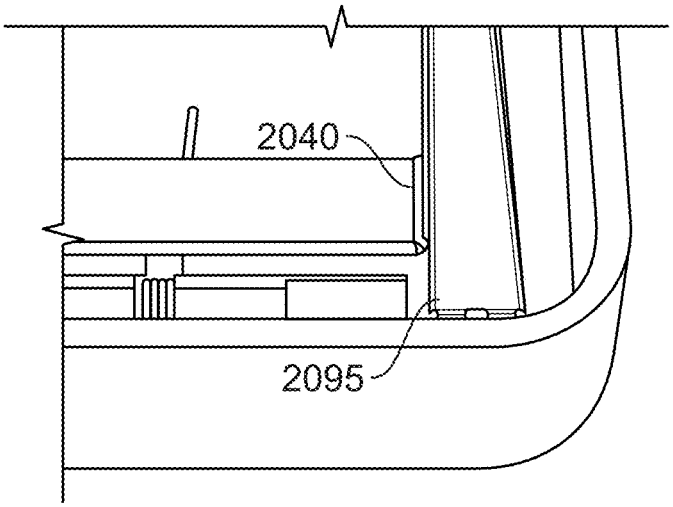

FIGS. 15A-15TT illustrate various views of various aspects/embodiments of the disclosure. FIGS. 15A-15H illustrate various views of an embodiment where the V-shape of the stand is shown in solid lines. FIGS. 15I-15P illustrate various views of an embodiment where the V shape of the stand and the legs are shown in solid lines. FIGS. 15Q-15W illustrate various views of an embodiment where the V shape of the stand and the surface of the enclosure shells are shown in solid lines. FIGS. 15X-15EE illustrate various views of an embodiment where the V shape of the stand and the legs (in an obtuse angle) are emphasized in solid lines. FIGS. 15FF-15TT illustrate various views of an embodiment where the full product details are shown in solid lines.

Figure 19A:
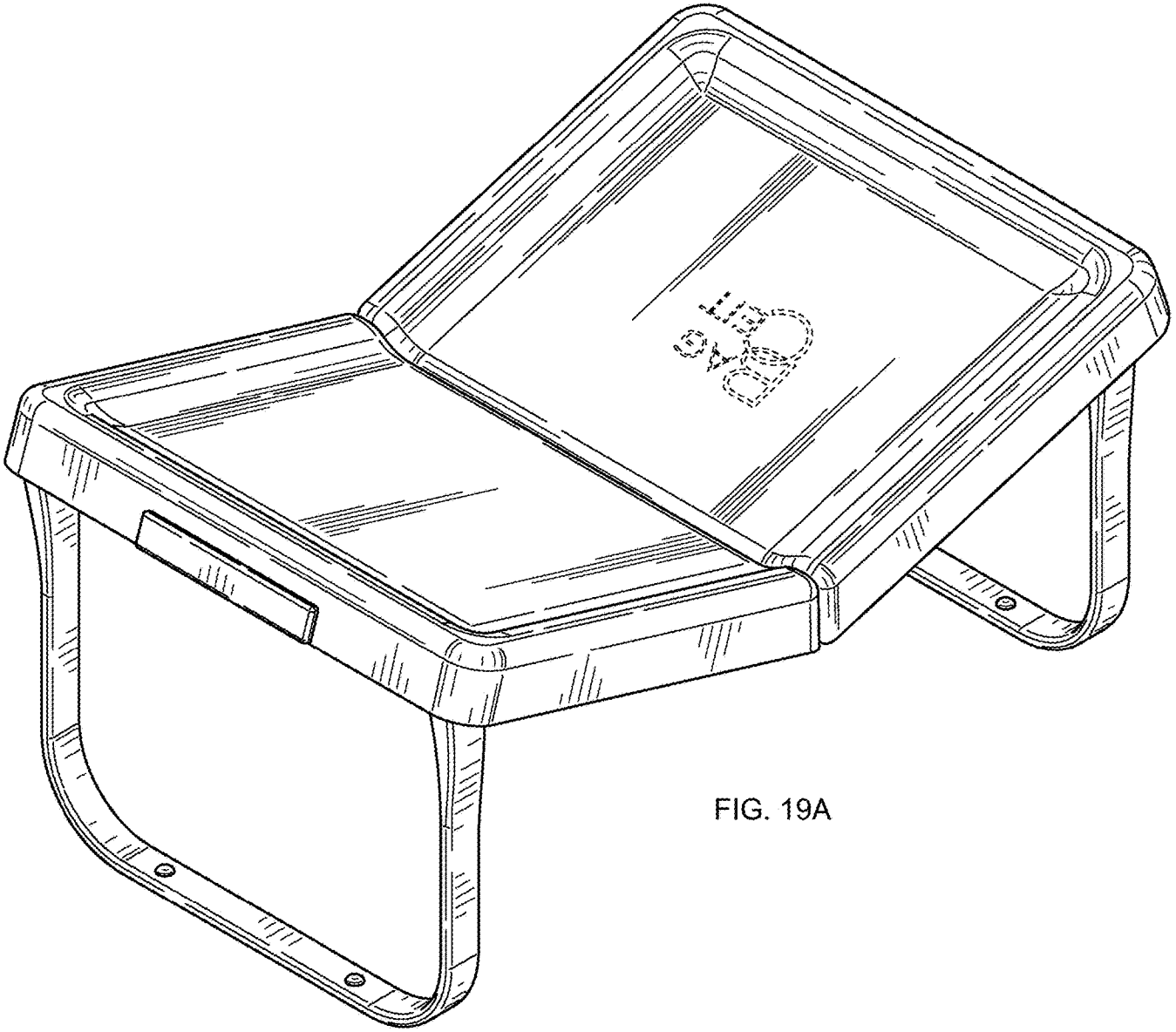
Figure 19B:
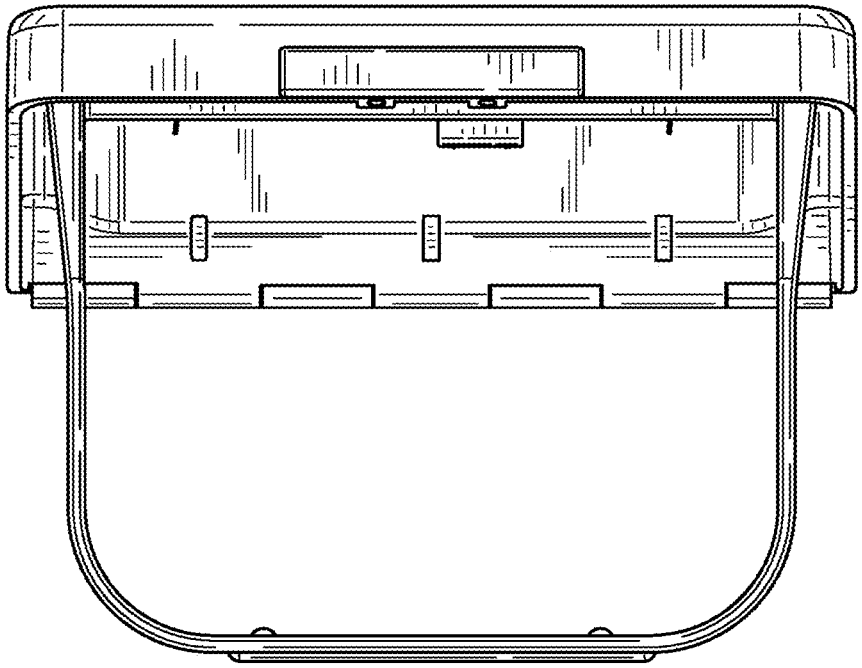
Figure 19C:
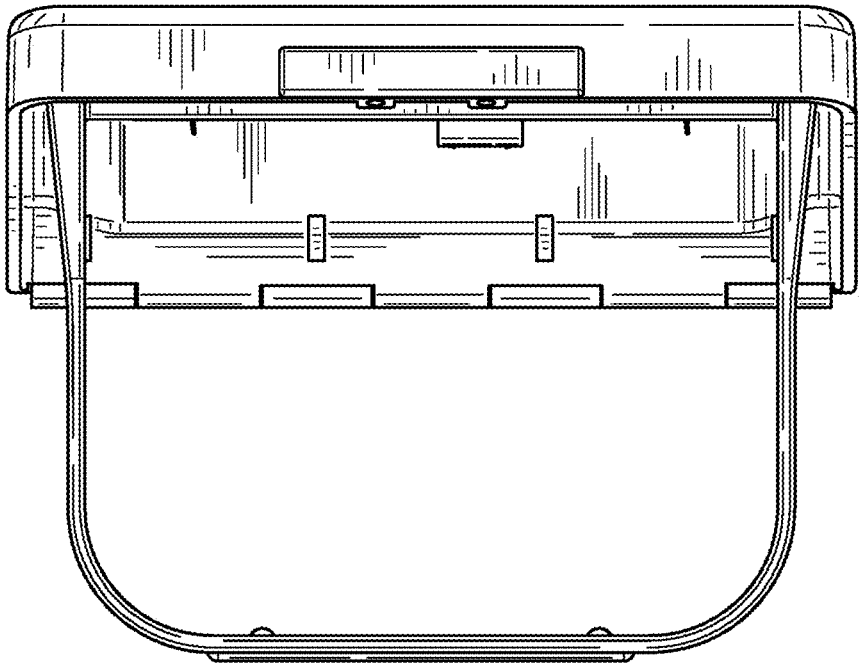
Figure 19D:
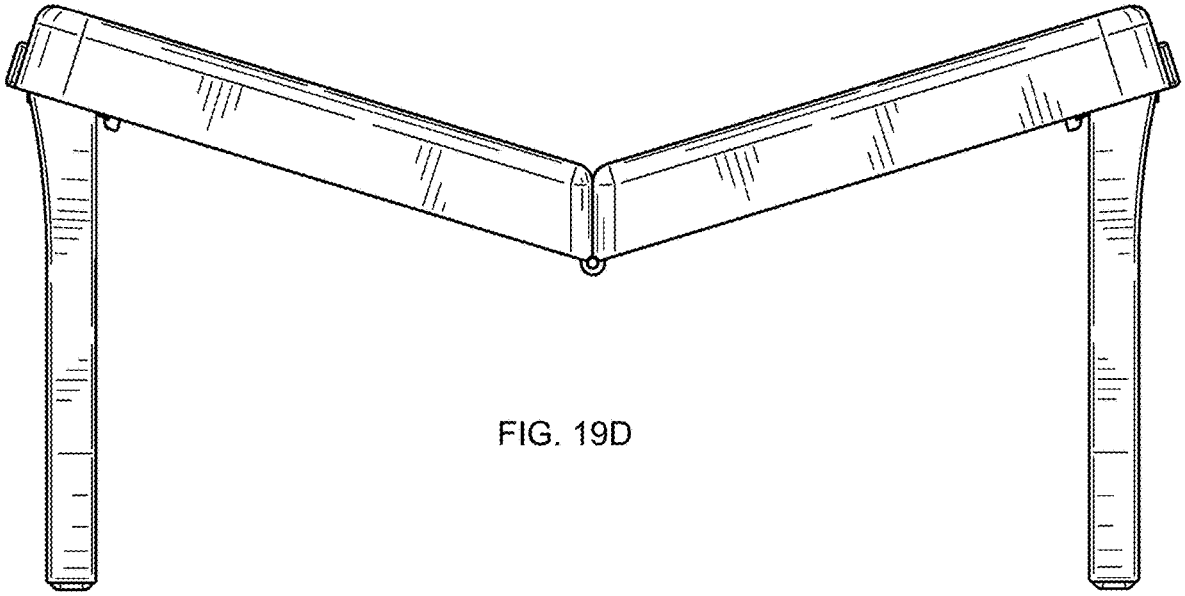
Figure 19E:
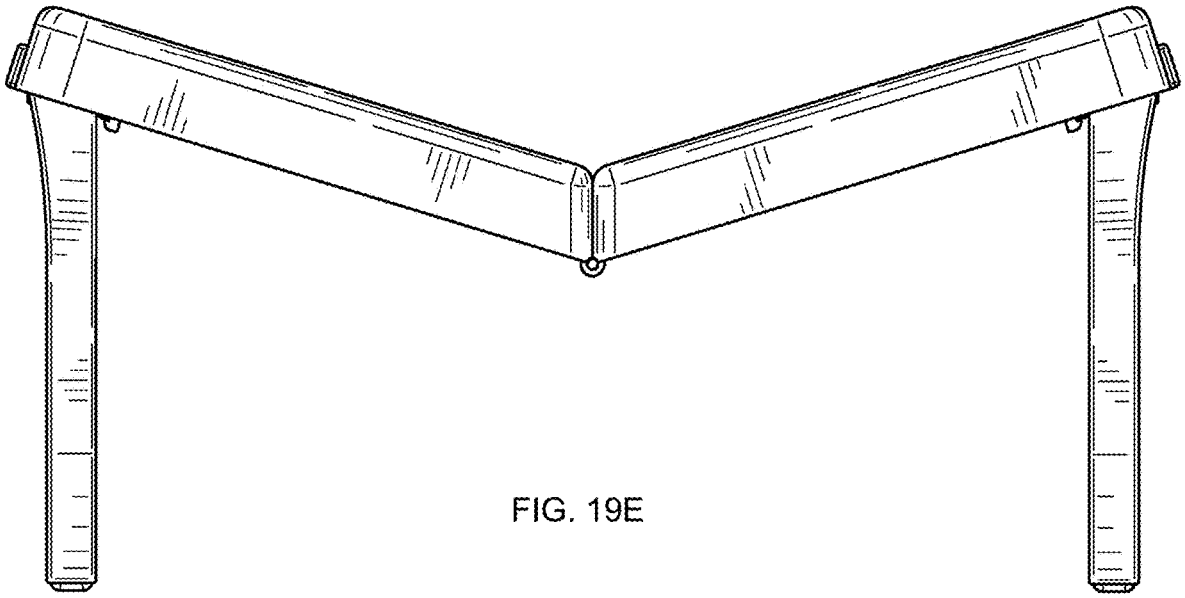
Figure 19F:
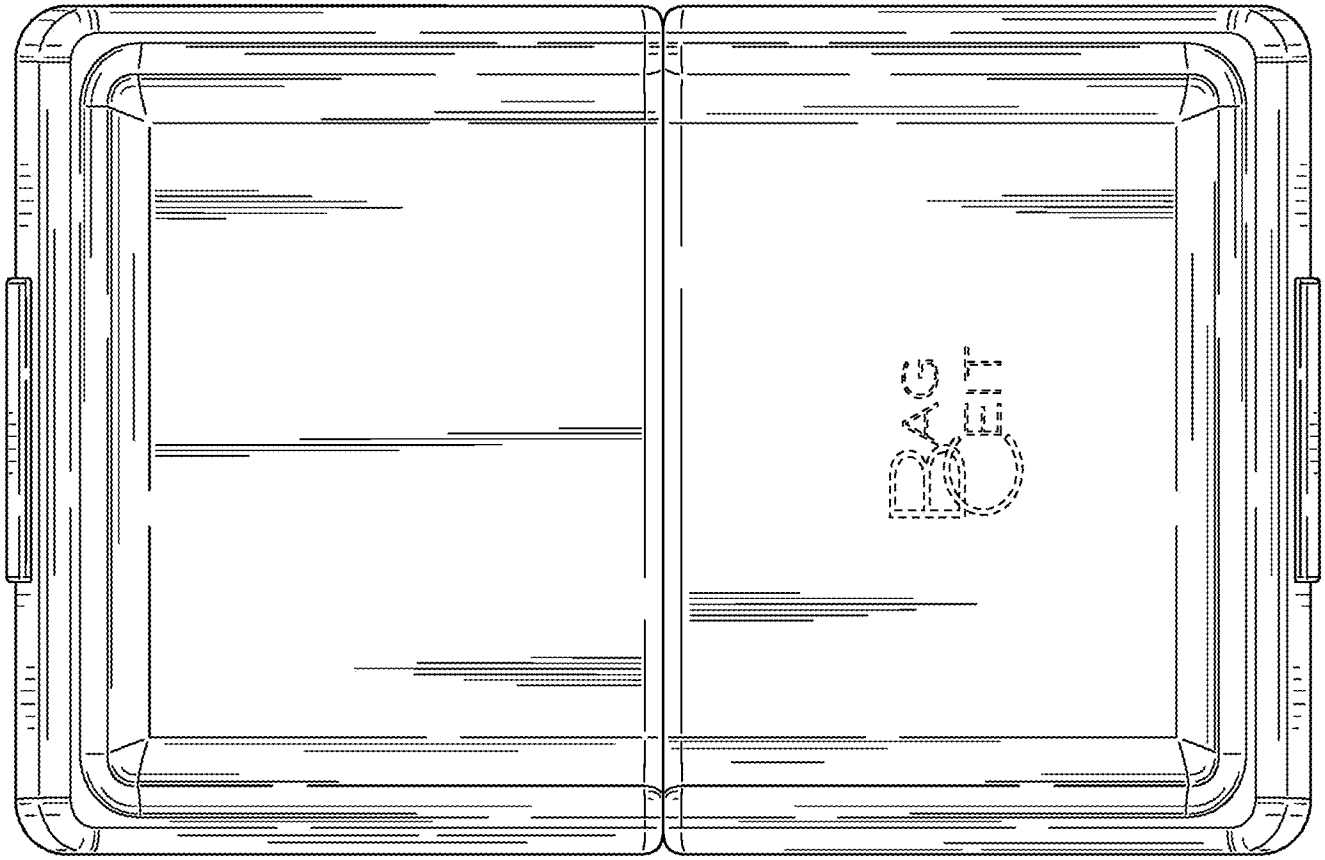
Figure 19G:
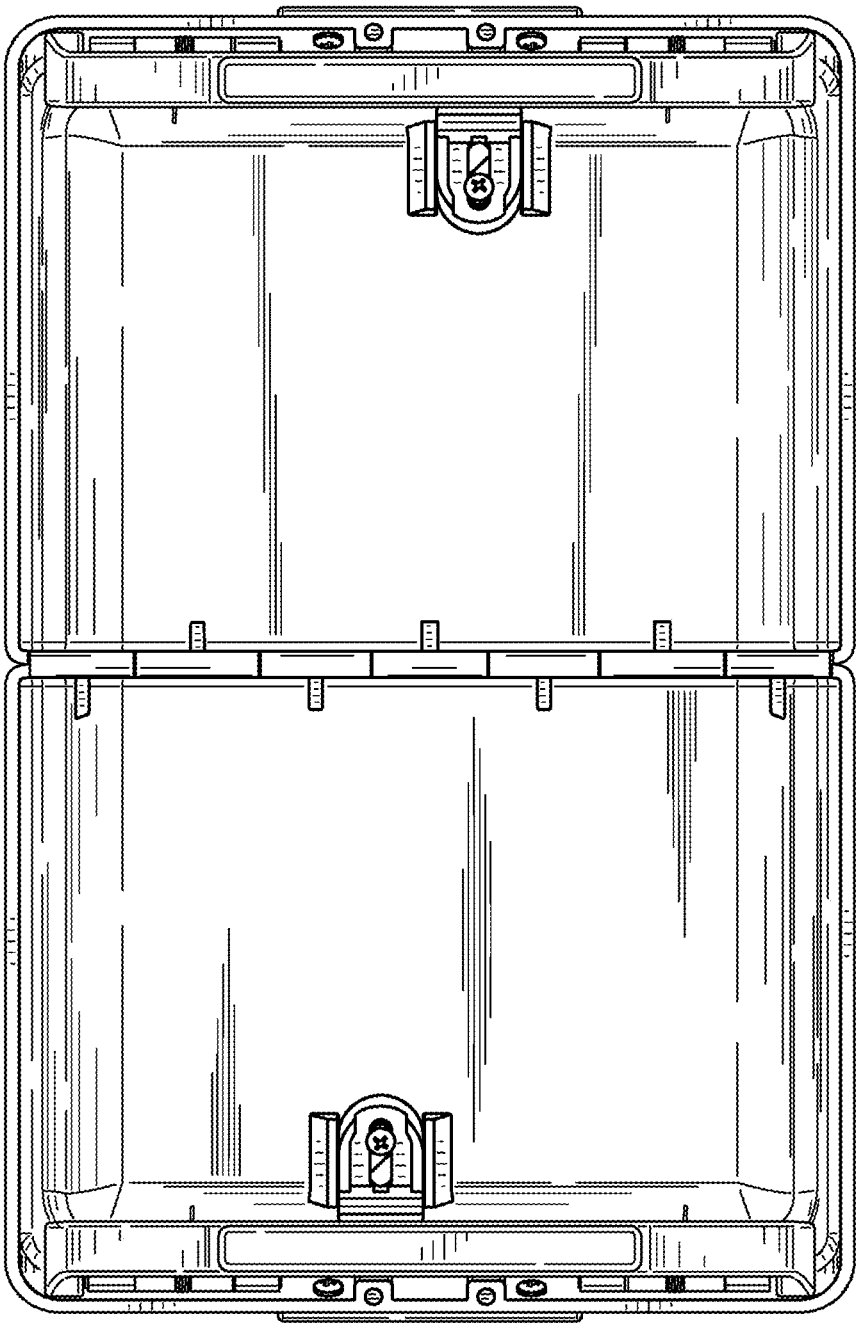
Figure 19H:
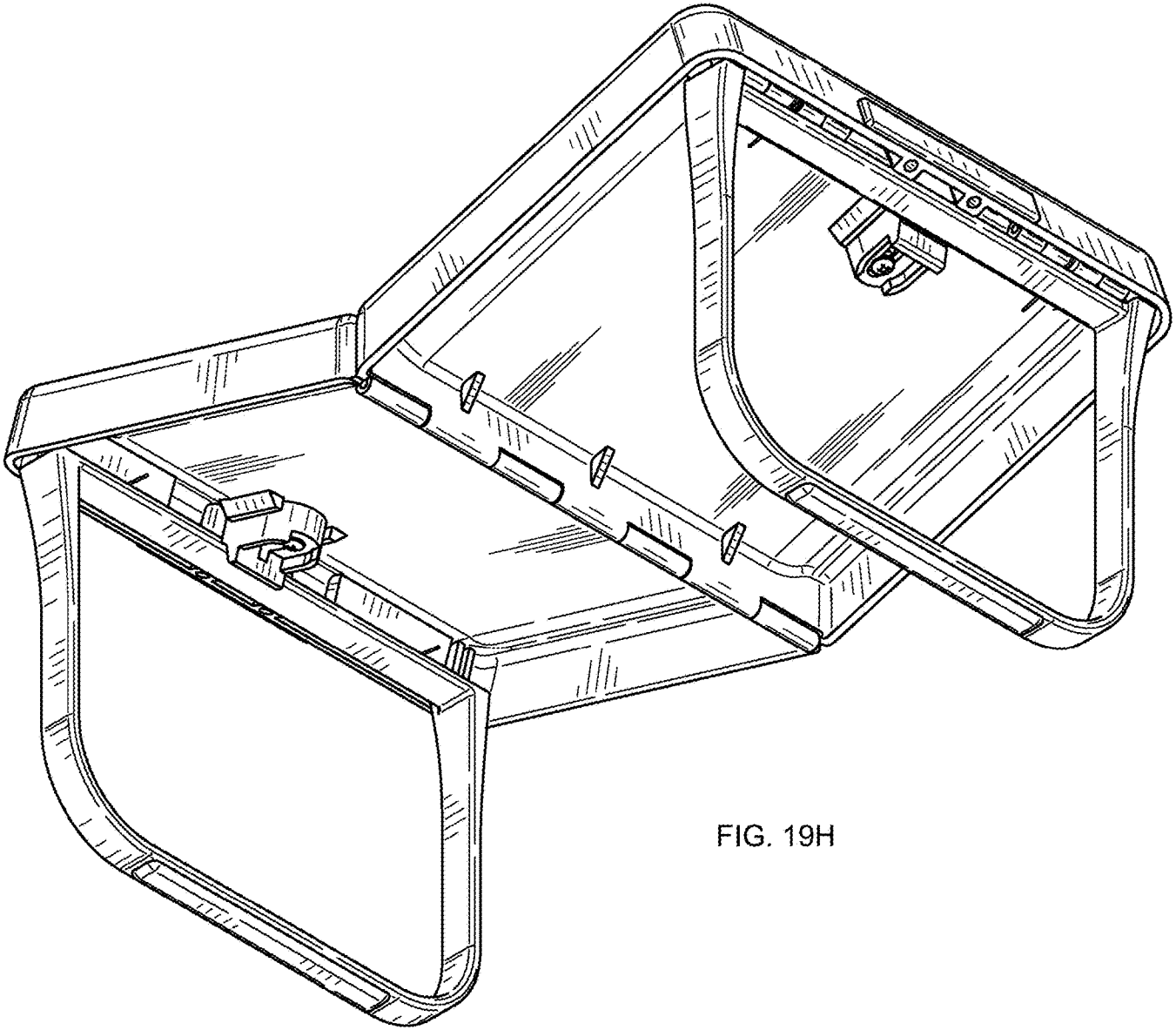
Figure 20A:
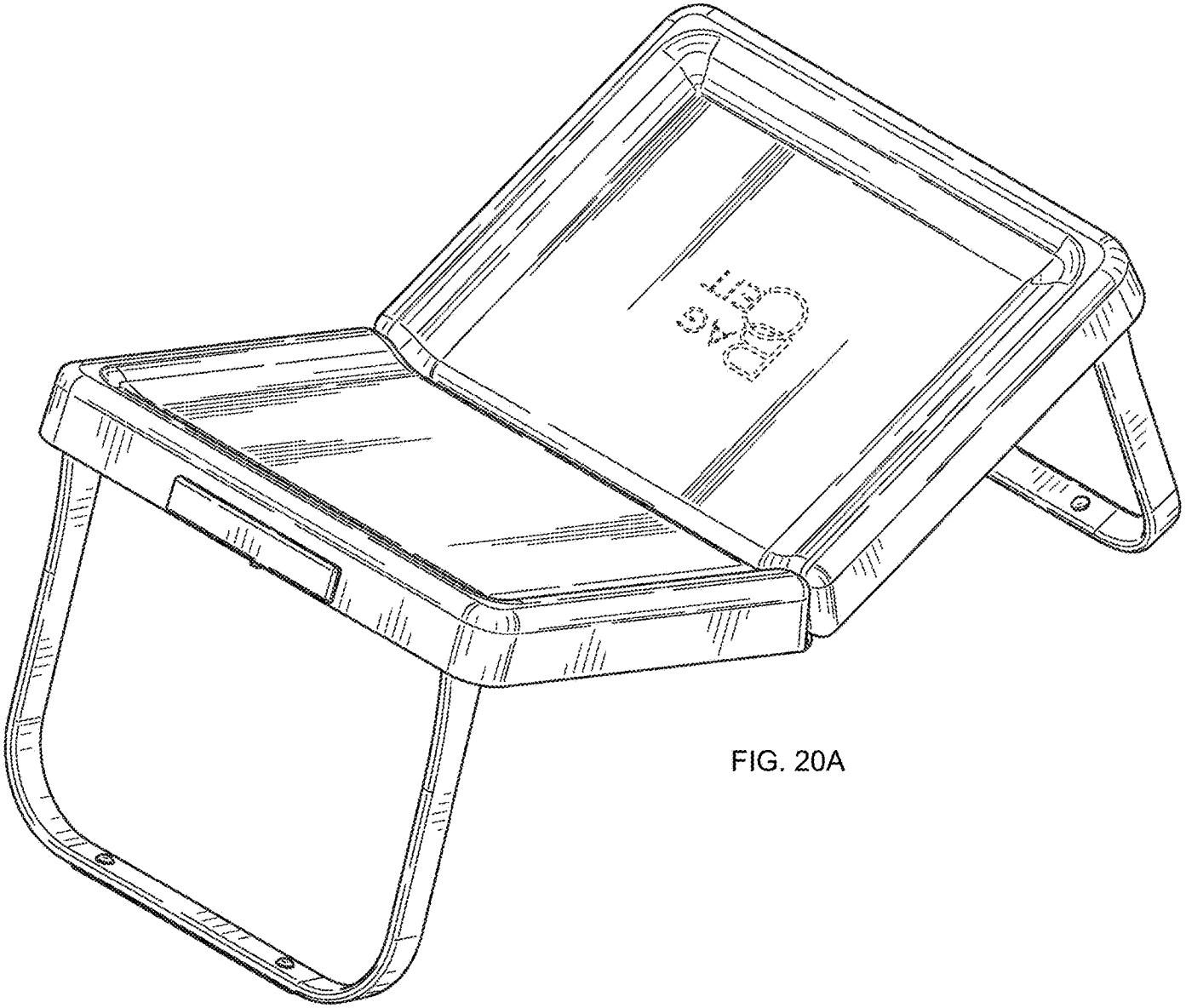
Figure 20B:
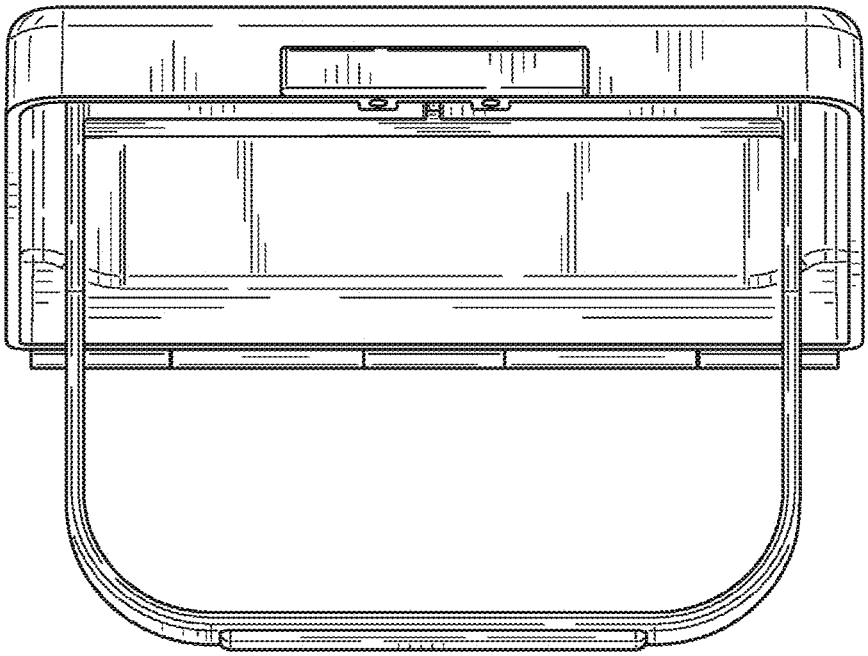
Figure 20C:
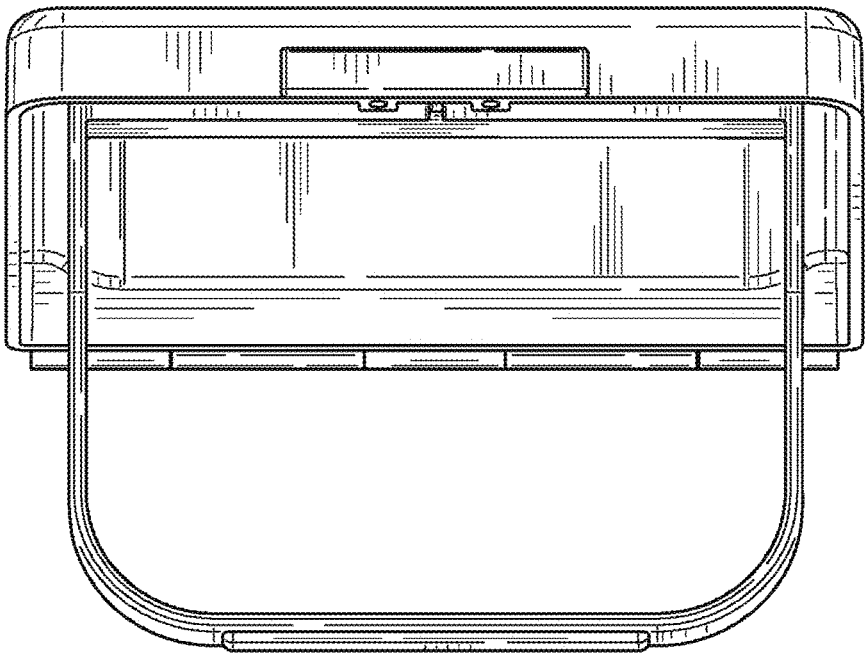
Figure 20D:
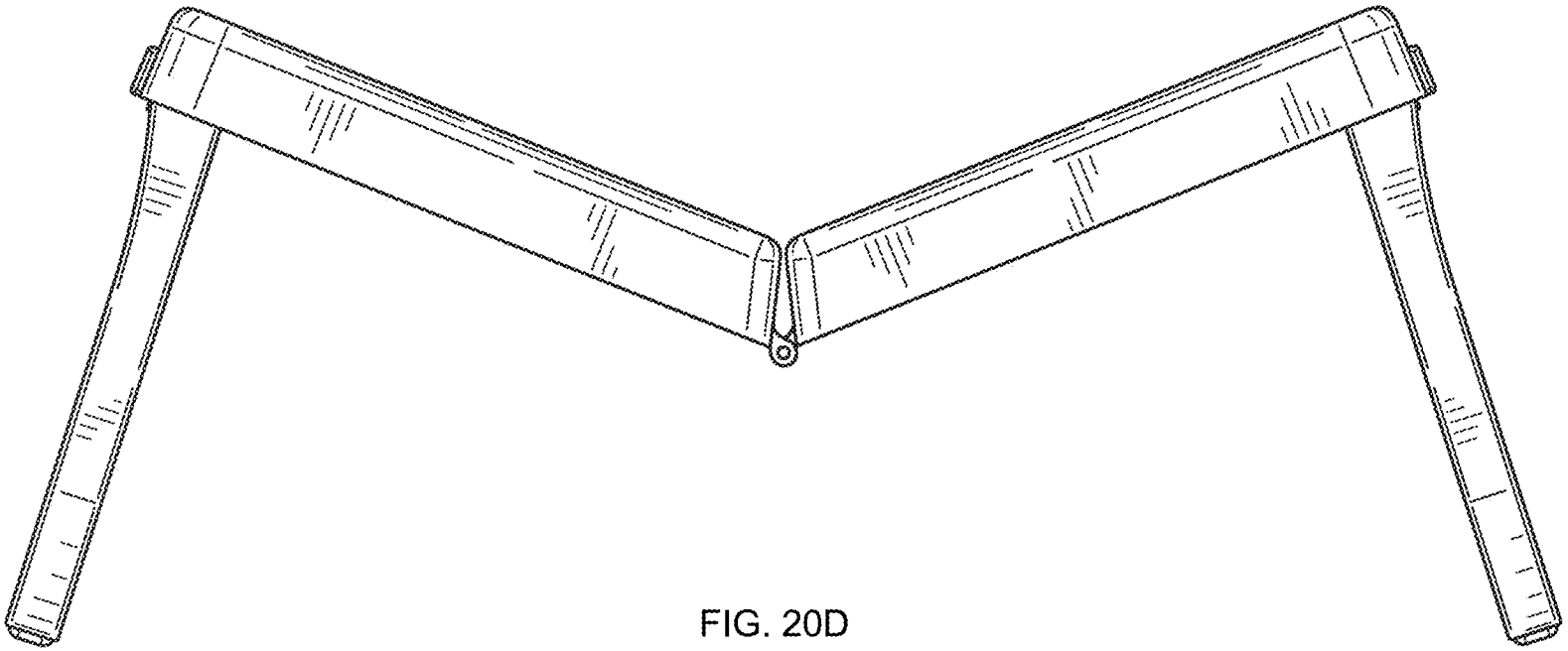
Figure 20E:
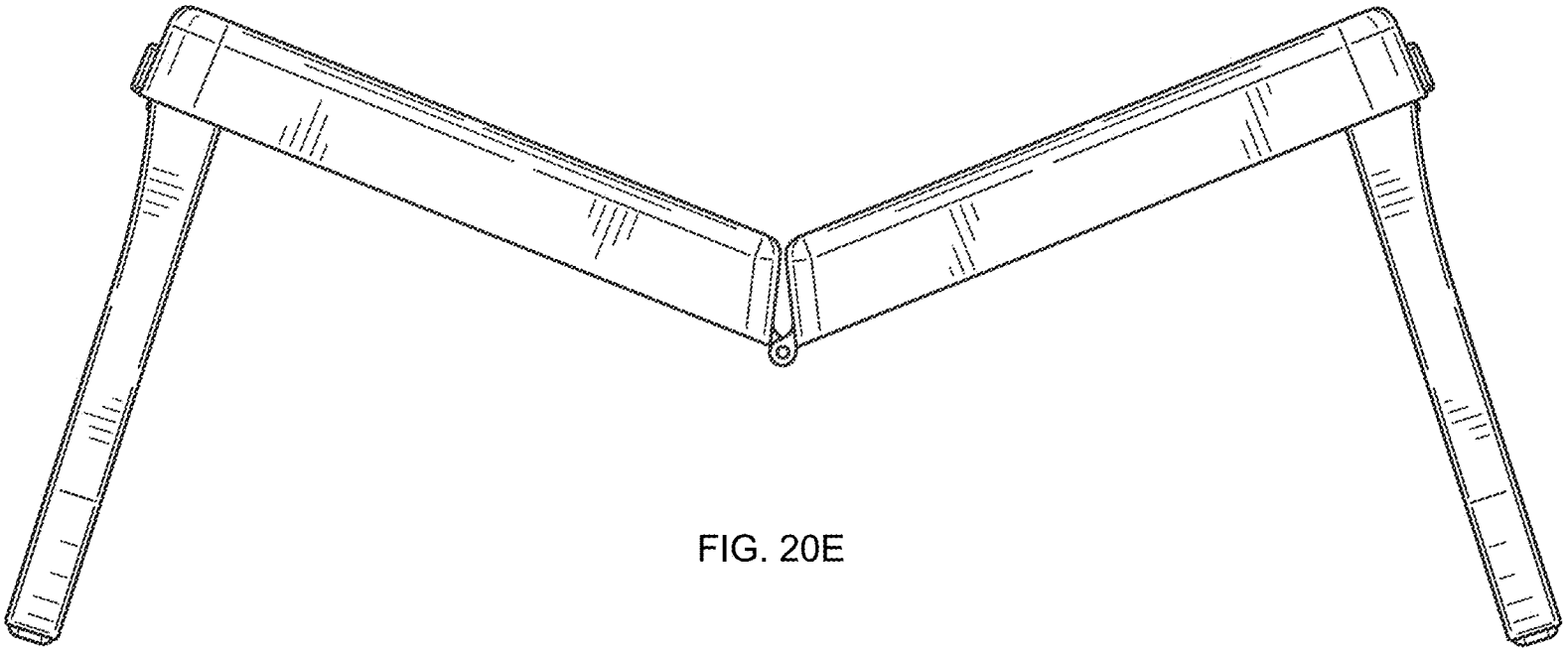
Figure 20F:
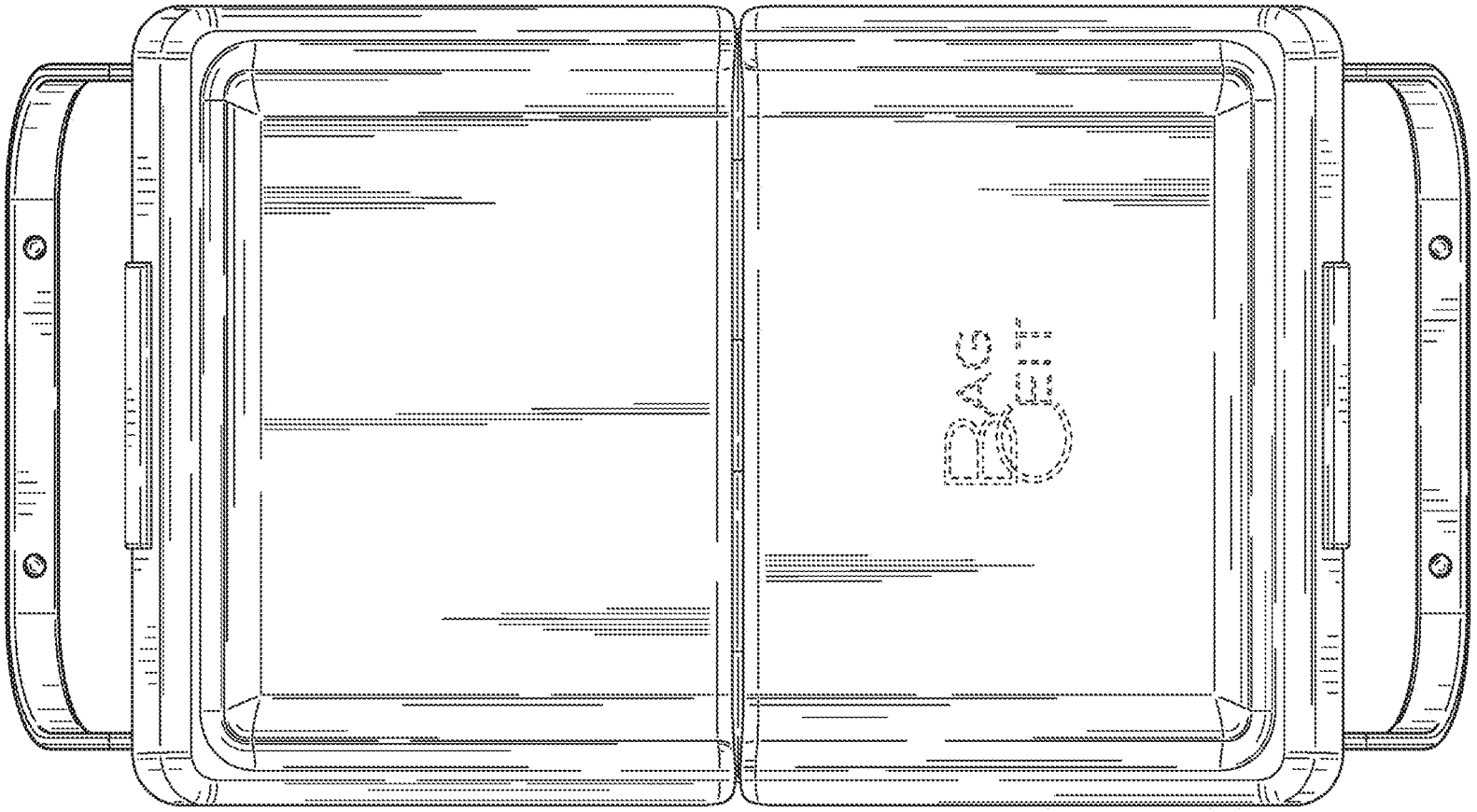
Figure 20G:
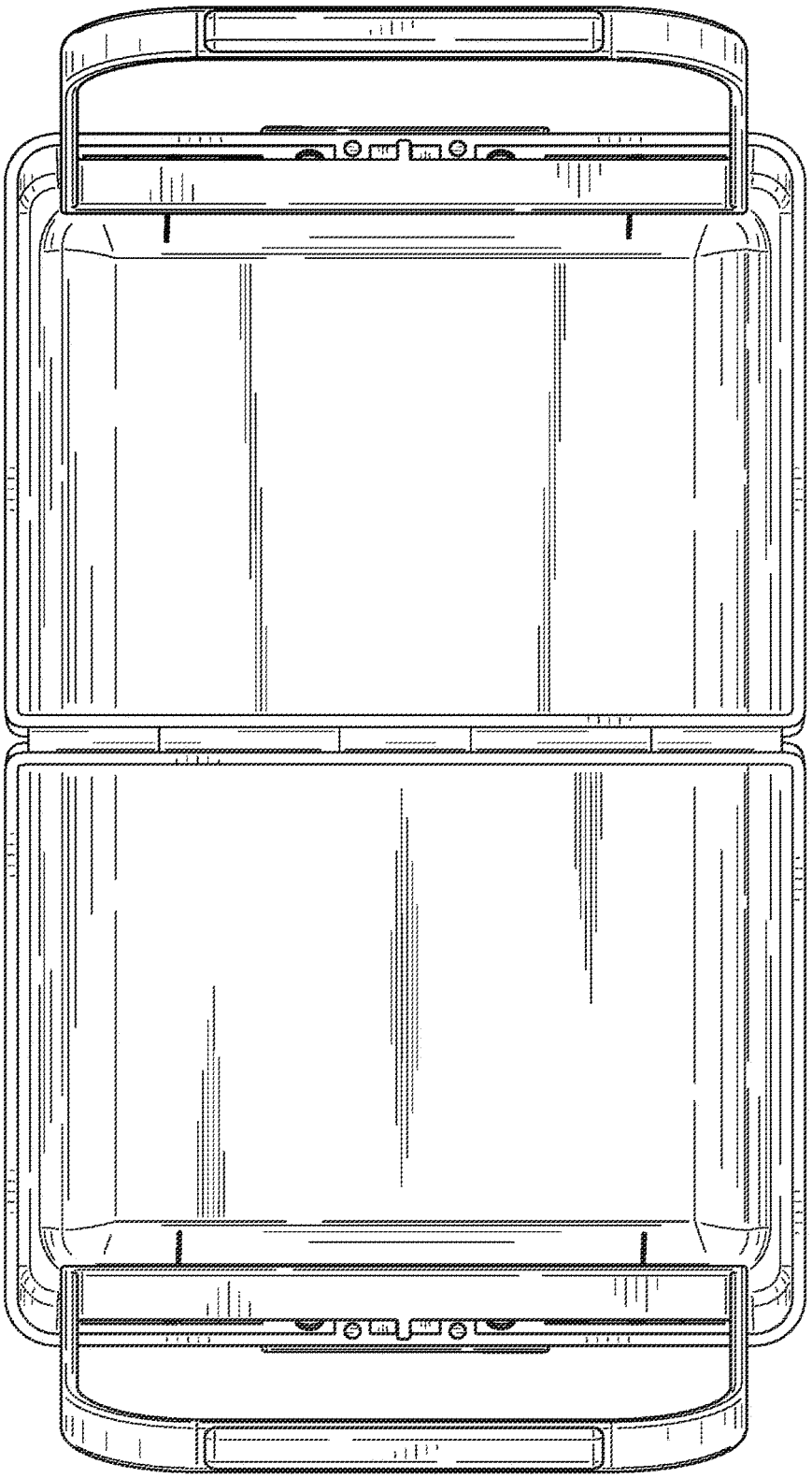
Figure 20H:
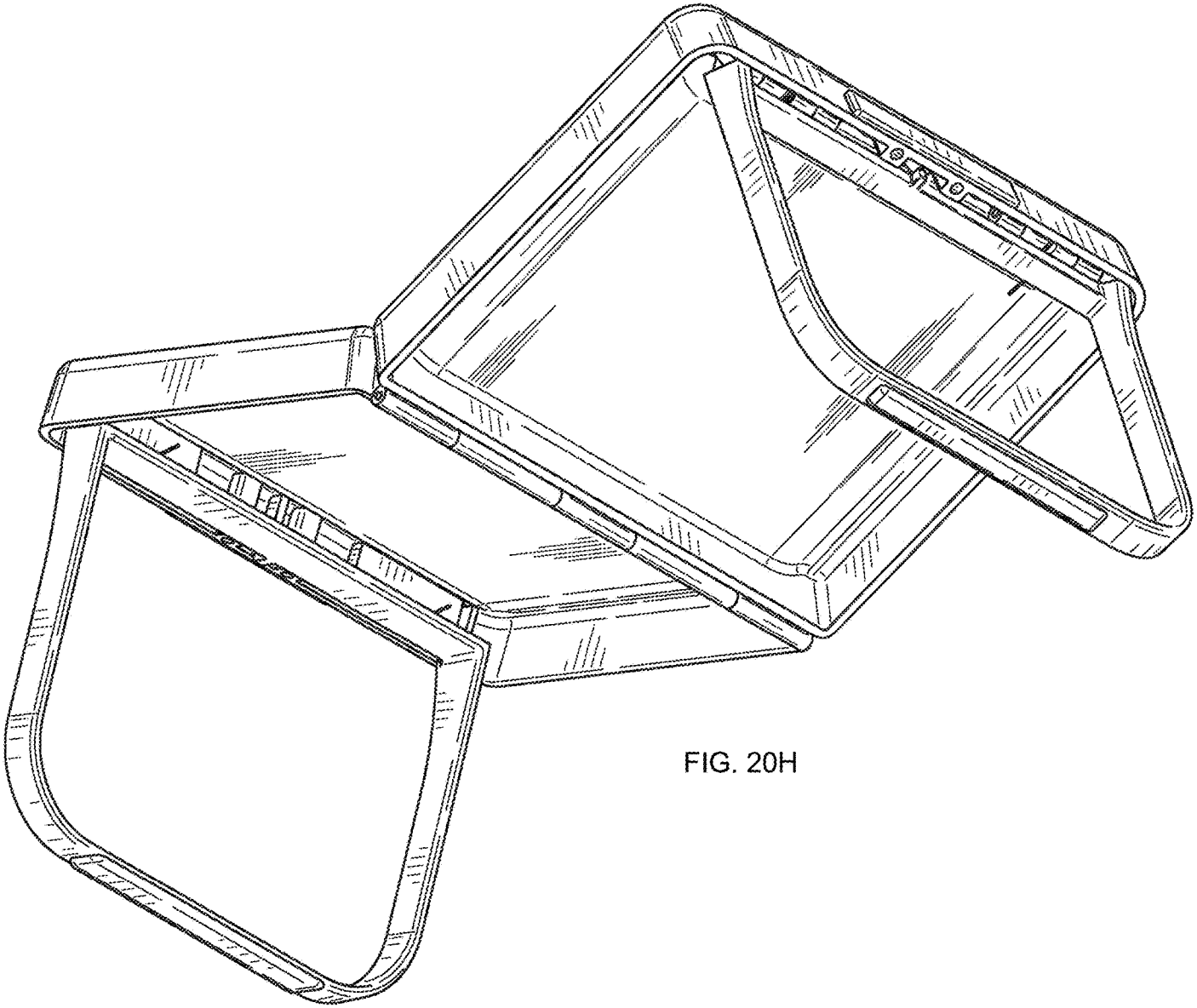

FIGS. 16A-E set forth additional information related to the product, according to various embodiments of the disclosure. As set forth in FIGS. 16A and 16C, the product (e.g., which can be called a Bagceit) can be an individually-sized, lightweight, small, inexpensive, sturdy, portable, easy to store, or easy to use, or any combination thereof. It can be made of fabric and/or metal. It can have retractable legs. It can be used for: purses, briefcases, and bags of all types. It can also be used for other items (e.g., books, computers, computer devices, cellphones, iPads, keys). The product can help keep an item from touching the floor. It can be used anywhere—indoors or outdoors (e.g., as shown in FIG. 19D: airport, airplane, restaurant, hospital, board room, cookout, restroom, sporting event, salon, gym, yoga, movie theatre, etc.). It can be stable on multiple types of floor surfaces. It can be cleaned (e.g., with antibacterial wipes, any cleaning product, anti-rust material).

As set forth in FIG. 16B, in some embodiments, the product can include a small, low-rise seat comprised of a durable fabric (e.g., canvas, plastic) supported by lightweight, collapsible legs (e.g., metal). When the seat is open, an item can be placed upon it. The seat can slide under or sit next to a chair, or in front of a person's feet. The product can be small, so it can fit in tight spaces. When folded, the product can be smaller and more easily portable. As indicated in FIG. 16E, the product can have a strap (e.g., a wrist strap, a longer strap).

In some aspects of the disclosure, a microban can be used on any of the parts of the product used to hold items to help hinder the growth of bacteria. For any parts of the product with plastic in them (e.g., enclosures (e.g., ABS), clips (e.g., ABS), feet (e.g., rubber)), additives can be mixed in with polymers then the part can be manufactured. For any parts of the product with metal in them (e.g., clasps (e.g., 304 stainless steel), legs (e.g., aluminum)), additives can be mixed into the epoxy, which can be applied after the parts have been manufactured. The following references (all dated May 12, 2020), which are incorporated by reference, discuss additional hygenic features and materials that can be used in any parts of the product used to hold items, according to aspects of the disclosure:

https://materialdistrict.com/article/bacteria-fighting-materials/ https://aabme.asme.org/posts/material-resists-bacteria-prevents-infection-saves-lives https://plasticpartsinc.com/plastic-decorating The following references, which are incorporated by reference, discuss a microban additive that can be used (e.g., with ABS, metal, rubber) and a biocote additive that can be used, according to aspects of the disclosure.

https://www.microban.com/antimicrobial-solutions/applications/antimicrobial-plastics https://www.biocote.com/treatable-materials/plastics-polymers/

The following references, which are herein incorporated by reference, discuss example textures/biomimicry (e.g., sharklet, leaves, leather material over plastic enclosures) that can be used, according to aspects of the disclosure). In some aspects of the disclosure, the product used to hold items can be made using recycled plastic, metal, and/or rubber.

https://www.sharklet.com/ https://www.wired.com/2014/06/empzeal-superhydrophobic-leaf/

FIG. 21A illustrates an example description of aspects of the disclosure. A product (e.g., stand, small table) for holding items (referred to herein as the "Bagceit" although any other name may be used) can be helpful for those interested in keeping items from touching the floor (e.g., for hygiene, cleanliness, etc.). The Bagceit can be an individual sized, lightweight, small, affordable, or portable, or any combination thereof. It can be a portable seat with retracable legs for any item that can be placed on the Bagceit, including: purses, briefcases, bags, keys, cellphones, laptops, or other personal items, or any combination thereof. The Bagceit can help a bag and personal items from touching the floor. It can be used anywhere (e.g., school, gym, airplane, gala, restaurant or eating environment, or professional's office (e.g., doctor, dentist, therapist, etc.) It can be used indoors and/or outdoors. The Bagceit can help avoid taking up space on a table or chair or lap. The Bagceit can also help avoid hanging items on a chair.

Figure 21B:
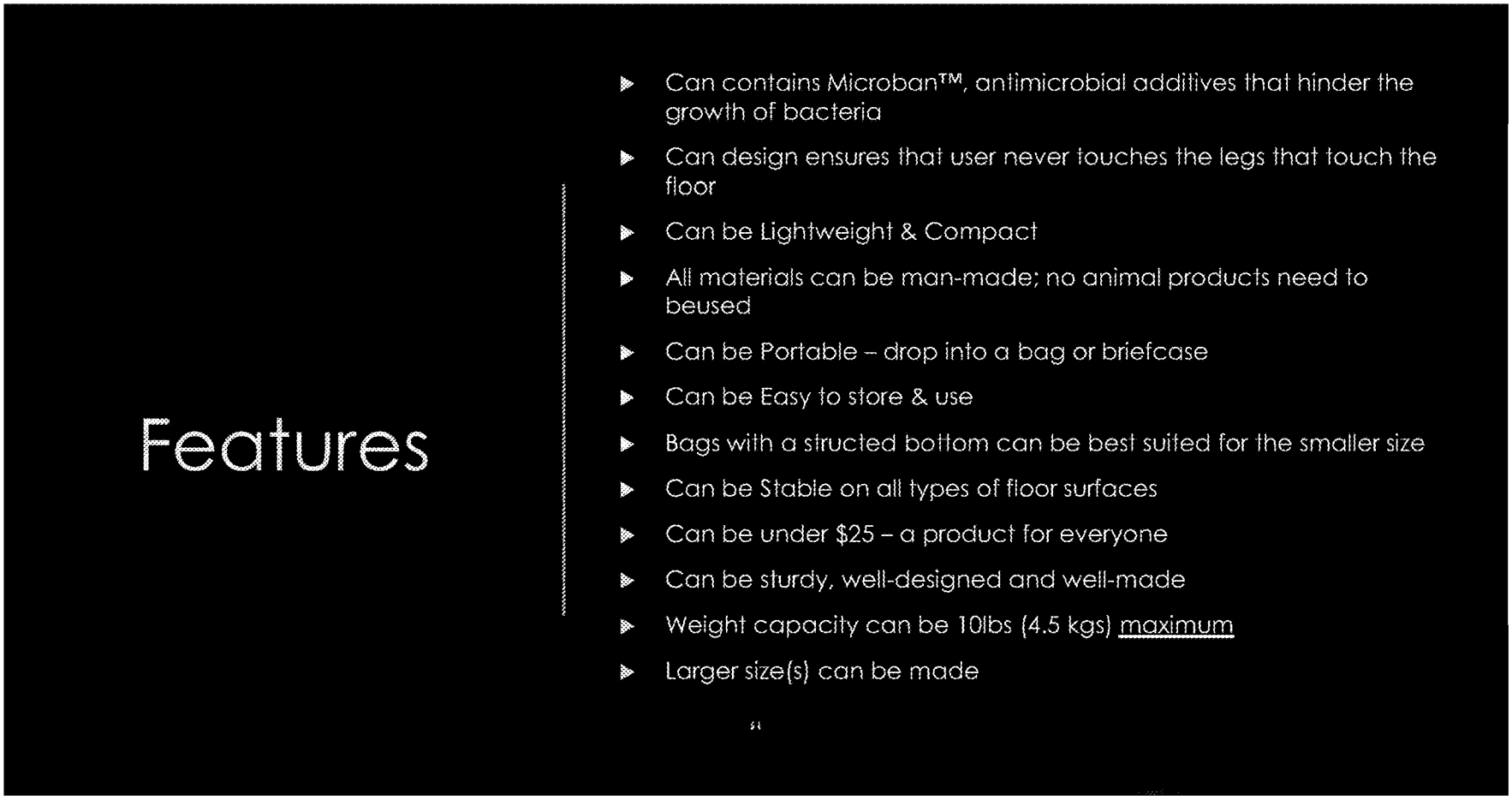
FIG. 21B illustrates example features of the Bagceit, according to aspects of the disclosure.
Figure 21C:
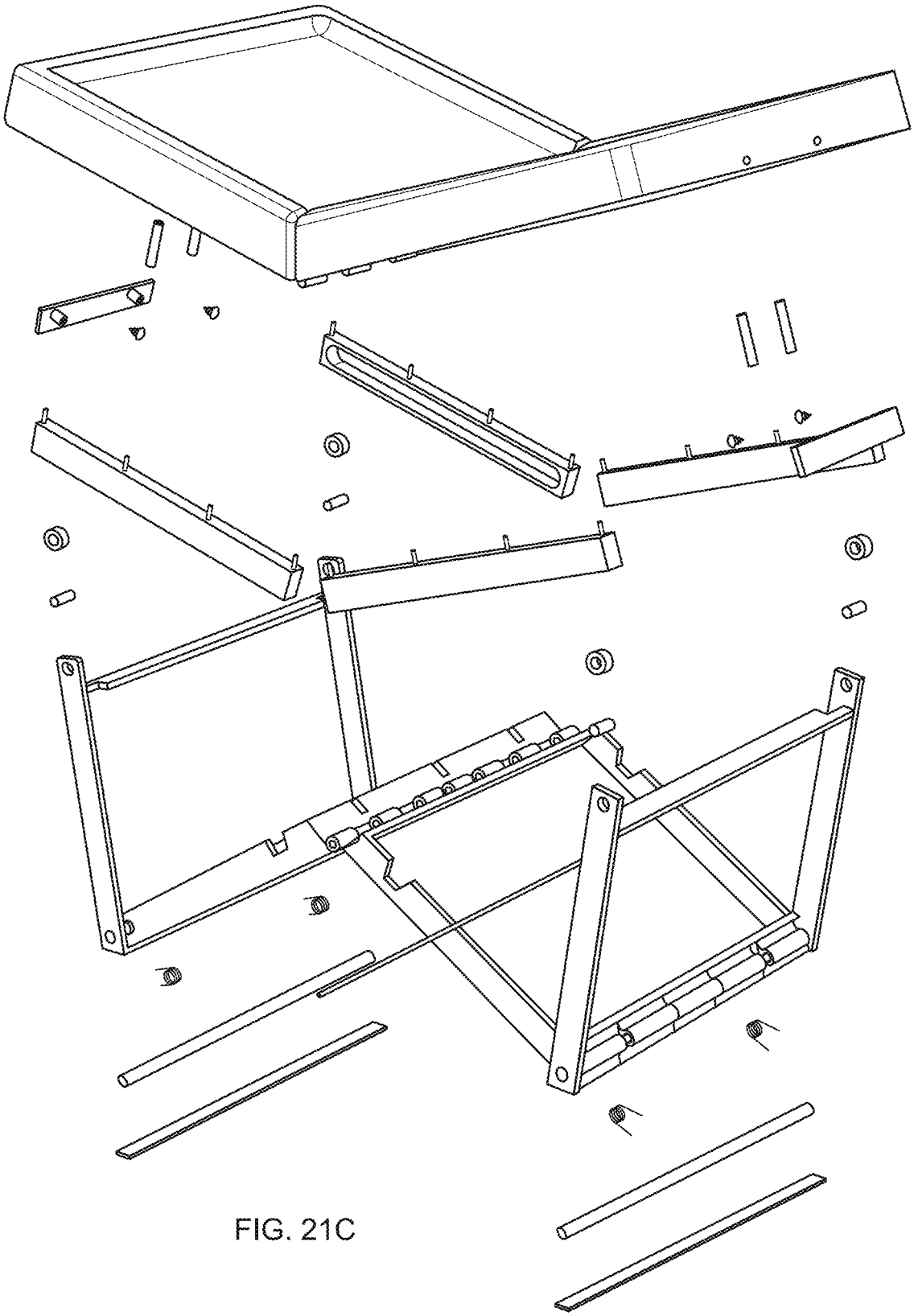
FIG. 21C illustrates example parts of the Bagceit, according to aspects of the disclosure.

FIG. 21B illustrates example features of the Bagceit, according to aspects of the disclosure. The features can include, but are not limited to: containing antimicrobial additives that can hinder the growth of bacteria; design can help user not tough the legs that touch the floor; can be lightweight and/or compact; materials can be man-made (e.g., animal products do not need to be used, but can be used in some aspects of the disclosure); can be portable (e.g., can drop into a bag or briefcase), can be easy to store and/or use; can hold a bag with a structured or unstructured bottom; can be stable on all types of floor surfaces; can be inexpensive (although can be expensive in some embodiments as well); can be sturdy or flexible; or can hold up to 10 lbs in some aspects of the disclosure (can hold more than 10 lbs in other aspects of the disclosure); or any combination thereof. FIG. 21C illustrates example parts of the Bagceit, according to aspects of the disclosure. These can include, but are not limited to: logos (e.g., printed, embossed, etc.), enclosures, magnets, clasps, screws and/or magnets, slotted rails, slider pins, legs, pins, spring, leg hinge pins, or feet, or any combination thereof. Note that any part of the Bagceit can be off the shelf and/or custom made. Note that any part of the Bagceit can be injection molded, die case, cast, or machined, or any combination thereof.

FIG. 21D illustrates example microban and materials, according to aspects of the disclosure. The microban can hinder the growth of bacteria in any amount. Additives can be mixed in with polymers, and then the part can be manufactured (e.g., for plastic application); and/or additives can be mixed into an epoxy which can be applied after parts have been manufactured (e.g., for metal applications). For example, the enclosures, clips, and/or feet can have a plastic application; and the clasps and/or legs can have a metal application. However, any part can have either plastic application and/or metal application.

Figure 21E:
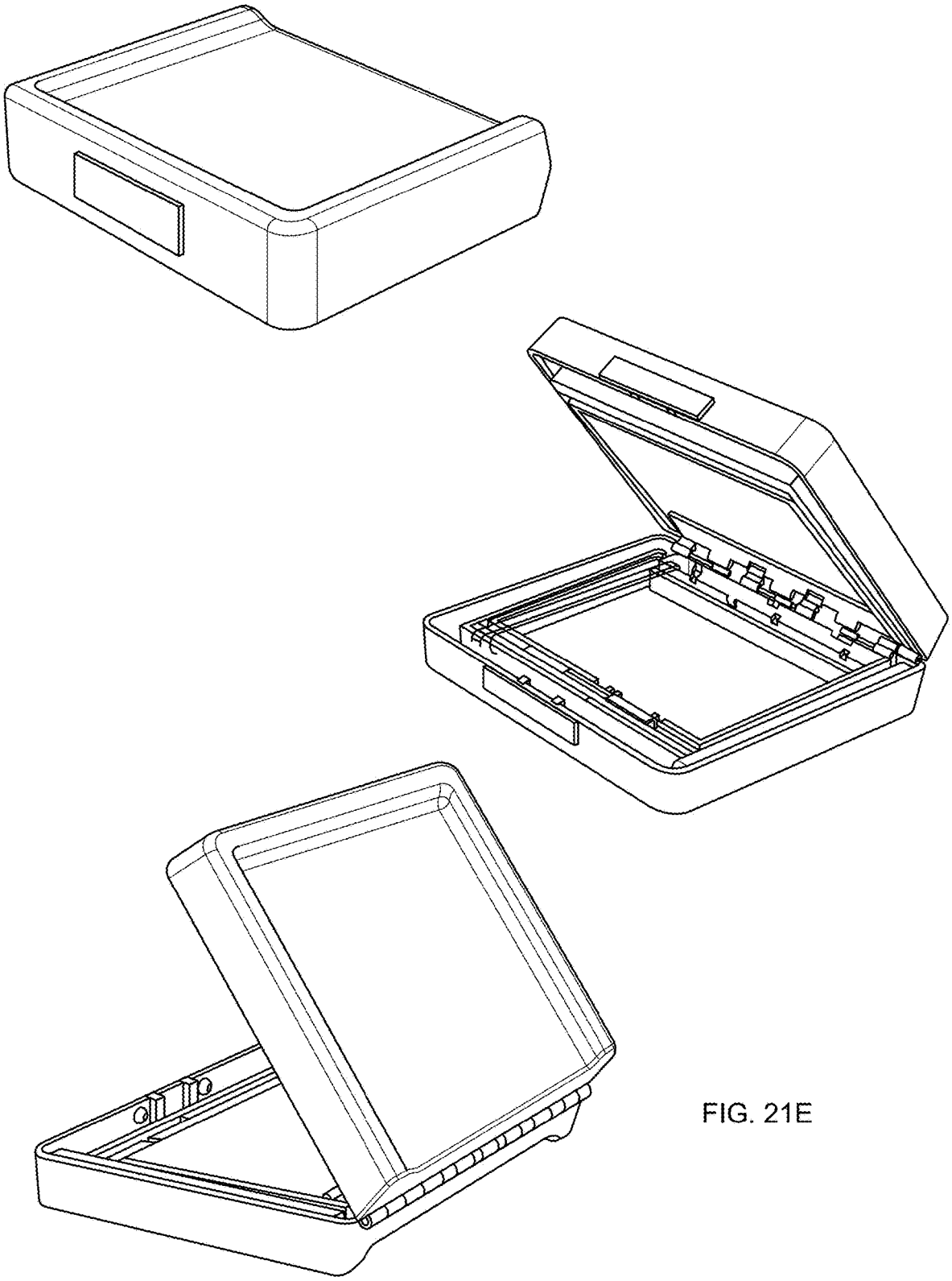
Figure 21E:
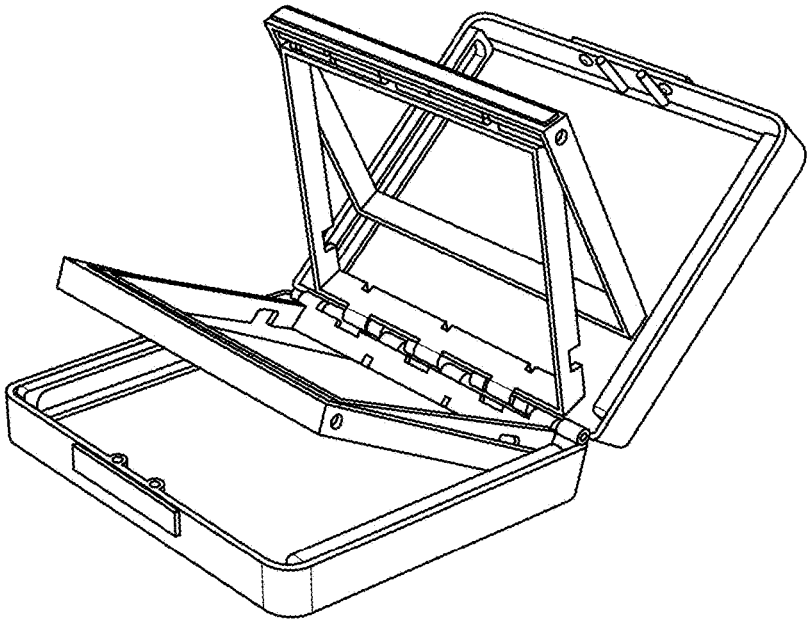
Figure 21E:
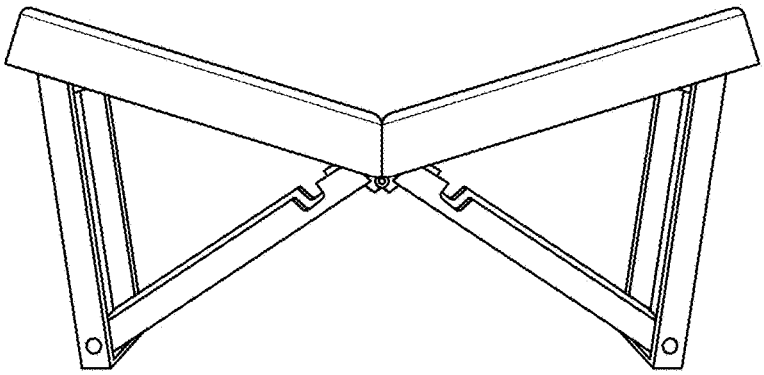
Figure 21E:
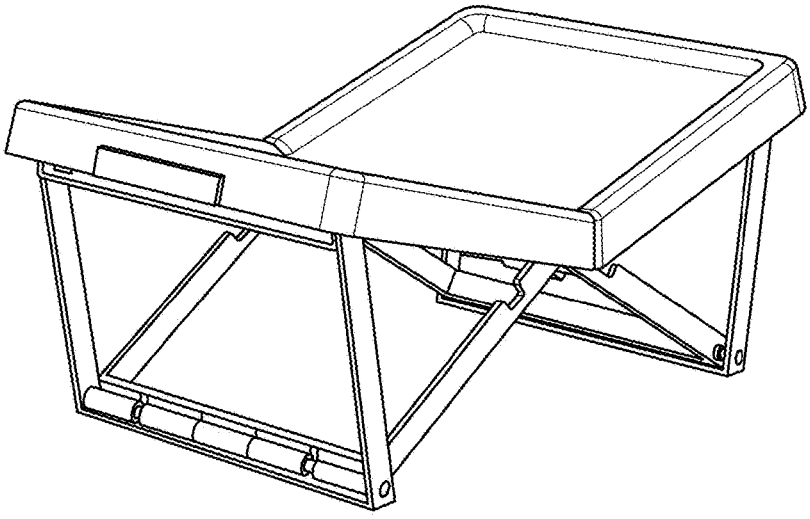
Figure 22C:
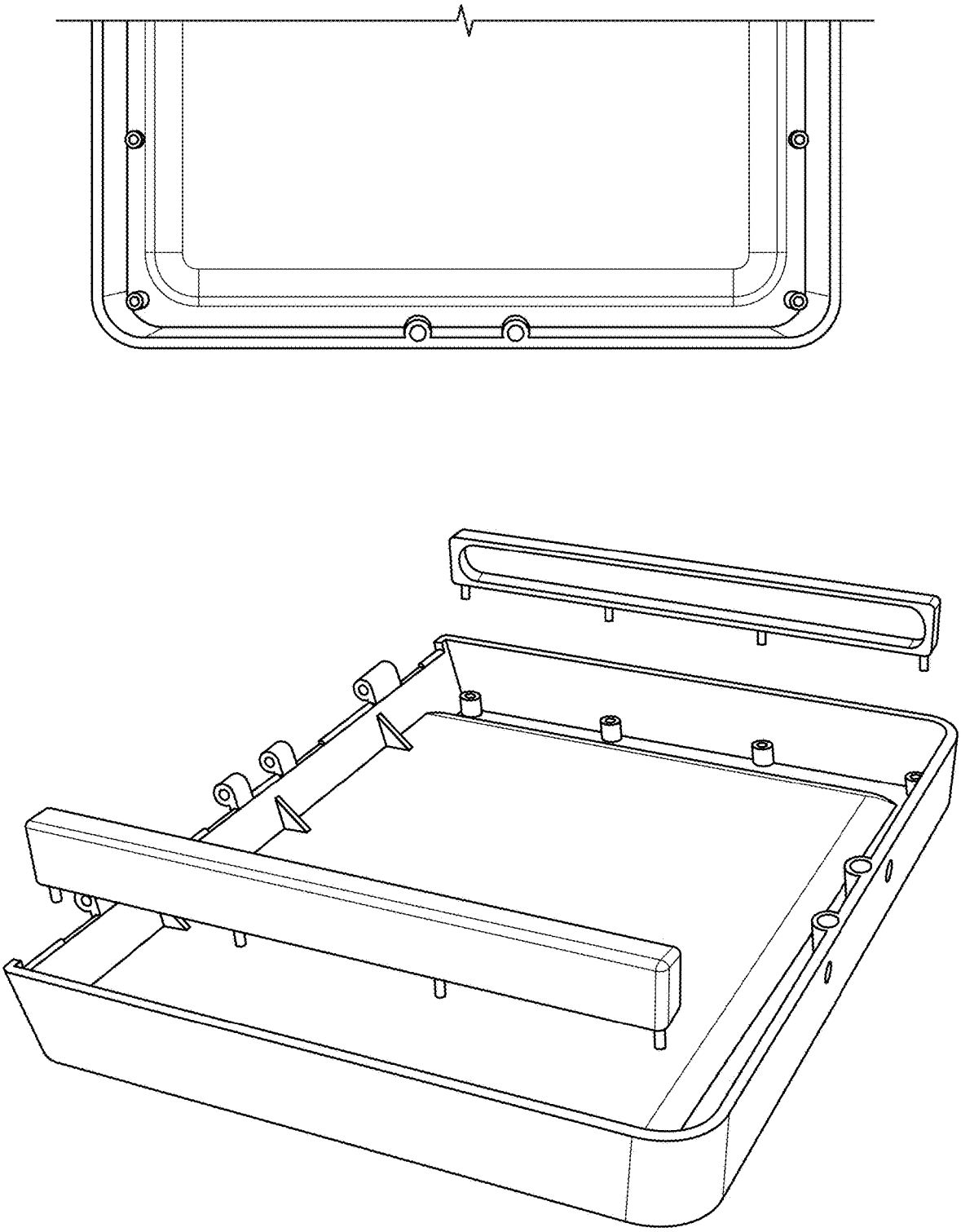
Figure 22D:
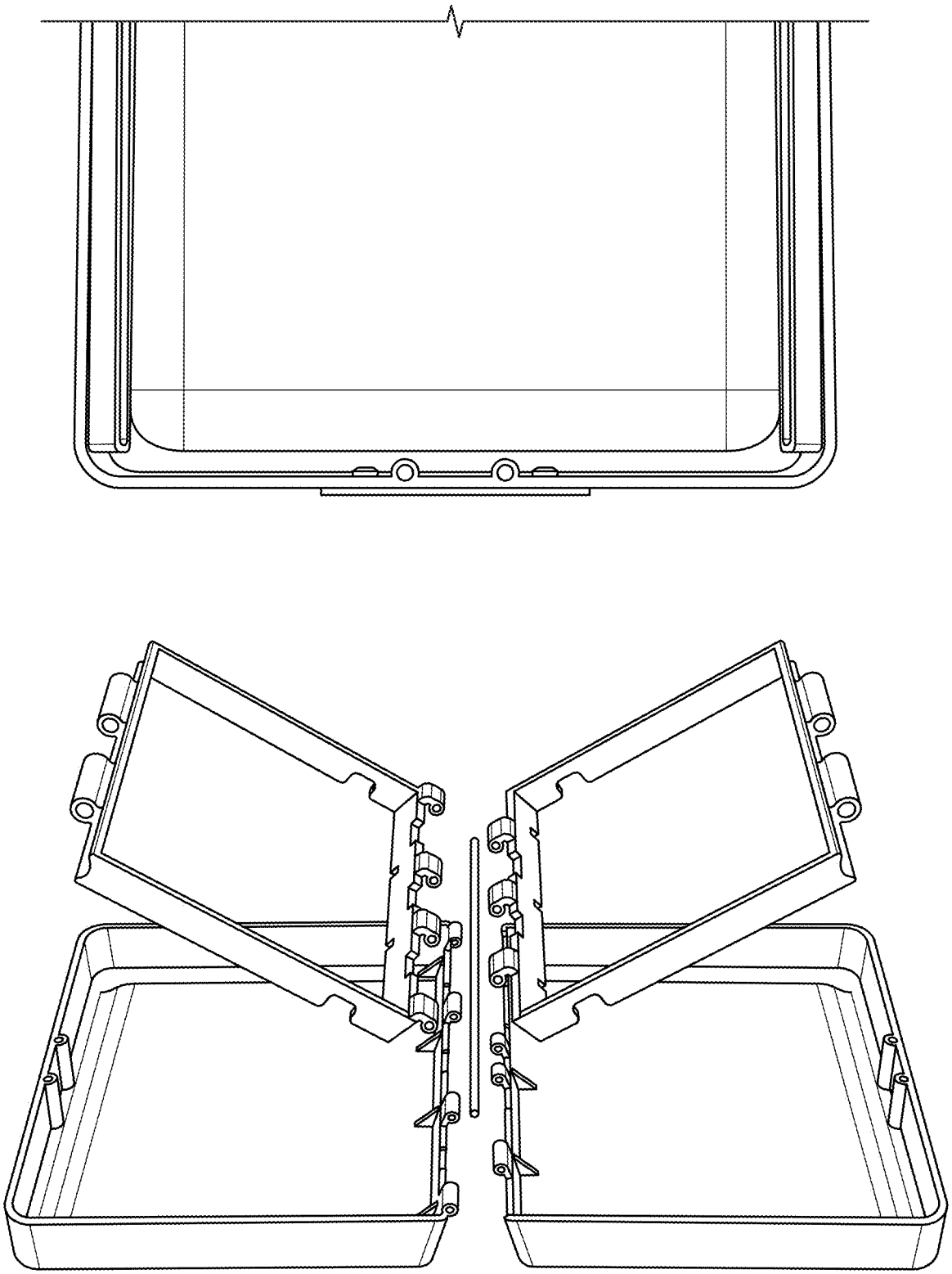
Figure 22E:
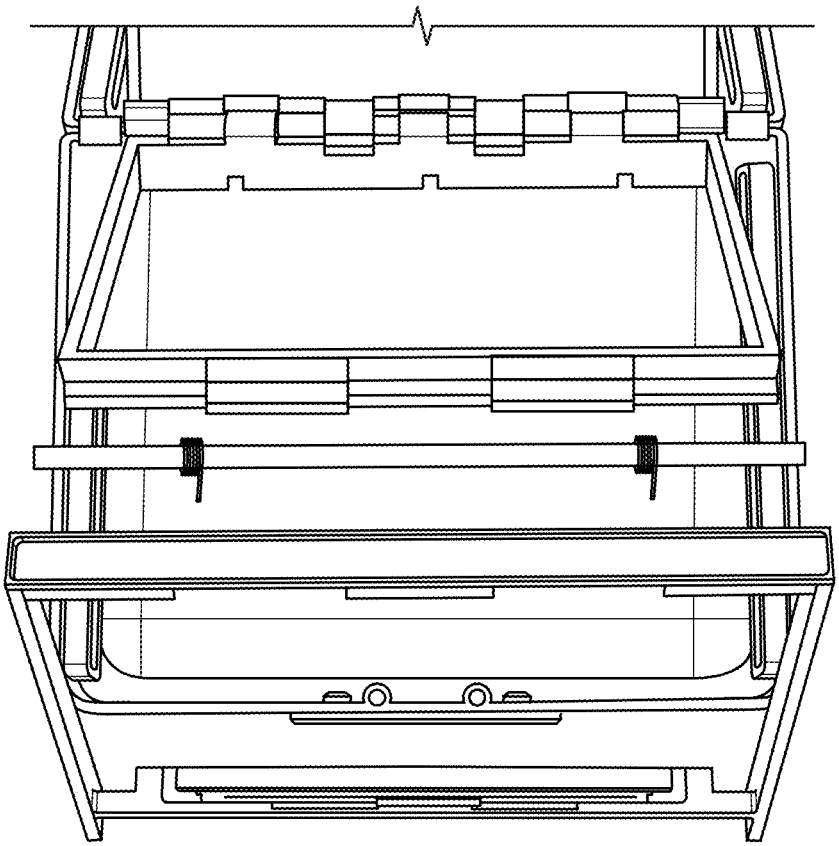
Figure 22E:
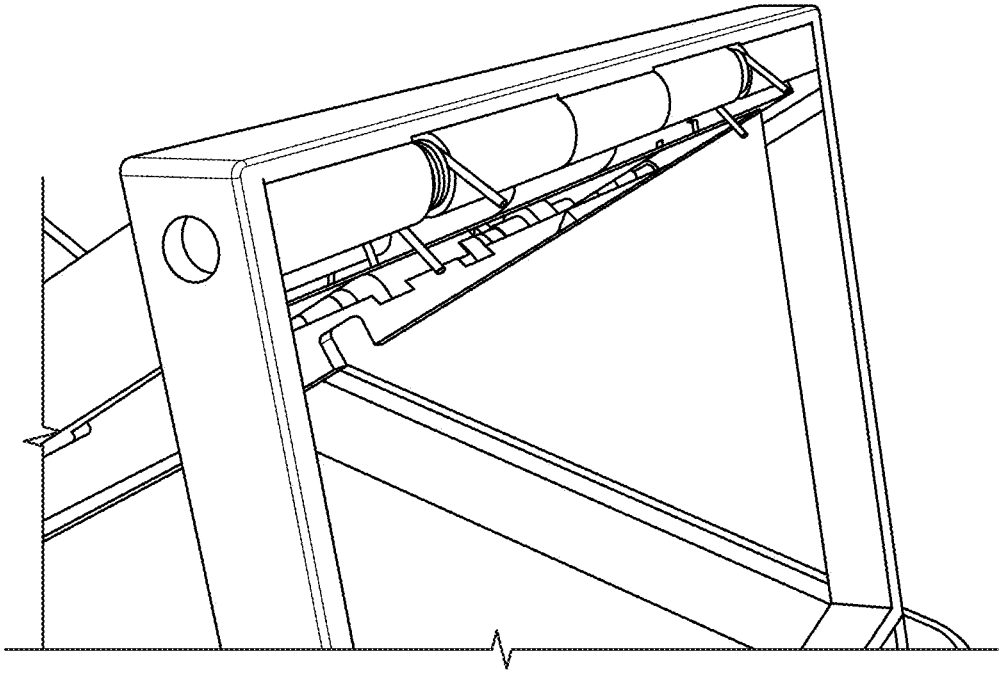
Figure 22F:
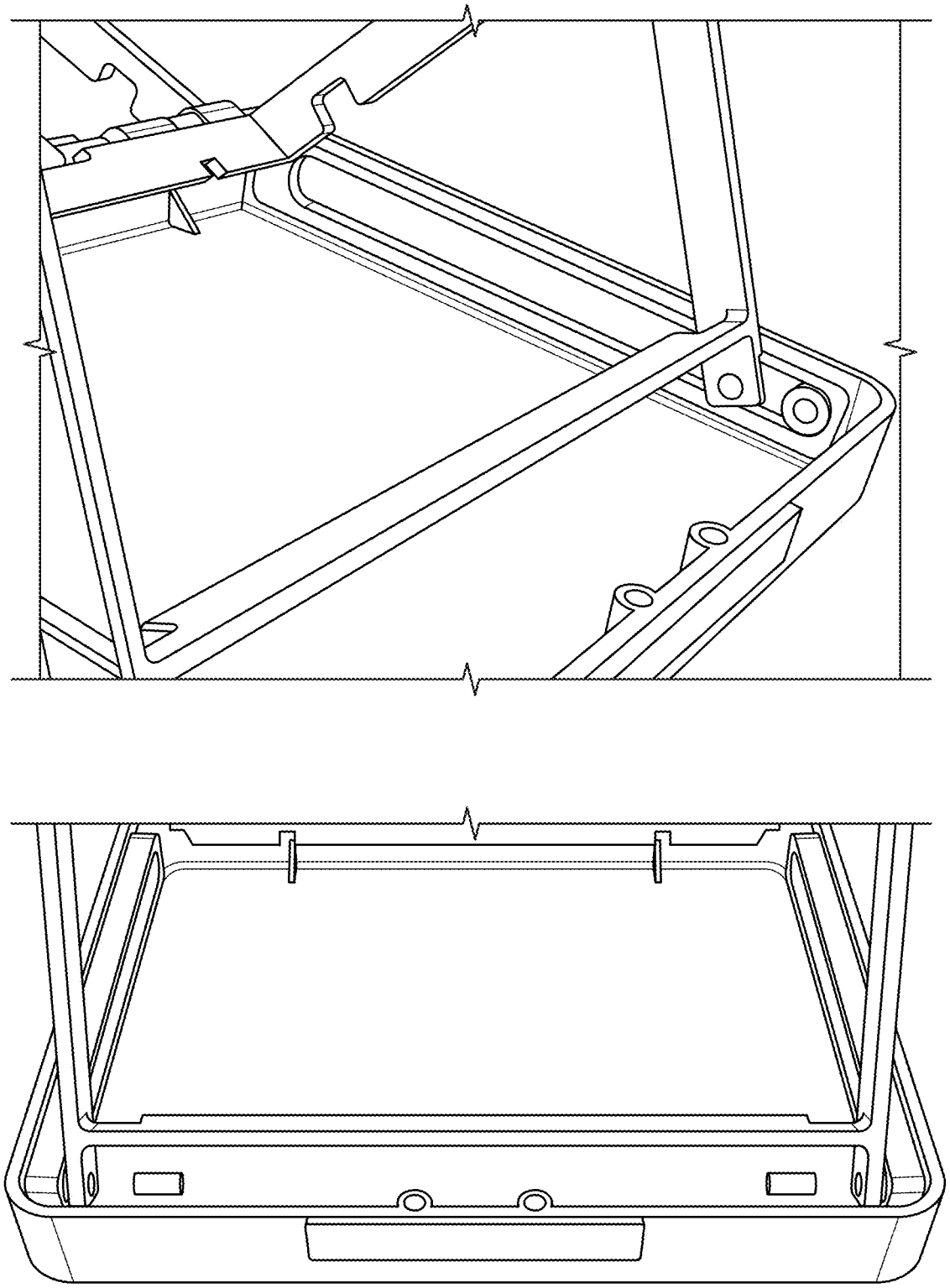
Figure 22G:
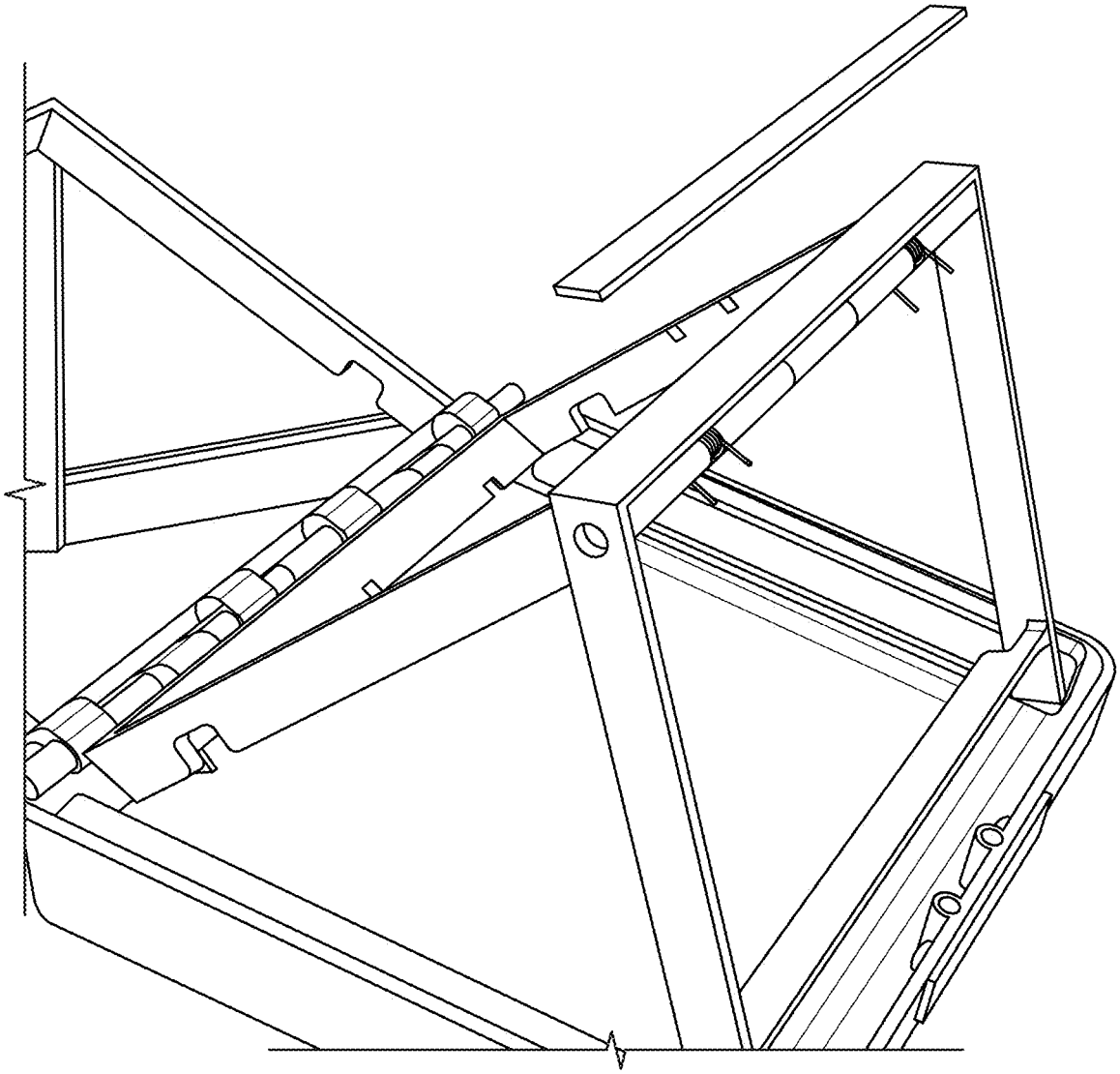

FIG. 21E illustrates a top and bottom view of the Bagceit, according to aspects of the disclosure.

FIGS. 21F-21G illustrates example product dimensions of the Bagceit according to aspects of the disclosure. Note that any dimension may be used in other aspects of the disclosure.

Note that any color palette or combination of color palettes can be used.

FIGS. 3A-3D illustrates example enclosure packaging for the Bagceit. Note that any enclosure can be provided in some aspects of the disclosure. In other aspects of the disclosure, no enclosure is needed and a handle or other way to hold and carry the Bagceit can be provided.

FIGS. 22A-22G illustrate example instructions for making a Bagceit, according to aspects of the disclosure. In 1.0-6.0, example preliminary information is provided. In 7.0, example tools, fixtures and gauges are listed, which include, but are not limited to: wire cutters, screwdriver (various kinds can be used in various aspects), super glue, metal file, mallet and/or hammer, or tape measure, or any combination thereof. In 8.0, example safely requirements can be given. Note that these can change according to aspects of the disclosure.

In 9.0, example generally assembly instructions are given. In 9.1, example materials are listed. Note that in some aspects of the disclosure, any combination of these parts can be used, and other parts can also be used. In 9.2, a long pin, slider pins, and leg hinge pins (example dimensions given) can be cut (e.g., using wire cutters or another cutter). All burrs and/or sharp edges can be removed with a metal file. The pin can be filed down so that both ends can have flat faces. In 9.3, magnets can be fit (e.g., press fit or other manner) into a hole. Magnets can be tested and installed into an enclosure shell. In 9.4, slotted railed can be fit into holes in the enclosures. The slots may face inward, towards each other. In 9.5, clasps can be installed onto the side of the enclosure shells. In 9.6, the hinges of the enclosure shells and legs can be lined up and secured together (e.g., by inserting a long pin or any other element). In 9.7, the tension spring can be held in place and the leg hinge pin can be inserted into the legs. The torsion springs can be held in place and the leg hinge pin can be inserted in each leg. In 9.8, a low friction sleeve can be placed into a slotted rail. This can be repeated (e.g., 3 times or another amount of times). In 9.9, the holes in the leg can be lined up with the holes in the low friction sleeves, and the slider pin and be inserted into the hole. This can be repeated (e.g., 3 times or another amount of times). In 9.10, the bumper can be inserted into the groove at the bottom of the legs. Note that any of these elements can be altered or done differently by methods and using materials known to those of ordinary skill in the art, according to aspects of the disclosure.

FIGS. 23A-23C disclose various features of the product, according to some aspects of the disclosure. In some aspects, the legs can have additional components to help improve the structure and help minimize wobbling when under weight. In some aspects, the legs can remain spring loaded, and can be attached at the main hinge and/or side rails can guide the legs to their open/closed positions. This can improve the overall integrity of the product, while remaining semi-automatic. In some aspects, ribs can be included. Note that the injection molding and/or the die casting (as well as any other method or part in this patent application) can also be done in any other manner known by those of ordinary skill in the art.

Figure 24:
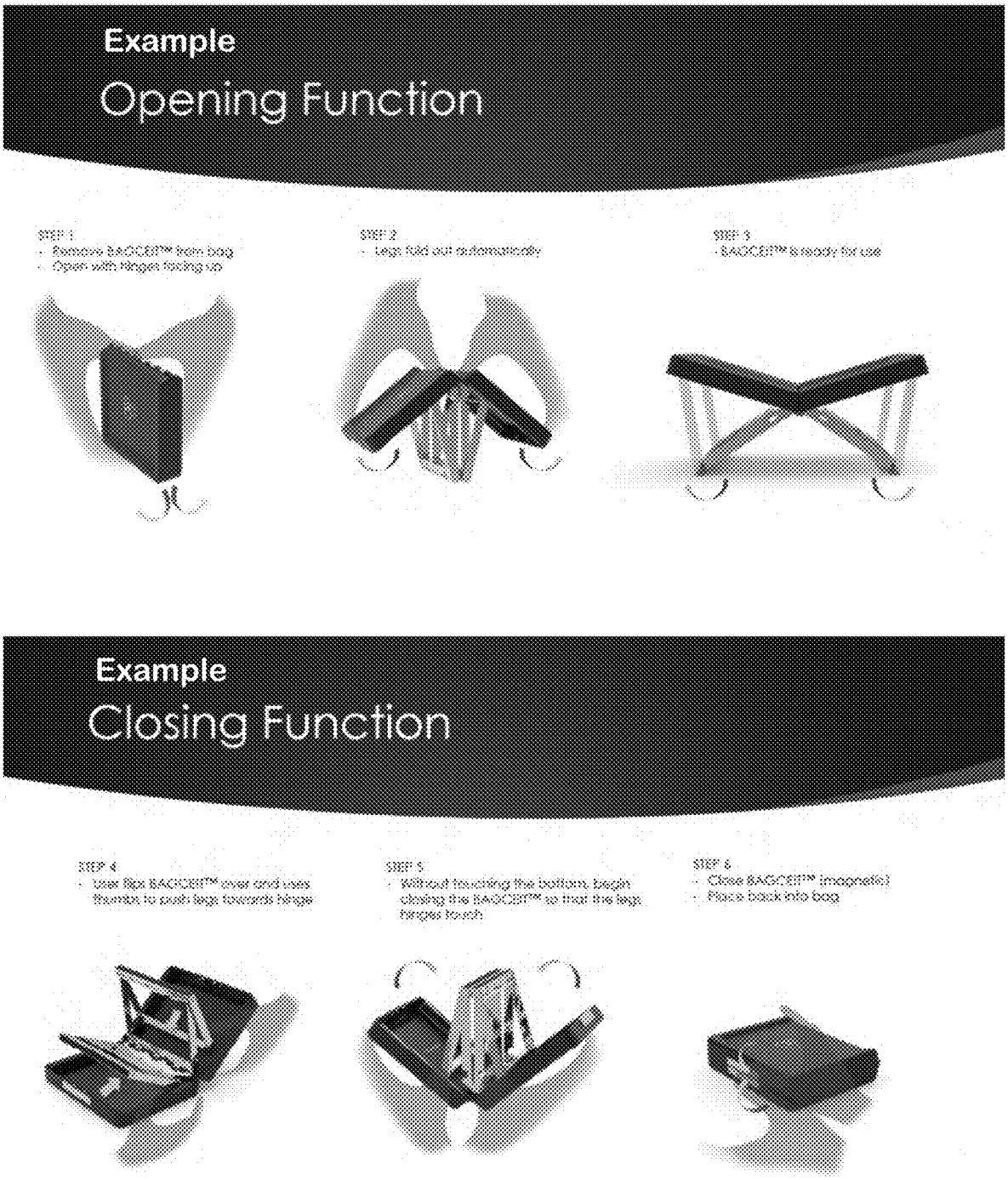
FIG. 24 illustrates example opening and closing functions, according to aspects of the disclosure.
Figure 25A:
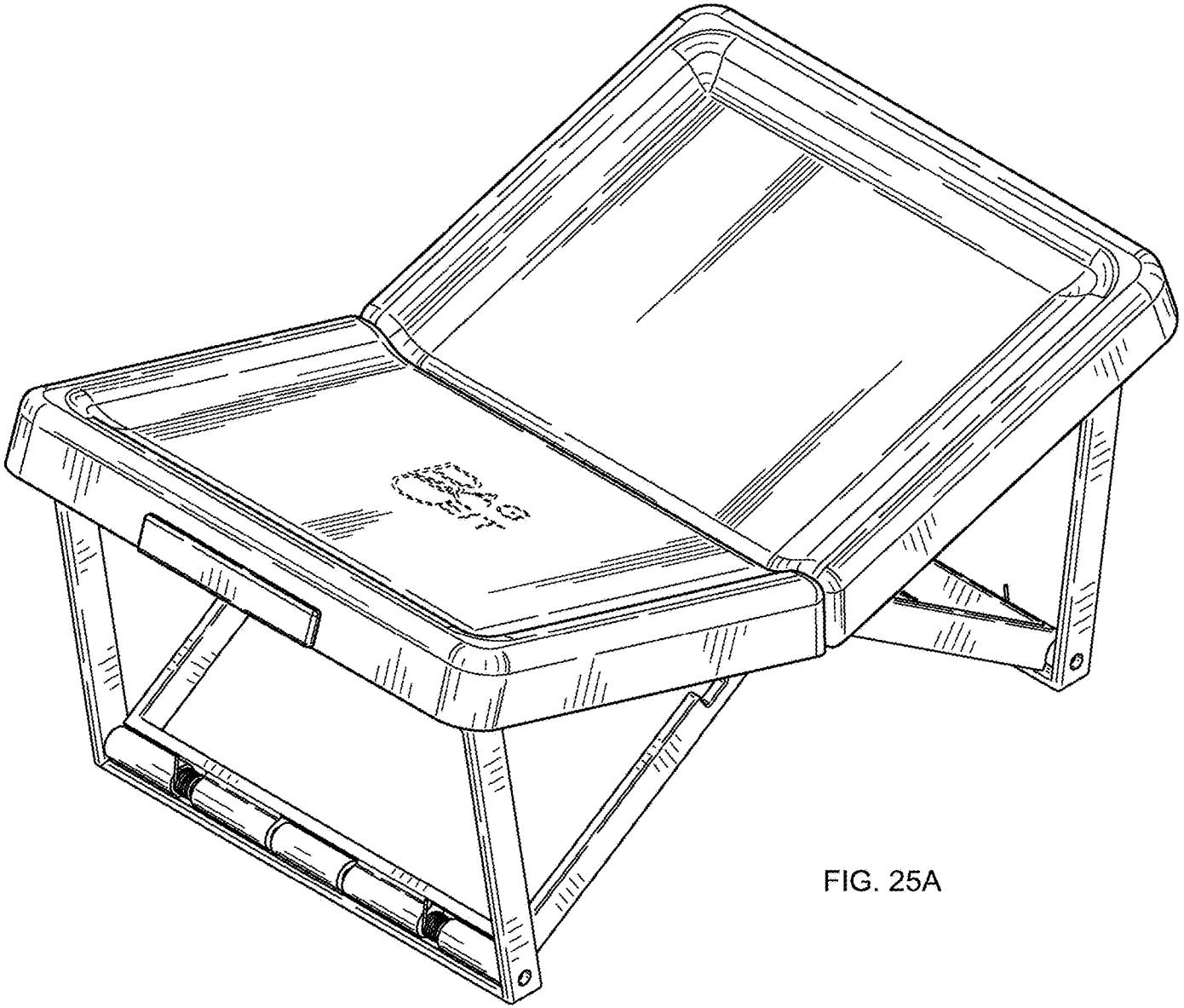
FIGS. 25A-25H illustrate example views of the product, according to aspects of the disclosure.
Figure 25B:
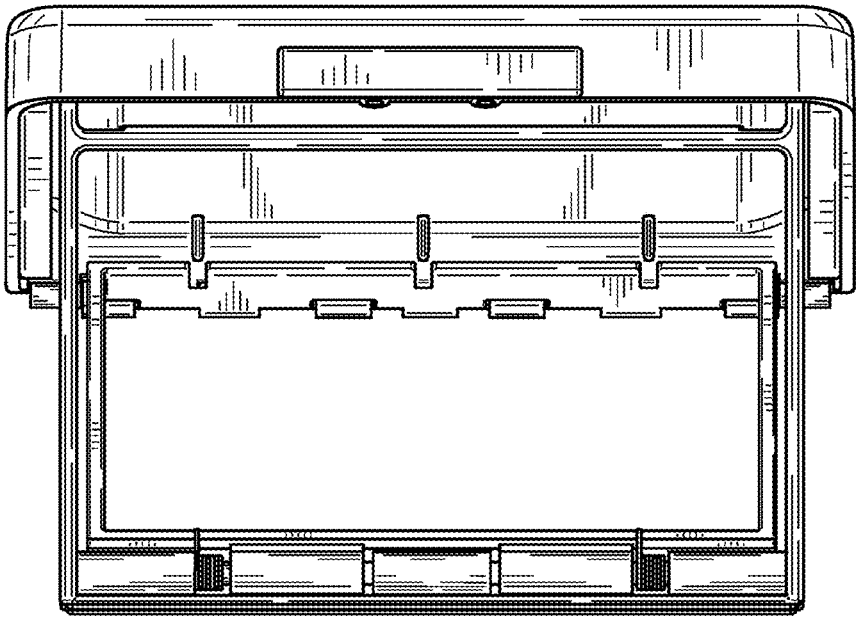
Figure 25C:
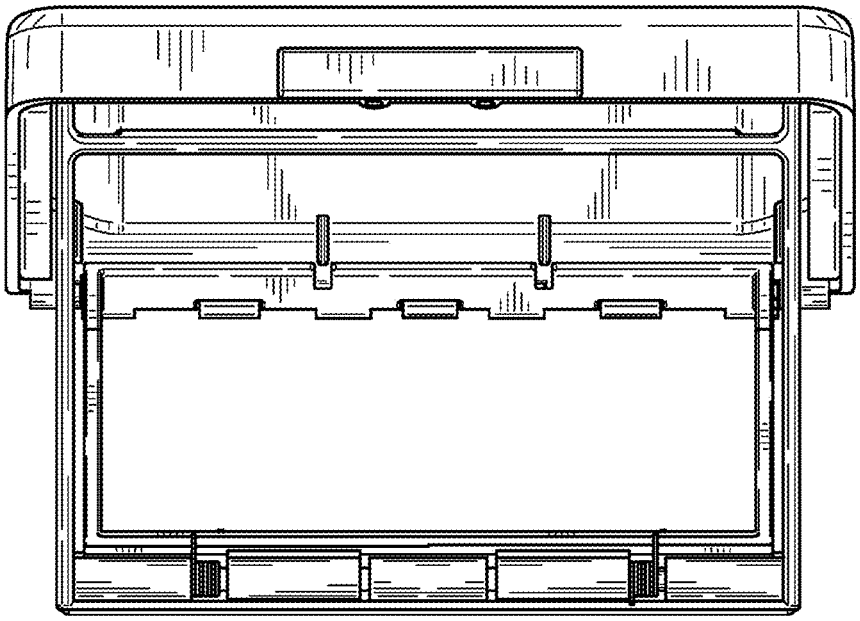
Figure 25D:
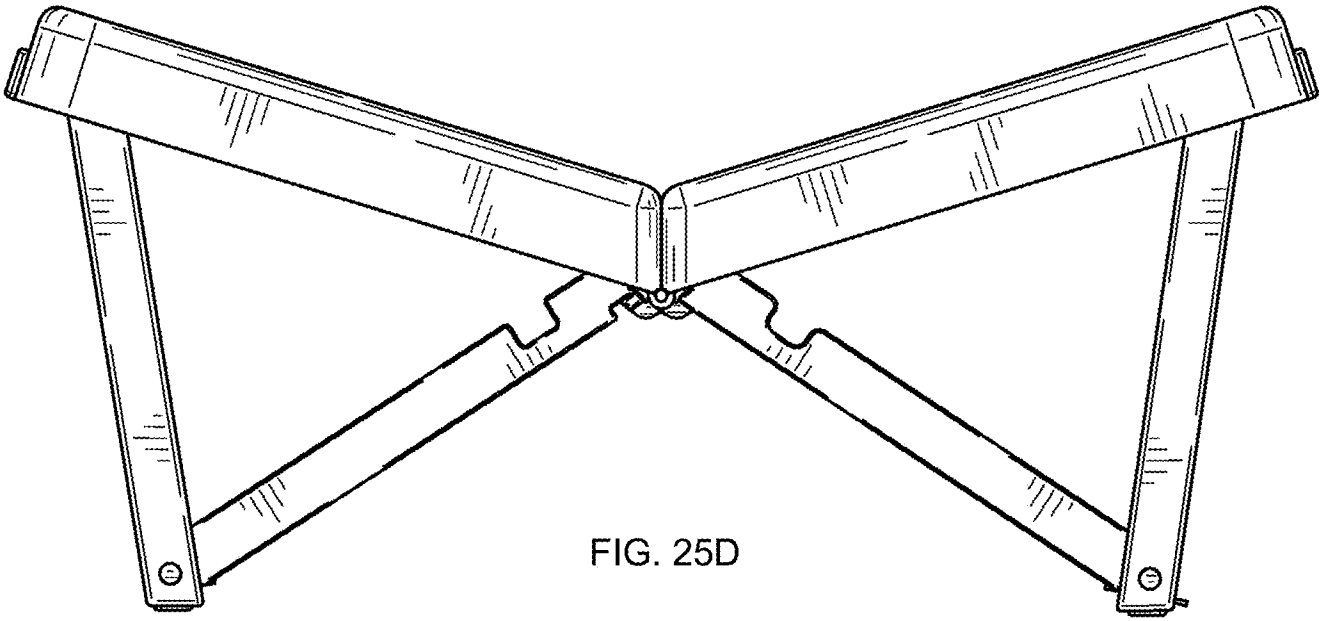
Figure 25E:
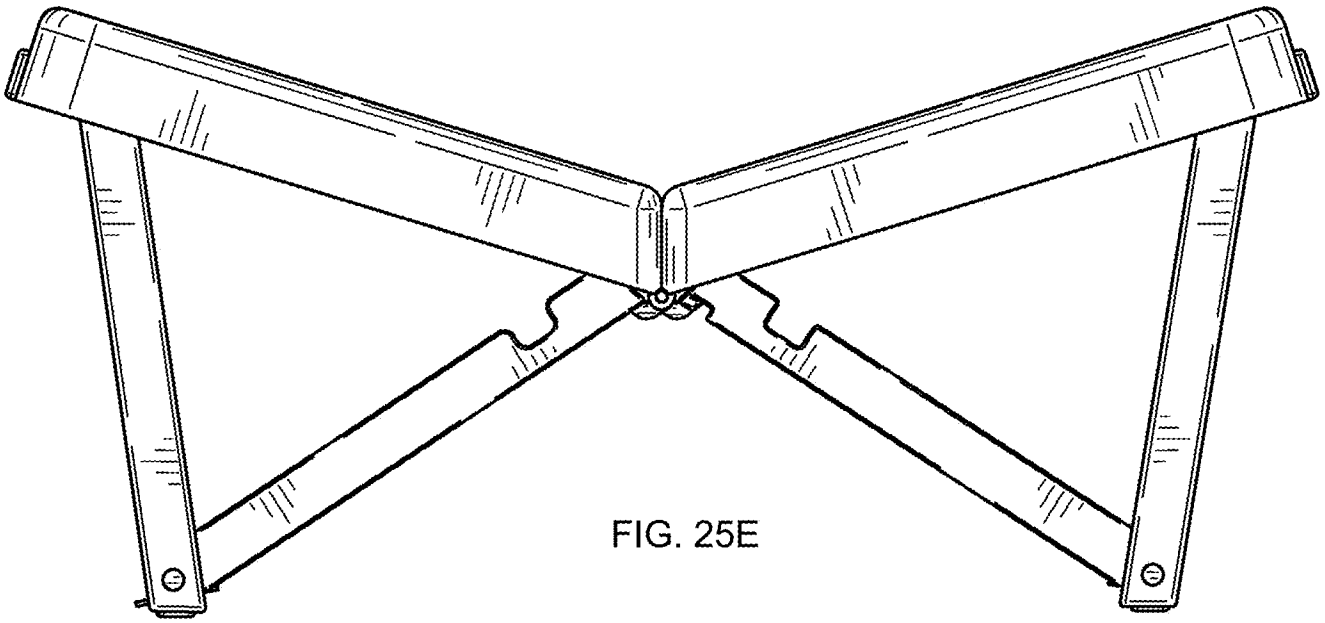
Figure 25F:
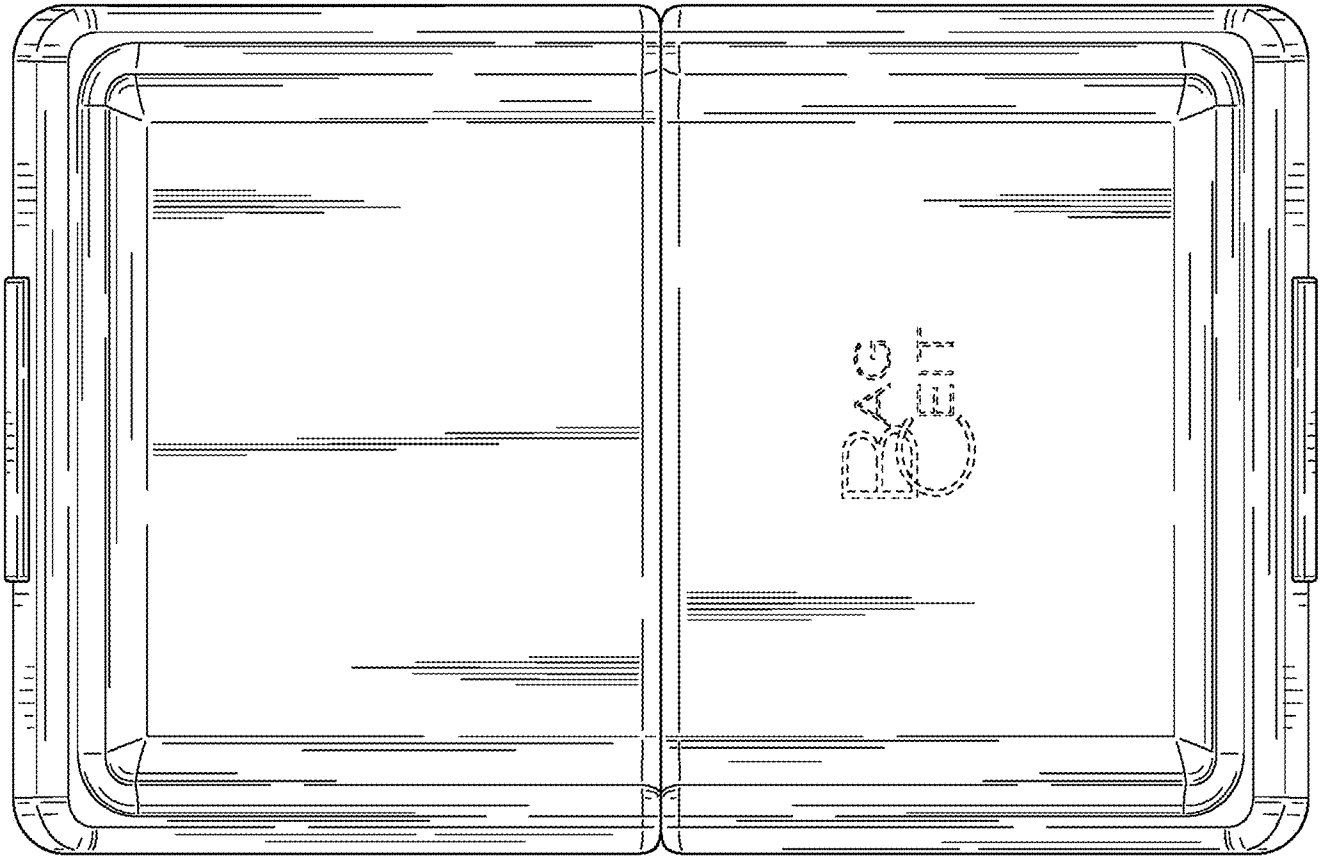
Figure 25G:
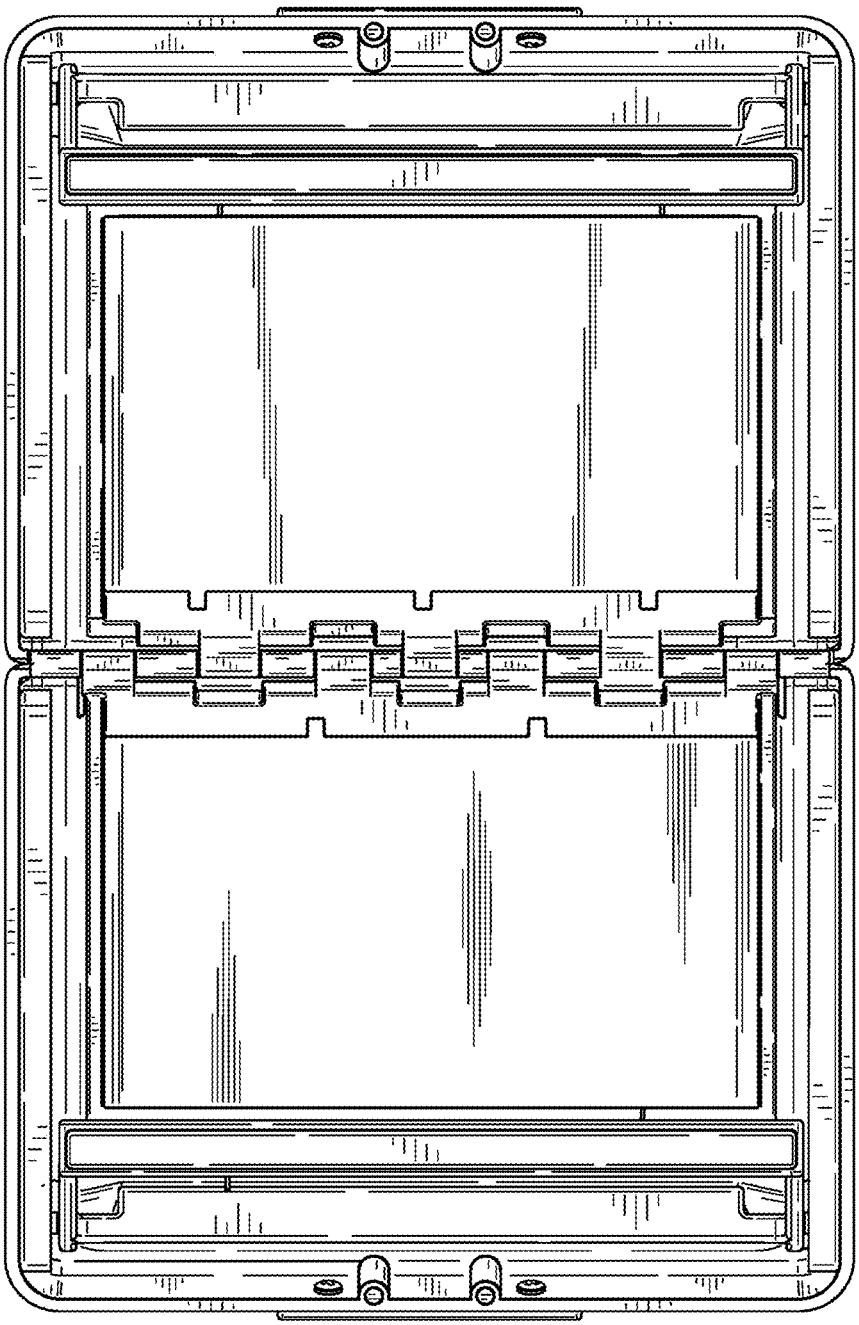
Figure 25H:
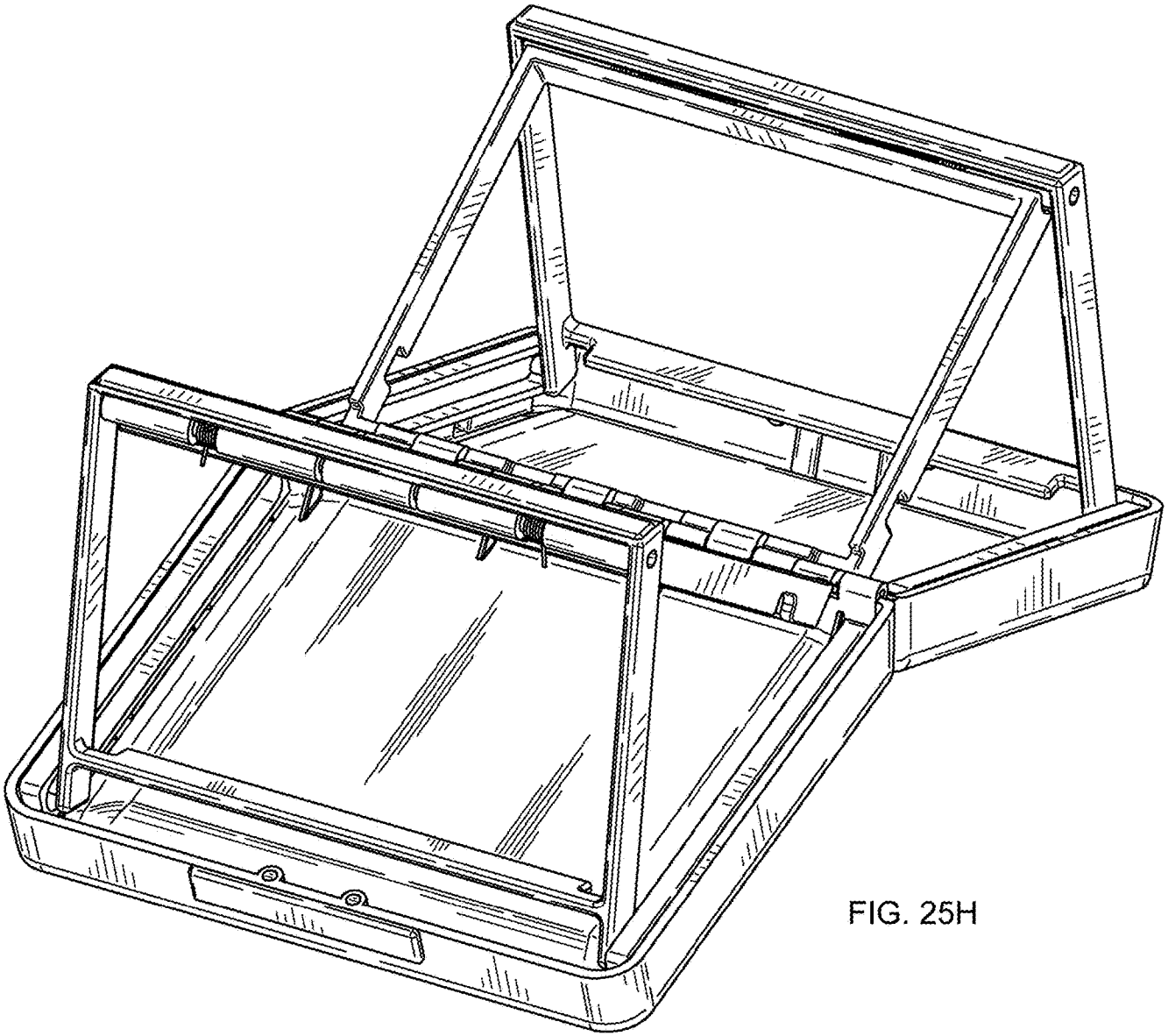

FIG. 24 illustrates example opening and closing functions, according to aspects of the disclosure. In step 1, the Bagceit can be removed from a bag or enclosure (if it is in a bag or enclosure) and opened. In step 2, the legs can fold out and lock into place automatically. In step 3, the Bagceit can be flipped over and can be ready for use. In step 4, the user can flip the Bagceit over the push the legs towards the hinge. In step 5, without touching the bottom, the user can begin to close the Bagceit so that the leg hinges touch. In step 6, the Bagceit can be closed. If there is a bag or enclosure, the Bagceit can be placed inside. If there is not an enclosure, a handle or other element for carrying the Bagceit can be provided.

CONCLUSION

It is to be understood that the disclosed subject matter is not limited in its application to the details of construction and to the arrangements of the components set forth in the description or illustrated in the drawings. The disclosed subject matter is capable of other embodiments and of being practiced and carried out in various ways. Accordingly, other implementations are within the scope of the following claims. Also, it is to be understood that the phraseology and terminology employed herein are for the purpose of description and should not be regarded as limiting. For example, the measurements and/or weights provided are for example purposes only, and many other measurements and/or weights may be used. Those skilled in the art will appreciate that the conception, upon which this disclosure is based, may readily be utilized as a basis for the designing of other products, methods, and systems for carrying out the several purposes of the disclosed subject matter. It is important, therefore, that the claims be regarded as including such equivalent constructions insofar as they do not depart from the spirit and scope of the disclosed subject matter.

It should be noted that any detail(s) or feature(s) of any aspects or embodiment discussed throughout this application can be used with any other detail(s) or feature(s) of any other aspect or embodiment discussed throughout this application.

Although the disclosed subject matter has been described and illustrated in the foregoing exemplary embodiments, it is understood that the present disclosure has been made only by way of example, and that numerous changes in the details of implementation of the disclosed subject matter may be made without departing from the spirit and scope of the disclosed subject matter. For example, the steps and/or limitations in the specification, drawings, and/or claims may be performed in an order other than the order set forth in the specification, drawings, and/or claims. In addition, any component and/or feature shown in any version or option of the product can be used with other components and/or features in any combination.

In addition, it should be understood that any figures which highlight the functionality and advantages are presented for example purposes only. The disclosed methodology and system are each sufficiently flexible and configurable such that they may be utilized in ways other than that shown. For example, other steps may be provided, or steps may be eliminated, from the described flows, and other components may be added to, or removed from, the described systems.

Although the term "at least one" may often be used in the specification, claims and drawings, the terms "a", "an", "the", "said", etc. also signify "at least one" or "the at least one" in the specification, claims and drawings.

Finally, it is the applicant's intent that only claims that include the express language "means for" or "step for" be interpreted under 35 U.S.C. 112(f). Claims that do not expressly include the phrase "means for" or "step for" are not to be interpreted under 35 U.S.C. 112(f).

The invention claimed is:

1. A product for holding an item, comprising:

enclosure shells connected together to form a v-shape surface, the enclosure shells connected together at an edge of each enclosure shell to form the v-shape, and the v-shape surface configured to hold the item when fully opened; and legs that connect to sides of the enclosure shells, the legs configured to hold up the v-shape surface when fully opened; the legs configured to open out automatically until the legs reach a pre-determined fully open position.

2. The product of claim 1, comprising a rib on a bottom side of at least one of the enclosure shells.

3. The product of claim 1, comprising a locking mechanism for the legs on a bottom side of at least one of the enclosure shells.

4. The product of claim 3, wherein the locking mechanism has a spring action.

5. The product of claim 1, comprising a positive stop on a bottom side of at least one of the enclosure shells.

6. The product of claim 1, further comprising a pin.

7. The product of claim 1, comprising magnets to hold the enclosure shells together when the product is closed.

8. A product for holding an item, comprising:

enclosure shells connected together that form a v-shape surface, the enclosure shells connected together at an edge of each enclosure shell to form the v-shape, and the v-shape surface configured to hold the item when fully opened; and legs that connect to sides of the enclosure shells, the legs configured to hold up the v-shape surface when fully opened;

wherein when the enclosure shells are fully opened, the legs open out automatically until the legs reach a pre-determined fully open position.

9. The product of claim 8, wherein the legs fold out and lock into place automatically.

10. The product of claim 8, wherein the legs are spring loaded.

11. The product of claim 8, wherein the legs are spring loaded and move into place automatically.

12. The product of claim 8, wherein the legs comprise hinges to keep the legs in place.

13. The product of claim 12, wherein springs in the hinges lock the legs into place so that the product is unfolded and can be placed upright.

14. The product of claim 8, wherein the product is closed by pushing a lock underneath at least one of the enclosure shells, wherein the lock releases the legs.

15. The product of claim 14, wherein the lock is spring loaded.

16. The product of claim 1, further comprising a handle to carry the product.

17. The product of claim 1, wherein an enclosure packaging is used to hold the product.

18. The product of claim 17, wherein a closed product is put in the enclosure packaging.

19. The product of claim 1, wherein a closed product is smaller than an open product.

20. The product of claim 1, wherein a closed product is more easily portable than an open product.

* * * * *